US008657588B2

(12) United States Patent
Lund

(10) Patent No.: US 8,657,588 B2
(45) Date of Patent: Feb. 25, 2014

(54) COMPRESSION APPARATUS

(75) Inventor: Morten A. Lund, Vista, CA (US)

(73) Assignee: US Airflow, Vista, CA (US)

( * ) Notice: Subject to any disclaimer, the term of this patent is extended or adjusted under 35 U.S.C. 154(b) by 571 days.

(21) Appl. No.: 12/734,578

(22) PCT Filed: Nov. 6, 2008

(86) PCT No.: PCT/US2008/012533

§ 371 (c)(1),
(2), (4) Date: May 10, 2010

(87) PCT Pub. No.: WO2009/061443

PCT Pub. Date: May 14, 2009

(65) Prior Publication Data

US 2011/0044828 A1 Feb. 24, 2011

Related U.S. Application Data

(63) Continuation-in-part of application No. 11/983,476, filed on Nov. 8, 2007, now Pat. No. 8,186,976.

(60) Provisional application No. 60/857,677, filed on Nov. 8, 2006, provisional application No. 60/923,978, filed on Apr. 17, 2007, provisional application No. 61/072,885, filed on Apr. 4, 2008.

(51) Int. Cl.
*F04B 25/02* (2006.01)
*F04B 25/04* (2006.01)

(52) U.S. Cl.
USPC ..... 417/258; 417/259; 417/254; 417/260; 417/262; 417/265

(58) Field of Classification Search
USPC ..... 417/254, 258, 259, 260, 265, 362, 459, 417/545, 555.1, 460, 469, 521, 523, 529; 92/52, 117 A, 109, 110, 181 R, 181 P, 92/140
See application file for complete search history.

(56) References Cited

U.S. PATENT DOCUMENTS

| | | | | | |
|---|---|---|---|---|---|
| 660,793 | A | * | 10/1900 | Grant | 417/254 |
| 722,240 | A | | 3/1903 | Millspaugh | |
| 832,567 | A | * | 10/1906 | Wixon | 417/265 |
| 847,785 | A | * | 3/1907 | Kleinberg | 417/262 |
| 865,019 | A | * | 9/1907 | Dellanna | 417/323 |
| 1,272,651 | A | * | 7/1918 | Foster | 417/258 |
| 2,406,229 | A | * | 8/1946 | Leinweber | 417/250 |
| 2,455,084 | A | * | 11/1948 | Langley | 417/511 |
| 2,963,217 | A | | 12/1960 | Wysong, Jr. | |
| 3,694,111 | A | | 9/1972 | Braun | |

(Continued)

FOREIGN PATENT DOCUMENTS

| | | | | |
|---|---|---|---|---|
| GB | 1043195 | | 9/1966 | |
| GB | 1259755 | | 1/1972 | |
| WO | WO 2005114835 | A2 * | 12/2005 | H03G 5/00 |

*Primary Examiner* — Christopher Bobish
(74) *Attorney, Agent, or Firm* — The Noblitt Group, PLLC

(57) ABSTRACT

A compression apparatus for compressing a fluid, the apparatus having a frame and a motor mounted to the frame, the improvement comprising a drive mechanism installed on the frame so as to be driven by the motor and at least one piston-cylinder unit operably connected to the drive mechanism, the piston-cylinder unit having a cylinder, a piston slidably installed within the cylinder, and a piston rod interconnecting the piston and the drive mechanism so as to shift the piston up and down within the cylinder.

20 Claims, 46 Drawing Sheets

(56) References Cited

U.S. PATENT DOCUMENTS

| | | | | | |
|---|---|---|---|---|---|
| 3,800,675 | A | | 4/1974 | Jacobs | |
| 3,806,134 | A | | 4/1974 | Schexnayder | |
| 4,089,624 | A | * | 5/1978 | Nichols et al. | 417/362 |
| 4,373,876 | A | | 2/1983 | Nemoto | |
| 4,669,364 | A | | 6/1987 | Komatsu et al. | |
| 4,800,730 | A | * | 1/1989 | Hipfl et al. | 62/228.3 |
| 5,050,892 | A | | 9/1991 | Kawai et al. | |
| 5,380,175 | A | * | 1/1995 | Amarume | 417/553 |
| 5,467,687 | A | | 11/1995 | Habegger | |
| 5,702,239 | A | | 12/1997 | Yang | |
| 5,785,506 | A | * | 7/1998 | Takahashi et al. | 417/366 |
| 5,873,705 | A | * | 2/1999 | Chen | 417/259 |
| 6,132,181 | A | | 10/2000 | McCabe | |
| 6,200,110 | B1 | | 3/2001 | Chou | |
| 6,428,290 | B1 | | 8/2002 | Wang | |
| 6,634,869 | B2 | * | 10/2003 | Britz | 417/313 |
| 6,655,935 | B2 | | 12/2003 | Bennitt et al. | |
| 6,776,589 | B2 | | 8/2004 | Tomell et al. | |
| 2002/0061251 | A1 | | 5/2002 | McCabe | |
| 2007/0251379 | A1 | | 11/2007 | Lund | |

* cited by examiner

COMPRESSION APPARATUS

RELATED APPLICATIONS

This application is a national phase application of PCT Application Serial No. PCT/US08/12533, filed Nov. 6, 2008 which claims the benefit of U.S. Provisional Patent Application No. 61/072,885, filed Apr. 4, 2008 and is a continuation-in-part of U.S. patent application Ser. No. 11/983,476, filed on Nov. 8, 2007, which claims the benefit of U.S. Provisional Patent Application Nos. 60/857,677, filed Nov. 8, 2006 and 60/923,978, filed Apr. 17, 2007, and incorporates the disclosure of such applications by reference. To the extent that the present disclosure conflicts with any referenced application, however, the present disclosure is to be given priority.

INCORPORATION BY REFERENCE

Applicant hereby incorporates herein by reference any and all U.S. patents and U.S. patent applications and related international patent applications cited or referred to in this application, including but not limited to: the above-mentioned U.S. Non-provisional and Provisional applications to which a priority claim has been made; International patent application Ser. No. PCT/US2005/018142 filed on May 23, 2005, and entitled "Air Compression Apparatus and Method of Use"; and the two U.S. Provisional patent applications to which the above-referenced PCT application claims priority, namely, U.S. Provisional application Ser. No. 60/573,250 filed May 21, 2004, and entitled "Multi-Stage Compressor with Integrated Internal Breathing" and U.S. Provisional application Ser. No. 60/652,694 filed Feb. 14, 2005, and entitled "Compressor with Variable-Speed Pressure Stroke."

TECHNICAL FIELD

Aspects of this invention relate generally to compression systems, and more particularly to an apparatus for compressing a variety of fluids in one or more stages of operation.

BACKGROUND ART

The following art defines the present state of this field:

Great Britain Patent No. GB 1043195 to Grant describes a reciprocating piston compressor or air motor having a plurality e.g. four cylinders extending radially from an axial valve chamber housing four angularly spaced ports and in which is rotatably mounted an axially adjustable tubular cylindrical distributing valve provided in a central portion with a suction port and a delivery port and adapted to be brought into sequential communication with each valve chamber port, the outer surface of the valve body is provided with a groove which at or immediately prior to opening of delivery port serves to connect the valve chamber port to an annular chamber bounded in part by the drive end of the valve body and the pressure therein acts against the discharge pressure in an annular chamber at the other end of said valve body and the resulting axial displacement of the valve controls the time of opening of the valve ports according to whether the pressure in one chamber is below or above that in another chamber. The valve portion comprises concentric tubes connected by webs and through which the suction port extends whilst the delivery port extends through the outer tube only. An axial extension tube provides air inlet means to said suction port. Each of the four valve chamber ports are roughly triangular and have a side parallel to the valve axis, a side normal to the axis and the third side has two portions of differing slopes which register with portions of the leading edge of the inlet port and with the leading edge of the delivery port. Lubricant is admitted to a bore leading to grooves and cooling water admitted through a pipe traverses a jacket surrounding the valve and a space round each cylinder. The pistons are each secured to a cross-head connected together in diametrically opposed pairs by the outside member whilst adjacent pistons are connected by connecting members and the cross-heads are reciprocated by two eccentric rings each rotatable within a slide block and having secured thereto a dished disc. The latter are secured together at their peripheries by bars and have balancing weights.

Great Britain Patent No. GB 1259755 to Sulzer Brothers Ltd. describes a compressor wherein a piston reciprocates in a cylinder without normally making physical contact with the cylinder, the piston being provided with a split ring having longitudinal grooves in its periphery. The ring may be of P.T.F.E. and acts to guide the piston in the event of abnormal operation causing the piston to approach the cylinder. During normal operation gas escaping past labyrinth seals or labyrinths formed in the periphery of the piston, acts on a conical ring to centre the piston. Radial holes pass through the ring and open into the grooves thereby to provide pressure equalization between the inside and outside of the ring. The piston may be double or, as shown, single acting and driven by a piston rod which extends through a cylinder seal for connection to a cross-head.

U.S. Pat. No. 4,373,876 to Nemoto describes a compressor having a pair of parallel, double-headed pistons reciprocally mounted in respective cylinder chambers in a compressor housing. The pistons are mounted on a crankshaft via Scotch-yoke-type sliders slidably engaged in the respective pistons for reciprocating movement in a direction normal to the piston axis. The sliders convert the rotation of the crankshaft into linear reciprocation of the pistons. The dimensions of these sliders are determined in relation to the other parts of the compressor so that, during the assemblage of the compressor, the sliders may be mounted in position by being passed over the opposite end portions of the crankshaft following the mounting of the pistons and crankshaft within the housing.

U.S. Pat. No. 5,050,892 to Kawai, et al. describes a piston for a compressor comprising a ring groove on the outer circumferential surface of the piston, and a discontinuous ring seal member with opposite split ends made of a plastic material and fitted in the ring groove. The ring member having an outer surface comprising a main sealing portion having an axially uniform shape and an outwardly circumferentially projecting flexible lip portion. Also, the inner surface of the ring member comprises an inner bearing portion able to come into contact with a first portion of a bottom surface of the ring groove such that the flexible lip portion of the outer surface is brought into contact with a cylinder wall of the cylinder bore and preflexed inwardly. An inner pressure receiving portion is formed adjacent to the inner bearing portion to receive pressure from the compression chamber, to further flex the flexible lip portion upon a compression stroke of the compressor and thereby allow the ring member to expand and the main sealing portion to come into contact with the cylinder wall of the cylinder bore.

Japanese Patent Application Publication No. JP 1985/0079585 to Michio, et al. describes a displacer rod bearing body, provided at its upper and lower parts with rod pin mounting parts, and reciprocatively slides a displacer rod bearing surface around a cross rod pin of a cross head. A displacer rod, secured to a displacer, is rotatably supported to an upper rod pin of the bearing body, and a compressor for the displacer is rotatably supported to a lower rod pin.

U.S. Pat. No. 5,467,687 to Habegger describes a piston compressor having at least one cylinder and a piston guided therein in a contact-free manner, which is connected via a piston rod to a crosshead. The piston rod consists of a pipe extending between the crosshead and the piston. In this pipe extends a tension rod, which can be extended by means of a hydraulic stretching device and under prestressing pulls the crosshead and the piston towards the pipe.

U.S. Pat. No. 6,132,181 to McCabe describes a windmill having a plurality of radially extending blades, each being an aerodynamic-shaped airfoil having a cross-section which is essentially an inverted pan-shape with an intermediate section, a leading edge into the wind, and a trailing edge which has a flange doubled back toward the leading edge and an end cap. The blade is of substantial uniform thickness. An air compressor and generator are driven by the windmill. The compressor is connected to a storage tank which is connected to the intake of a second compressor.

U.S. Patent Application Publication No. U.S. 2002/0061251 to McCabe describes a windmill compressor apparatus having multiple double acting piston/cylinders actuated by the windmill. The windmill additionally has multiple pairs of blades to enhance power output and lift.

U.S. Pat. No. 6,655,935 to Bennitt, et al. describes a gas compressor and method according to which a plurality of inlet valve assemblies are angularly spaced around a bore. A piston reciprocates in the bore to draw the fluid from the valve assemblies during movement of the piston unit in one direction and compress the fluid during movement of the piston unit in the other direction and the valve assemblies prevent fluid flow from the bore to the valve assemblies during the movement of the piston in the other direction. A discharge valve is associated with the piston to permit the discharge of the compressed fluid from the bore.

U.S. Pat. No. 6,776,589 to Tomell et al. describes a reciprocating piston compressor having a suction muffler and a pair of discharge mufflers to attenuate noise created by the primary pumping frequency in the primary pumping pulse. The suction muffler is disposed along a suction tube extending between the motor cap and the cylinder head of the compressor. The discharge mufflers are positioned in series within the compressor to receive discharge gases from the compression mechanism and are spaced one quarter of a wavelength from each other so as to sequentially diminish the problematic or noisy frequencies created during compressor operation. The motor/compressor assembly including the motor and compression mechanism is mounted to the interior surface of the compressor housing by spring mounts. These mounted are secured to the housing to define the position of the nodes and anti-nodes of the frequency created in the housing to reduce noise produced by natural frequencies during compressor operation.

U.S. Pat. No. 2,963,217 to Wysong, Jr. describes a reciprocating air compressor for supplying and maintaining compressed air in a pneumatic suspension system for vehicles including a high pressure storage tank and a low pressure return tank. The compressor comprises a unitary housing forming the cylinder body and crankcase. The crankcase has an open side wall over which is bolted an elongated annular crankcase cover in which is rotatably supported a single throw counter-balanced crankshaft. Operatively engaging the crankshaft throw is a one-piece connecting rod which, in turn, is connected to a piston movable in the cylinder. The open top end wall of the cylinder body has bolted thereover an exhaust valve plate assembly and cylinder head. In operation, air is drawn from a low pressure tank, through the crankcase, passes through a suitable intake valve in the piston and is exhausted to the high pressure tank through an outlet formed in the cylinder head. An exhaust valve disposed between the outlet and the piston prevents return of the compressed air to the cylinder during the downstroke of the piston.

U.S. Pat. No. 3,694,111 to Braun describes an improved free piston engine with an improved bounce compressor which includes a bounce compressor cylinder and a bounce compressor piston reciprocally movable with respect to each other. The engine includes venting means for the bounce compressor cylinder which provides a limited high velocity ejection of fluid from such cylinder at a location and in a manner adapted to insure regular periodic removal of contaminants from a bounce chamber within said cylinder. In one embodiment, passage means formed in the bounce compressor piston and bounce compressor cylinder, and check valves positioned in the bounce compressor piston, allow the controlled venting of the air contained within the bounce compressor chamber during a portion of the bounce compressor cycle and allow uncontaminated air to be introduced into the bounce chamber during another portion of the bounce compressor cycle, so as to minimize the contaminants in the bounce chamber. Alternate embodiments are also shown which similarly permit contaminants or contaminated air in the bounce chamber to be vented.

U.S. Pat. No. 3,800,675 to Jacobs describes a refrigerant compressor including a housing having a compact piston-intake valve assembly mounted for reciprocation within a cylinder bore. The piston-valve assembly is formed from tubular material with its ends covered by a flexible metal inlet valve whose peripheral edge engages the end of the piston. The circular intake valve is spot welded at two diametrically opposite locations to secure the valve to the end of the tubular piston.

U.S. Pat. No. 3,806,134 to Schexnayder describes a seal means between the plunger and cylinder of a pneumatic actuator of the kind used for remote actuation of a spool valve or other mechanical device to which rectilinear movement is imparted from a distant position. The seal is contained in a groove circumscribing a plunger where it is loosely fitted so that it is self-centering. It is of durable, flexible material for wear resistance in operation against a cylinder wall and is urged into contact with the wall by an annulus of a more highly elastic material.

U.S. Pat. No. 4,669,364 to Komatsu et al. describes a rack-and-pinion steering gear structure for a vehicle including a rack housed within a cylinder and driven by means of a pinion shaft, comprising an annular piston received with suitable axial clearance in an annular groove defined by three surfaces, namely the end face of one end of the rack, a seating surface of a head of a bolt screwed into a boss projecting from the end of the rack, and the outer periphery of the boss itself. An elastic annular seal member is interposed between the inner periphery of the piston and the outer periphery of the boss.

U.S. Pat. No. 6,200,110 to Chou describes an air compressor including a housing having a tube extended from the top and having a passage communicating the housing with the tube and having a tapered surface. A piston is slidably received in the chamber of the housing and is forced to move along the housing in a reciprocating action and to force the air out through the tube via the passage. The provision of the tapered surface allows the piston to smoothly move in the housing. A stop is adjustably spring-biased to block the passage. The piston has a spring blade to block an aperture to control the air into the housing.

In connection with combination compressor and vacuum pump units, more particularly, a typical application of such technology is in connection with an oxygen concentrator or oxygen generator, a device used to provide oxygen therapy to a patient at substantially higher concentrations than those of ambient air and so employed as an alternative to tanks of compressed oxygen. Oxygen concentrators may also provide an economical source of oxygen in industrial processes. The typical oxygen concentrator works off of the principle of Pressure Swing Adsorption (PSA). A PSA concentrator is capable of continuous delivery of oxygen and has internal functions based around two cylinders, or beds, filled with a zeolite material, which selectively adsorb the nitrogen in the air. In each cycle, air is flowed through one cylinder at a pressure of around 20 $lbf/in^2$ (138 kPa or 1.36 atmospheres) where the nitrogen molecules are captured by the zeolite, while the other cylinder is vented off to ambient atmospheric pressure allowing the captured nitrogen to dissipate. Such units typically have cycles of around 20 seconds and allow for a continuous supply of oxygen at a flow rate of up to approximately five liters per minute (LPM) at concentrations anywhere from 50 to 95%. A similar prior art process is known as Vacuum Pressure Swing Adsorption (VPSA), which uses a single low pressure blower and a valve which reverses the flow through the blower so that the regeneration phase occurs under a vacuum. A still further alternative prior art approach to oxygen concentration employs technology known as Advanced Technology Fractionator (ATF). A rotary distribution valve built into the ATF directs the flow of compressed air to a group of four molecular sieve beds at any given time. Simultaneously, another four beds are allowed to purge to atmosphere through the rotary valve. The remaining four beds are interconnected through the valve to equalize pressure as they transition between adsorbing and desorbing. The combined twelve sieve beds of the ATF device contain about the same amount of molecular sieve as the conventional two-bed oxygen concentrator. In any of the above approaches, a compressor or a combination compressor and vacuum pump may be employed in pressurizing, delivering, and/or purging air within the system as the concentrator operates. A typical such compressor and vacuum pump unit is manufactured and sold by Rietschle Thomas. For example, the WOB-L® Piston design Model 2250 employs a rocker piston arrangement driven by a brushless DC motor offering variable speed from 1,000 to 3,000 RPM, whereby the air flow of the concentrator can be varied according to patient need. In addition, an optional closed loop controller may allow motor speed to be maintained at a pre-set, constant RPM regardless of load or voltage fluctuations. The oil-less piston and cylinder prior art design reduces contaminants in the air flow, and the use of magnesium components minimizes the pump's weight, important features for portable oxygen concentrators.

The prior art described above teaches single and double-acting air cylinders and other such compression and vacuum pump devices and related drive mechanisms, seals and valves therefor, but does not teach, among other things, various arrangements by which the piston rod is configured with a sufficient outside diameter as compared to the inside diameter of the cylinder within which the piston rod is operating such that the rod itself serves to displace volume and thereby participate in the compression of the fluid in various stages of operation. Aspects of the present invention fulfill this need and provide further related advantages as described in the following disclosure.

DISCLOSURE OF INVENTION

Aspects of the present invention teach certain benefits in construction and use which give rise to the exemplary advantages described below.

In a first aspect of the present invention, a compression apparatus includes a piston rod having a sufficient outside diameter as compared to the inside diameter of the cylinder within which the piston rod is operating such that the rod itself serves to displace volume and thereby participates in the compression of the fluid in various stages of operation.

In a further aspect of the present invention, at least one piston-cylinder unit is operably connected to a drive mechanism, the piston-cylinder unit having a displacement rod connected to the drive mechanism so as to shift a piston up and down within a cylinder, the displacement rod having an outside diameter relative to the inside diameter of the cylinder such that the ratio of the nominal surface area below the piston to the nominal surface area above the piston is in the range of 1.1 to 20.

In a further aspect of the present invention, the drive mechanism comprises first and second timing pulleys rotatably mounted in a spaced apart relationship on a common side of a frame, a drive pulley installed on a drive shaft of a motor so as to be positioned substantially co-planar with the first and second timing pulleys, and a timing belt configured to engage the drive pulley and the first and second timing pulleys.

In a further aspect of the present invention, the drive mechanism comprises a flywheel rotatably mounted on the frame, the flywheel rotating about a first shaft, a pulley installed on a drive shaft of the motor so as to be positioned substantially co-planar with the flywheel, a belt configured to engage the pulley and the flywheel, a first linkage pivotably installed on a second shaft installed in the frame opposite the flywheel, a base of the cylinder being pivotably installed to one end of the first linkage, and a second linkage pivotably installed to the end of the first linkage opposite the connection of the cylinder base, the displacement rod and the second linkage being pivotably connected to a crank installed on the flywheel offset from the first shaft, whereby rotational movement of the flywheel as driven by the motor through the pulley and the belt shifts the cylinder and the displacement rod spatially so as to drive the piston up and down within the cylinder.

In a further aspect of the present invention, the piston-cylinder unit comprises a cylinder having a cylinder wall and a collar assembly installed on the cylinder wall through which the displacement rod slidably and sealingly passes, the collar assembly including an exit hole in which a connector is installed for transfer of the fluid.

In a further aspect of the present invention, the piston-cylinder unit is further formed having a reaction chamber in the collar assembly of the cylinder, whereby compressed fluid is stored in the reaction chamber as a pre-charged, pressurized fluid to be pushed into a subsequent compression stage.

In a further aspect of the present invention, the piston-cylinder unit comprises a cylinder having a cylinder wall and a base cap installed on the cylinder wall having a profile substantially conforming to that of the piston, including geometry to accommodate a downwardly-extending piston wall of the piston, whereby the clearance pocket below the piston at the bottom of the stroke of the piston-cylinder unit is reduced.

In a further aspect of the present invention, the piston-cylinder unit comprises a displacement rod having a tubular configuration and further comprising a top cap installed on the displacement rod and having at least one top channel formed therein for communication between the space surrounding the piston-cylinder unit and the tubular displacement rod and a bottom cap installed on the displacement rod substantially opposite the top cap and having at least one bottom channel formed therein for communication between the tubular displacement rod and the space below the piston within the cylinder as controlled by a piston valve installed on the piston opposite the bottom cap, whereby fluid can pass through the displacement rod into the piston-cylinder unit.

In a further aspect of the present invention, the piston-cylinder unit comprises a piston having a piston body with at least one through-hole formed therein for communication between the space below the piston within the cylinder and the space above the piston within the cylinder as bounded laterally by the displacement rod and a cylinder wall of the cylinder in which the piston is slidably installed, a piston wall installed on the piston body for slidably sealing against the cylinder wall, and a piston valve installed on the piston for selectively controlling the passage of fluid through the at least one through-hole.

In a still further aspect of the present invention, the compression apparatus has a direct drive motor mounted to the frame, two offset arms installed on a shaft of the motor, and a piston-cylinder unit operably connected to each offset arm, each piston-cylinder unit having a cylinder, a piston slidably installed within the cylinder, and a piston rod interconnecting the piston and the respective offset arm so as to shift the piston up and down within the cylinder.

In a further aspect of the present invention, each cylinder is pivoted on a stud about an intermediate point along the cylinder.

In a further aspect of the present invention, the piston-cylinder units are arranged in series as in a multi-staging set up, the apparatus further comprising a first line connected to an exit valve of a first piston-cylinder unit, a second line connected to an inlet valve of a second piston-cylinder unit, and an intermediate surge tank connected between the first and second lines.

In a still further aspect of the present invention, at least one first through-hole is formed in a first piston body of the first piston of a first piston-cylinder unit so as to selectively communicate between the space below the first piston and the space above the first piston within the first cylinder, and a first piston valve is installed on the first piston so as to selectively open the at least one first through-hole, thereby allowing the fluid to pass through the first piston during movement of the first piston within the first cylinder, whereby the first piston on the down stroke within the first cylinder compresses the fluid in the space within the first cylinder below and above the first piston in a first stage of compression, the first stage compressed fluid then being momentarily trapped within the space above the first piston as controlled by the first piston valve, and the first piston on the up stroke within the first cylinder further compresses the first stage compressed fluid in the space within the first cylinder above the first piston in a second stage of compression.

In a further aspect of the present invention, a second piston-cylinder unit having a second cylinder, a second piston slidably installed within the second cylinder, and a second piston rod driving the second piston up and down within the second cylinder receives the second stage compressed fluid from the first piston-cylinder unit in the space within the second cylinder below the second piston when the second piston is on its up stroke, whereby the second stage compressed fluid assists in pushing the second piston upward during its up stroke.

In a yet further aspect of the present invention, at least one second through-hole is formed in a second piston body of the second piston of the second piston-cylinder unit so as to selectively communicate between the space below the second piston and the space above the second piston within the second cylinder, and a second piston valve is installed on the second piston so as to selectively open the at least one second through-hole, thereby allowing the second stage compressed fluid to pass through the second piston during movement of the second piston within the second cylinder, whereby the second piston on the down stroke within the second cylinder compresses the second stage compressed fluid in the space within the second cylinder below and above the second piston in a third stage of compression, the third stage compressed fluid then being momentarily trapped within the space above the second piston as controlled by the second piston valve, and the second piston on the up stroke within the second cylinder further compresses the third stage compressed fluid in the space within the second cylinder above the second piston in a fourth stage of compression.

In a further aspect of the present invention, a compressor piston-cylinder unit comprises a hollow first piston rod connected to a first piston operable within a first cylinder so as to form the compressor piston-cylinder unit, whereby air is pulled into the compressor piston-cylinder unit through the first piston rod for compression therein.

In a further aspect of the present invention, a vacuum pump piston-cylinder unit comprises a hollow second piston rod connected to a second piston operable within a second cylinder so as to form the vacuum pump piston-cylinder unit, whereby air is exhausted from the vacuum pump piston-cylinder unit through the second piston rod.

In a further aspect of the present invention, the compressor piston-cylinder unit and the vacuum pump piston-cylinder unit are mechanically coupled to a common drive mechanism through the respective first and second hollow piston rods.

In a further aspect of the present invention, the first and second pistons comprise an annular piston body formed with at least one circumferential, spaced-apart groove thereabout.

In a still further aspect of the present invention, at least one channel is formed in an outer wall of a piston base sub-assembly, and an o-ring is seated in the at least one channel so as to secure the piston body on the piston base sub-assembly in a rooted fashion, whereby side load and mechanical and thermal expansion forces on the piston body during operation of the piston within the cylinder are minimized and centering and even wear of the piston body are encouraged.

In yet a further aspect of the present invention, the piston base sub-assembly has at least one through-hole, a floating disk valve is installed substantially adjacent to the piston base sub-assembly, the disk valve having at least one groove formed within a surface thereof substantially opposite the piston base-sub-assembly, and an o-ring seated within the at least one groove so as to selectively seal about the at least one through-hole.

In a still further aspect of the present invention, at least one of the piston-cylinder units further comprises a cylinder body having an upper end with a stepped bore formed therein.

In a still further aspect of the present invention, at least one of the piston-cylinder units further comprises a cylinder body having an upper end and a cylinder inside diameter, and an upper cap installed on the cylinder body substantially at the upper end, the upper cap having a cap inside diameter that is larger than the cylinder inside diameter.

Other features and advantages of aspects of the present invention will become apparent from the following more detailed description, taken in conjunction with the accompanying drawings, which illustrate, by way of example, the principles of aspects of the invention.

BRIEF DESCRIPTION OF DRAWINGS

The accompanying drawings illustrate aspects of the present invention. In such drawings.

MODES FOR CARRYING OUT THE INVENTION

Figure 1:
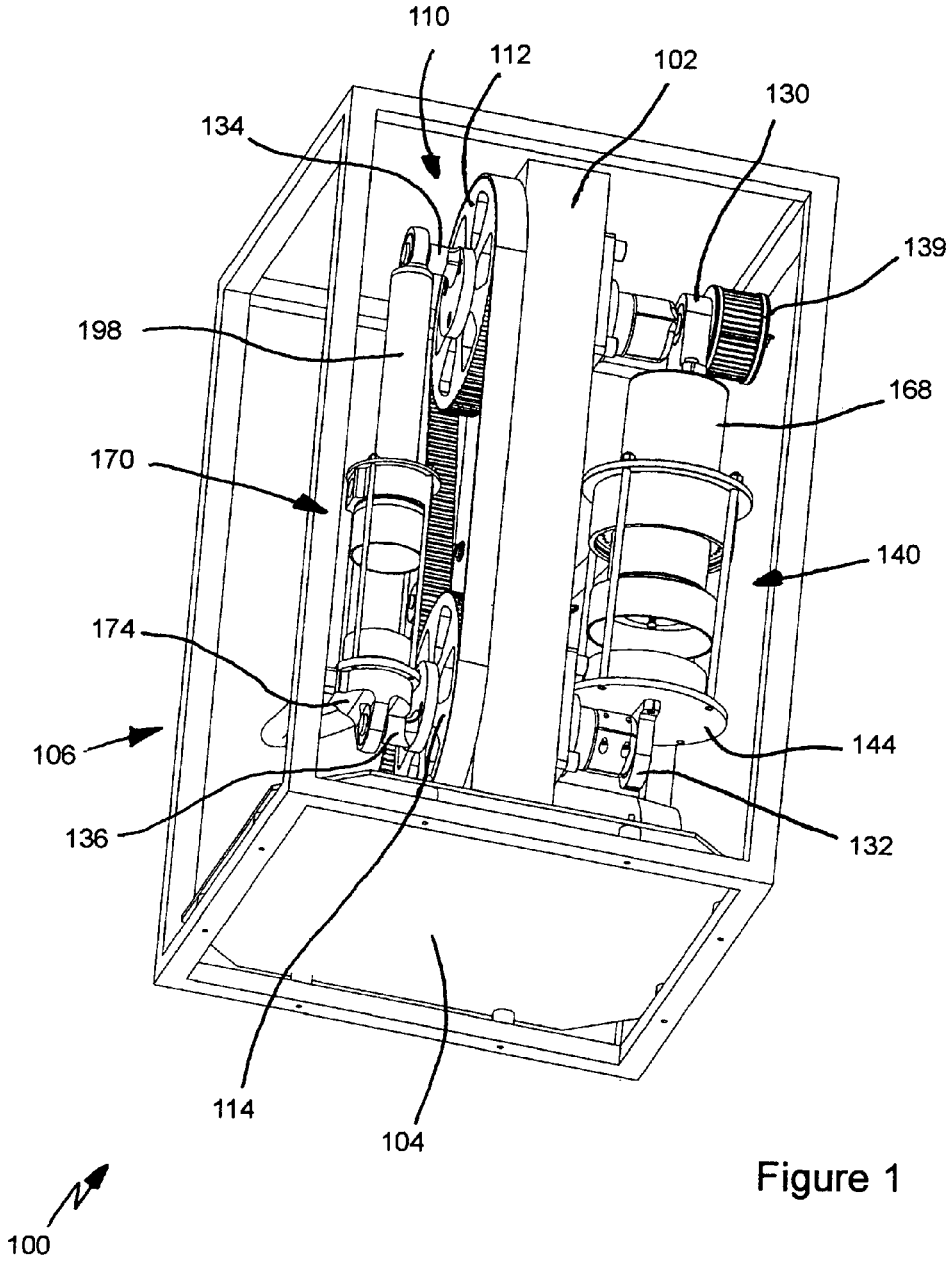
FIG. 1 is a partial bottom left perspective view of an exemplary embodiment of the compression apparatus of the present invention.

The above described drawing figures illustrate aspects of the invention in at least one of its exemplary embodiments, which are further defined in detail in the following modes.

The subject of this patent application is an improved compression apparatus capable of compressing in one or more stages a variety of fluids, where "fluid" as used throughout, including in the claims, is to be understood to mean and apply to any compressible medium, whether gas or gas with liquid, such fluid including but not limited to air. The overall compression apparatus described herein is generally comprised of an assembly made up in part of one or more cylinders, each containing a piston which is driven by a rod connected to a crank. The connection between the rod and the crank can take many forms depending on the design and application, but is typically achieved by attaching the free end of the rod to a timing pulley, as shown in the exemplary embodiment, or to flywheel, a pivoting arm, a cam follower arrangement, a direct drive motor, or other such mechanism so that each cylinder assembly moves relative to the crank in a manner that manipulates the velocity of travel of the piston and thereby increases the leverage exerted against the fluid within the cylinder when the piston is approaching its top and bottom positions, or potentially highest points of compression in that particular stage. It will be appreciated by those skilled in the art that while the general structure and operation of the improved compressor of the present invention is shown and described herein in various exemplary embodiments, the invention is not so limited. Rather, aspects of the present invention generally relate to mechanisms by which one or more piston-cylinder arrangements are driven so as to achieve dynamic movement of the piston within the cylinder while minimizing side loads and are themselves configured with piston rod and piston and piston valve configurations to achieve the desired fluid movement and compression in various contexts. Accordingly, numerous other designs and constructions are possible without departing from the spirit and scope of the invention.

With respect to the piston-cylinder unit, aspects of the present invention relate to various arrangements by which the piston rod is configured with a sufficient outside diameter as compared to the inside diameter of the cylinder within which the piston rod is operating such that the rod itself serves to displace volume and thereby participate in the compression of the fluid in various stages of operation, as explained in more detail below. In the exemplary embodiments, the fluid is compressed in a first stage of operation on the piston's down stroke by being transferred from the bottom chamber of each cylinder, or the space below the piston, to the top chamber, or the space above the piston, by passing through the piston itself and then being compressed in both the top and bottom chambers substantially simultaneously, or during the same stroke, in part, as by being displaced by the large diameter piston rod. In a second stage of operation, the fluid is then further compressed in the top chamber of the cylinder when the piston valve closes on the piston's upstroke. However, it will be appreciated that other valve arrangements beyond those shown and described may be employed by which the chambers operate cooperatively or independently, such that the invention is not so limited. As such, the valve configurations and the locations of both the inlets and outlets for the two chambers of each cylinder may vary depending on the design and application, exemplary ones of which are described further below. In any such cylinder designs, depending on the particular embodiment of the compressor, the air or other fluid compressed in a first cylinder, whether in one or two stages of operation and whether single-acting or double-acting, may be transferred to a pressure holding tank or to further cylinders for additional stages of compression. The additional cylinders may be connected to the same drive mechanism as the first cylinder, as in the exemplary embodiment, or to a separate drive mechanism. It will be appreciated that by compressing fluid on the upstroke and the down stroke in each cylinder, as in the exemplary two-cylinder, four-stage compression apparatus, the useful work done by each piston is effectively doubled for the same work by the motor in cycling the piston through its stroke, or put another way, the peak load on the motor may be cut in half while still getting the same or better output in terms of pressure and/or flow rate of the compressed fluid, greatly increasing efficiency. Moreover, by compressing the fluid in the bottom and top chambers on the down stroke, or during a first phase of compression in each cylinder caused, in part, by the piston valving and the displacement rod, and then compressing the fluid further on the upstroke, or during a second phase of compression in each cylinder, the fluid moves through the cylinder at all stages of compression in a relatively more laminar fashion. These effects coupled with the relatively longer or larger volume stroke and intermittent speed of the piston thus enable the fluid to effectively be "squeezed" rather than "slammed," providing numerous additional benefits in terms of the performance, cost, and maintenance of the cylinders and the rest of the compressor. These and other advantages of the present invention will be further apparent with reference to the following more detailed description and the accompanying drawing figures. First described below is the exemplary embodiment of the drive mechanism and overall compressor structure with general reference to the operation of the piston itself, with further more detailed descriptions of the design and operation of various exemplary piston-cylinder configurations then following.

Referring first to FIGS. 1-8, there is shown in various views an exemplary embodiment of an improved compression apparatus embodying aspects of the present invention. In this exemplary embodiment, the compression apparatus 100 is an assembly generally comprised of a frame 102, a drive mechanism 110 operably installed on the frame 102, and two piston-cylinder units 140, 170 operably connected to the drive mechanism 110 on opposite sides of the frame 102. In a bit more detail, the frame 102 is shown as a substantially vertical member of tubular rectangular cross-section. The frame 102 itself may be mounted on a base 104 of an enclosure 106 in any appropriate manner now known or later developed. In the exemplary embodiment, rubber grommets 105 are spaced between the base 104 and the enclosure 106 for vibration damping. The materials of construction and methods of fabricating and assembling the frame 102, base 104, and enclosure 106 may also involve any appropriate technology now known or later developed. In the exemplary embodiment, such components are fabricated from aluminum. It will be appreciated that any or all such components can be scaled or oriented as needed to suit particular applications, such as orienting the frame 102 substantially horizontally rather than vertically, for example, such that the exemplary configuration shown and described is to be understood as being merely illustrative of aspects of the invention.

Continuing with a general discourse related to the exemplary compression apparatus 100 shown in FIGS. 1-8, the drive mechanism 110 is shown as generally comprising first and second timing pulleys 112, 114 rotatably mounted in spaced apart relationship on a common side of the frame 102, a motor 116 mounted on the base 104 so as to have a pulley 118 installed on the motor's drive shaft 120 positioned substantially co-planar with the first and second timing pulleys 112, 114, and a belt 122 configured to engage the drive pulley 118 and the first and second timing pulleys 112, 114. A belt tensioner 124 may also be installed on the frame 102 or in any other suitable location and manner to maintain proper tension on the belt 122 as it is driven in engaging relationship with the first and second timing pulleys 112, 114 by the drive pulley 118 of the motor 116. The belt tensioner 124 would take up any slack in the belt 122 during normal operation as the loading on the drive mechanism 110, and thus belt stretch or wear, varies during use of the compression apparatus 100. Moreover, such a tensioner 124 may also cooperate with other components of the assembly in allowing changes to the operation of the unit to suit different applications and affect different performance, as by changing out the drive pulley 118 or one or both of the timing pulleys 112, 114, for example, to modify the speed at which the compression apparatus 100 operates or to accommodate adjustments to or wholesale substitution of one or both of the piston-cylinder units 140, 170. As with the frame 102 and other components of the system 100, it will be appreciated that the timing pulleys 112, 114 and belt 122 and other components making up the drive mechanism 110 also may be formed of any suitable material now known or later developed. In the exemplary embodiment, the timing pulleys are cast iron and the belt 122 is a standard industrial timing belt. The motor 116 is a 5 hp, 1,725 rpm AC motor. Again, such components can be scaled up or down and substituted out depending on the application (the desired output of the compression apparatus in terms of pressure and flow rate, for example).

Figure 2:
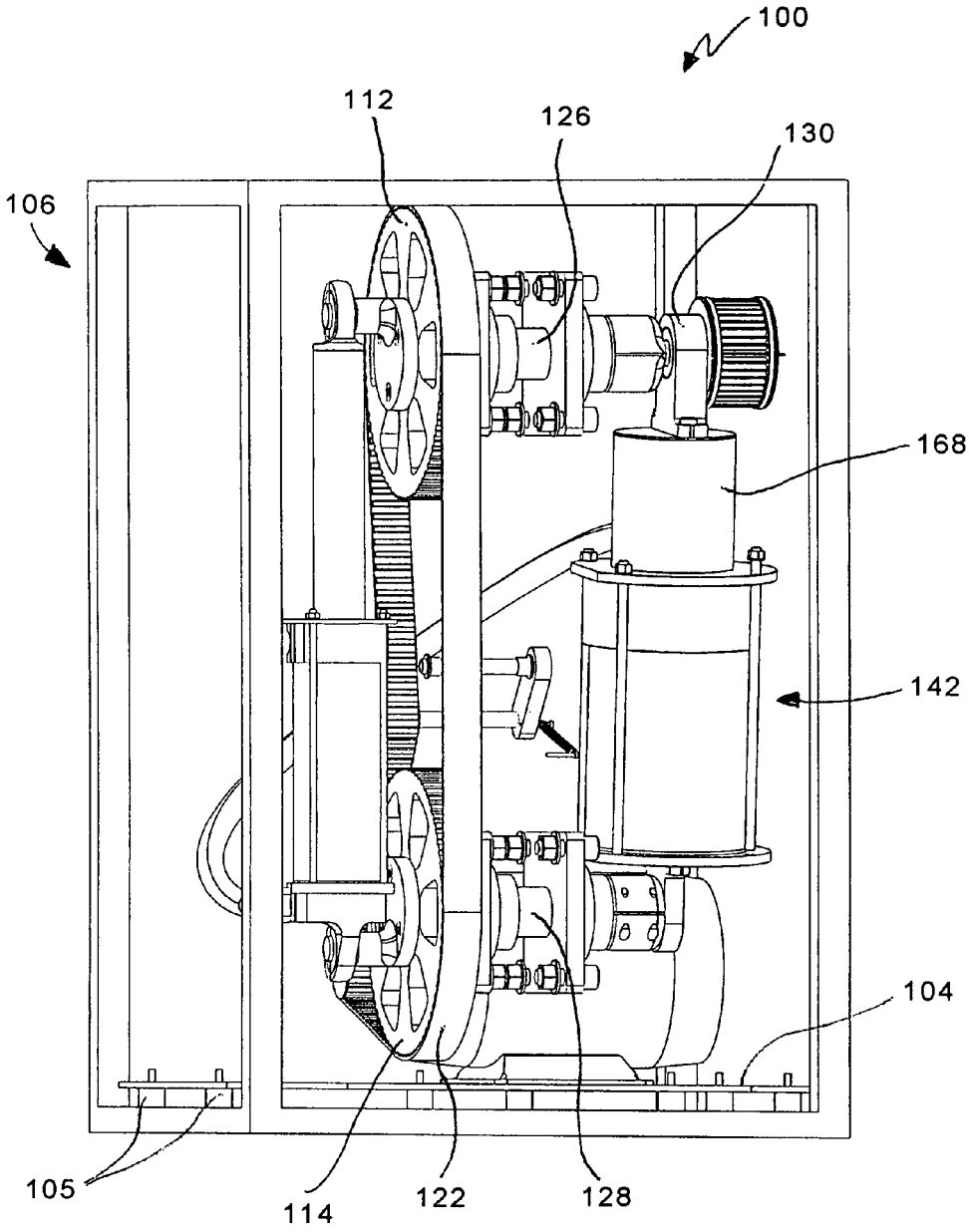
FIG. 2 is a partial top left perspective view thereof.
Figure 3:
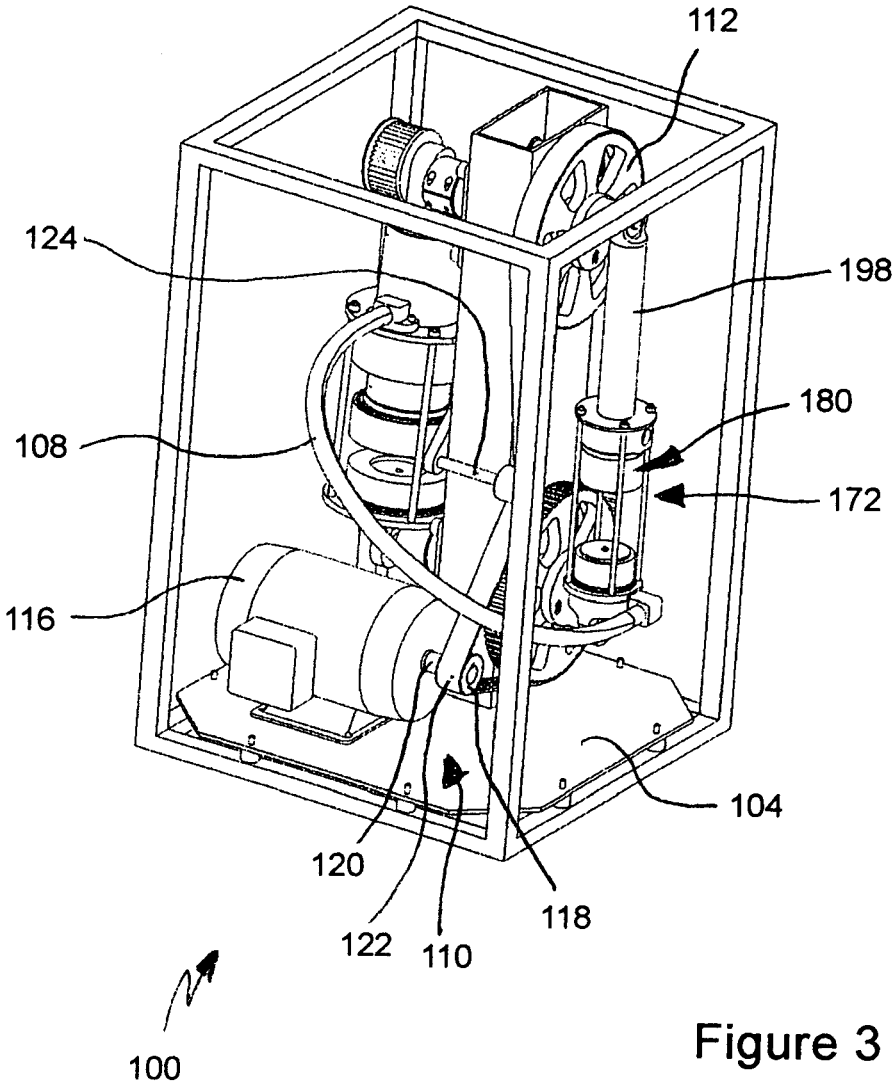
FIG. 3 is a partial top right perspective view thereof.
Figure 4:
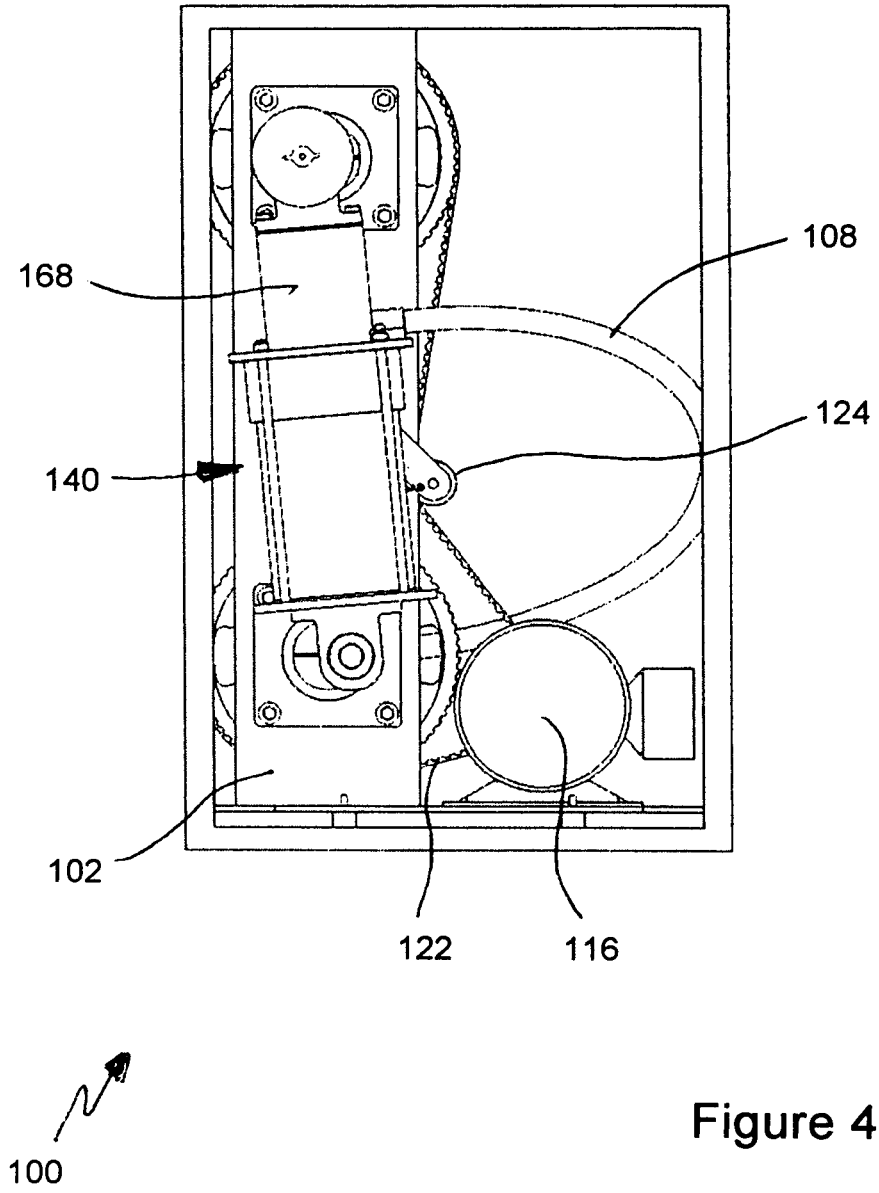
FIG. 4 is a partial front view thereof.
Figure 5:
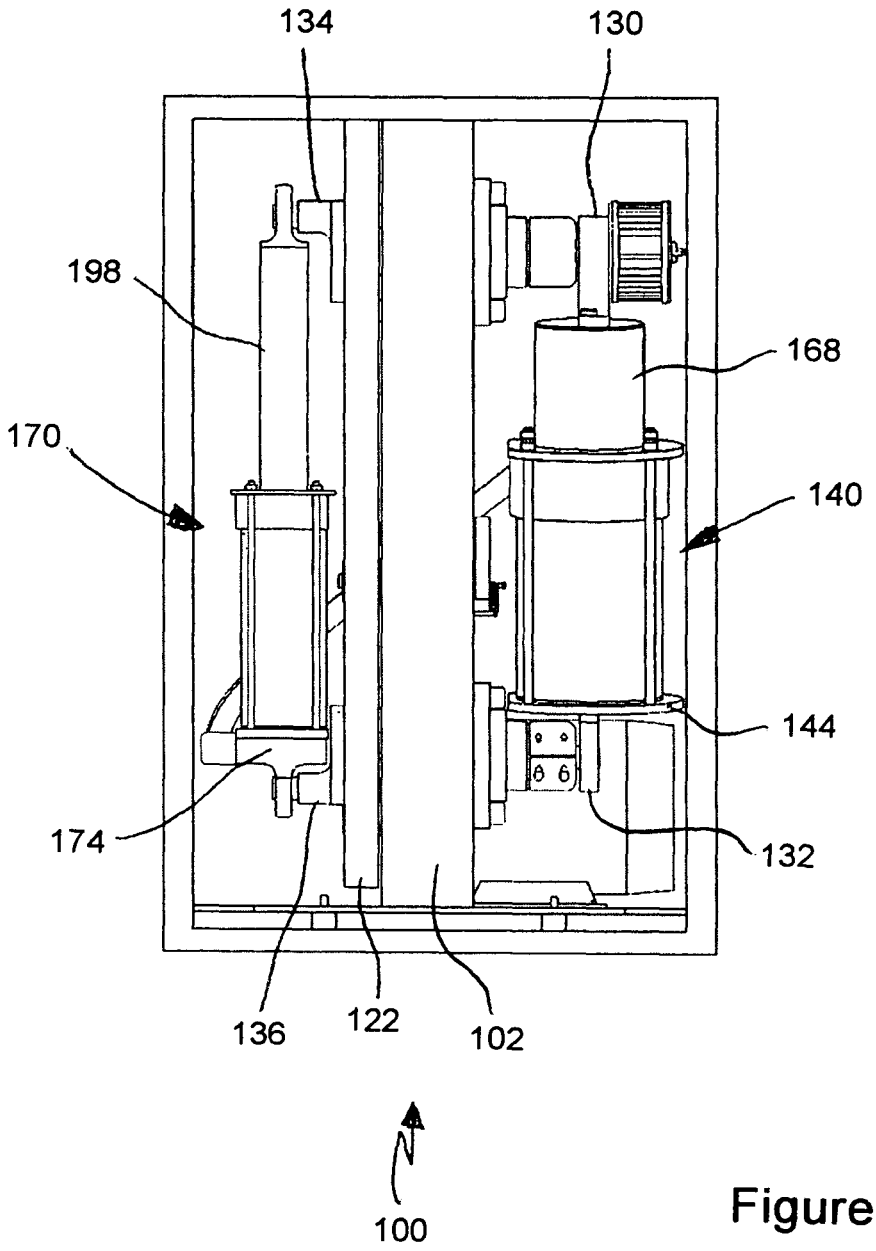
FIG. 5 is a partial left side view thereof.
Figure 6:
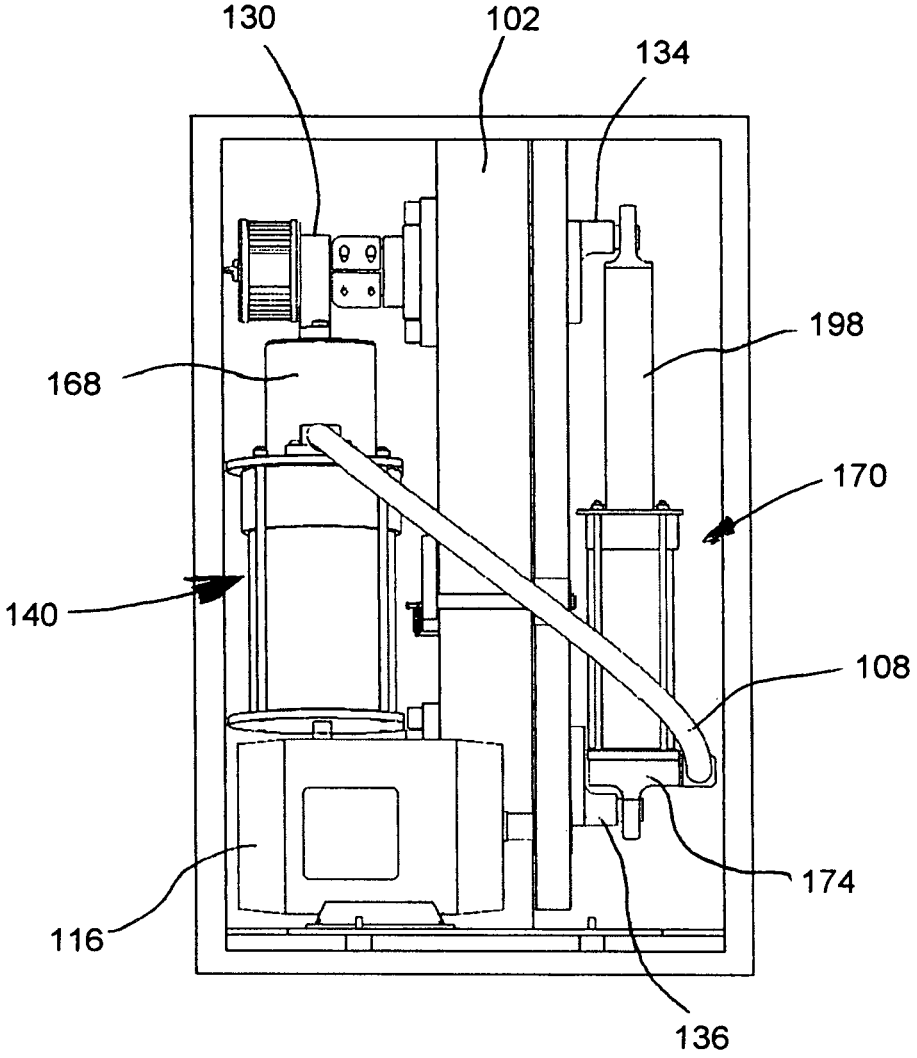
FIG. 6 is a partial right side view thereof.
Figure 6:
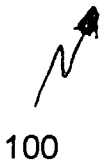
Figure 7:
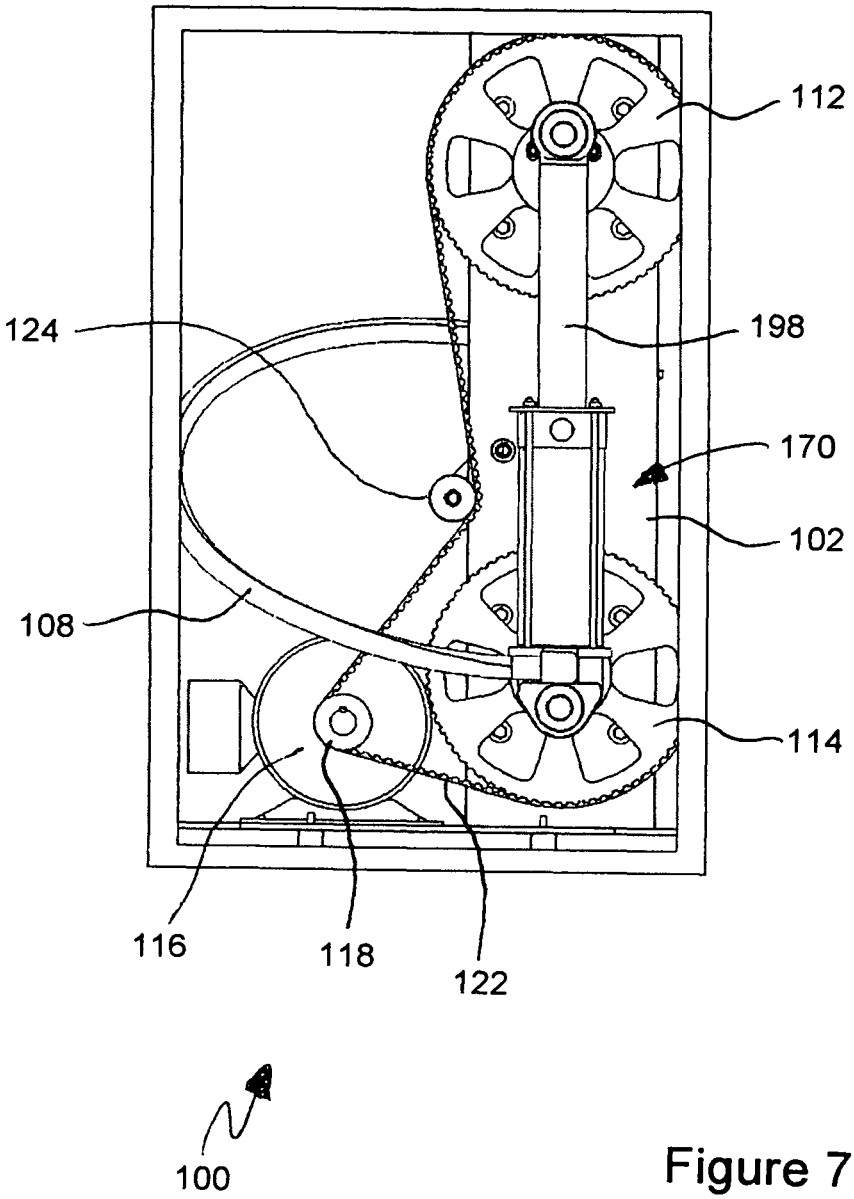
FIG. 7 is a partial back view thereof.
Figure 8:
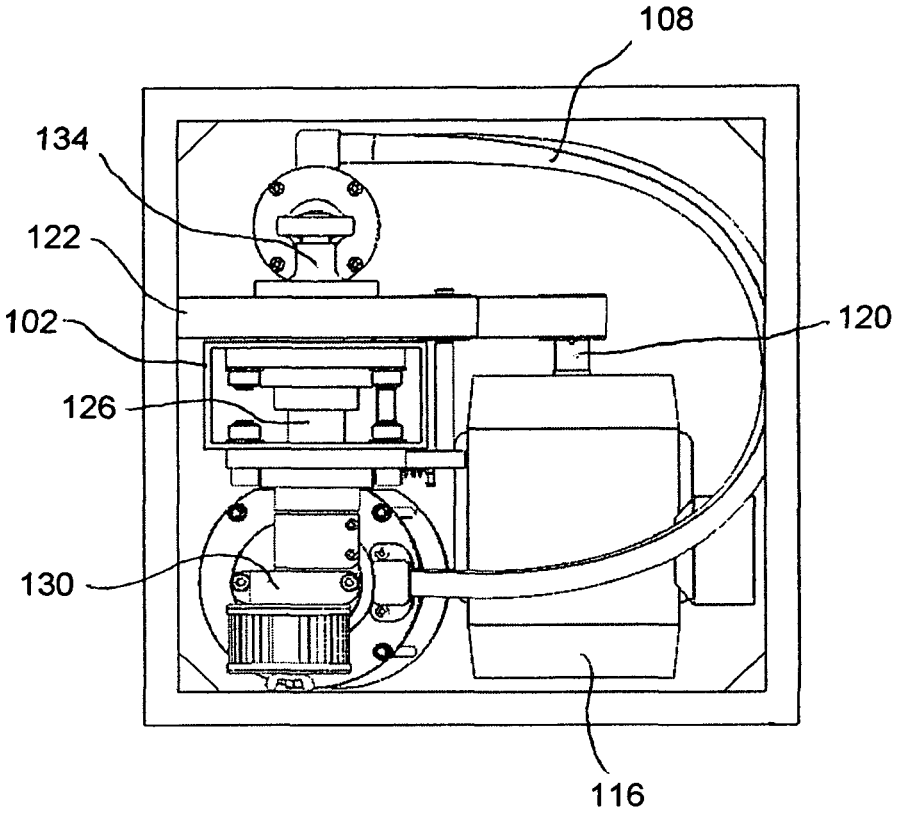
FIG. 8 is a partial top view thereof.

With continued general reference to FIGS. 1-8, once more, the exemplary compression apparatus 100 of the present invention further comprises two piston-cylinder units 140, 170 operably installed on the drive mechanism 110. Each piston-cylinder unit 140, 170 generally comprises a cylinder 142, 172, a piston 150, 180 slidably installed within the cylinder 142, 172, and a piston rod 168, 198 connected between each respective piston 150, 180 and the drive mechanism 110 to effectuate movement of the piston 150, 180 within the cylinder 142, 172, more about which is said below in connection with FIGS. 9-24. In FIGS. 1 and 3, the actual cylinder walls 143, 173 (FIGS. 9 and 13) have been removed to reveal the inner workings of each piston-cylinder unit 140, 170, and particularly the two pistons 150, 180. The first piston-cylinder unit 140 is installed on the front side of the frame 102, or the side of the frame 102 opposite the location of the timing pulleys 112, 114. From each timing pulley 112, 114, first and second timing pulley shafts 126, 128, respectively, extend through the frame 102 to the opposite side. The shafts 126, 128 are best seen in FIG. 2 in which the frame 102 has been removed for ease of viewing the other components. Each such timing pulley shaft 126, 128 is rotatably installed within the frame 102 using bearings or other such devices now known or later developed for reduced-friction rotatable installation. The timing pulley shafts 126, 128 may be formed of any suitable material now known or later developed and may be dimensioned as needed to suit any particular application. On the end of each timing pulley shaft 126, 128 opposite the timing pulleys 112, 114, first and second timing pulley couplings 130, 132 are installed so as to serve as cranks or crank arms for the first piston-cylinder unit 140. In the exemplary embodiment, the timing pulley couplings 130, 132 are each installed in an offset manner relative to the respective timing pulley shafts 126, 128, or each coupling 130, 132, is installed so as to have its central axis offset from that of the respective timing pulley shaft 126, 128. The free end of the piston rod 168 of the first piston-cylinder unit 140 is then pivotably attached to the first coupling 130 driven by the opposite first timing pulley 112 through the first timing pulley shaft 126. Similarly, the base 144 of the first cylinder 142 is mounted on the second coupling 132, which is itself pivotably driven by the second timing pulley 114 through the second timing pulley shaft 128. As explained in more detail below, it will be appreciated that by offsetting the couplings 130, 132 relative to the rotating timing pulley shafts 126, 128 and relative to each other, in the exemplary embodiment substantially one-hundred eighty degrees (180°) out of phase, movement of the piston 150 within the cylinder 142 is effectuated as the timing pulleys 112, 114 turn. That is, the points of connection of the free end of the piston rod 168 and of the base of the cylinder 142 to the respective couplings 130, 132 essentially dynamically move from locations relatively closer and farther apart as the two timing pulleys 112, 114, and hence the timing pulley shafts 126, 128 and the couplings 130, 132, rotate, thereby oscillating the movement of the piston 150 within the cylinder 142 as driven by the piston rod 168. It will be further appreciated that dynamically operating the piston-cylinder unit 140 in this manner serves to decrease frictional and inertial losses by balancing rather than wagging the piston-cylinder unit 140 and by dramatically reducing if not altogether eliminating any side load on the piston 150 operating within the cylinder 142. It will be still further appreciated that the relative speed of the piston 150 within the cylinder 142 is also dynamic, or varies depending on where the couplings 130, 132 are rotationally, the piston 150 moving relatively faster through the 3:00 and 9:00 positions of the couplings 130, 132, where the piston 150 is in the middle of its up and down strokes, and moving relatively slower "over the top" around the noon and 6:00 positions where the piston 150 is near the top and bottom of its stroke, which would be where the greatest work of compression would be required, it then being advantageous to be operating the piston slowly with more leverage to "squeeze" the fluid in the final compression in each stage of operation. Thus, in the exemplary embodiment of the first piston-cylinder unit 140 and its installation on the drive mechanism 110 of the compression apparatus 100, essentially, the unit 140 completes its up stroke when the upper coupling 130 is at the noon or straight up position and the lower coupling 132 is at the 6:00 or straight down position, and the unit 140 completes its down stroke when the upper coupling is at the 6:00 position and the lower coupling 132 is at the noon position. Once again, as the piston 150 nears those top and bottom positions at the end of its up and down strokes it is traveling relatively slowly and then speeds up again as it leaves those positions heading in the other direction. Those skilled in the art will appreciate that while a particular configuration of the first piston-cylinder unit 140 and its installation on the drive mechanism 110 is shown and described, the invention is not so limited, but instead may involve a wide variety of configurations without departing from its spirit and scope. Turning briefly to the second piston-cylinder unit 170, in the exemplary embodiment its configuration and installation on the drive mechanism 110 is highly analogous to that of the first piston-cylinder unit 140. Here, first and second timing pulley cranks 134, 136 are installed directly on the first and second timing pulleys 112, 114, again in offset relationship that in the exemplary embodiment is substantially one-hundred eighty degrees (180°) apart. The free end of the piston rod 198 of the second piston-cylinder unit 170 is pivotably attached to the first timing pulley crank 134 and the base 174 of the second cylinder 172 is pivotably attached to the second timing pulley crank 136. As the first and second timing pulleys 112, 114 rotate during use as driven by the motor 116 through the belt 122, the cranks 134, 136 in turn rotate, thereby actuating the second piston 180 within the second cylinder 172 on its up stroke and down stroke much like that of the first piston-cylinder unit 140. In the exemplary embodiment, the first and second piston-cylinder units 140, 170 cooperate to provide four stages of compression, with the compressed fluid from the second stage of the first piston-cylinder unit 140 being passed through a hose 108 to the third stage of the second piston-cylinder unit 170. As such, the second piston-cylinder unit 170 effectively lags the first piston-cylinder unit 140 by approximately one to ninety degrees (1°-90°), as dictated by the direction of rotation of the motor's drive shaft 120 and pulley 118, which in the exemplary embodiment is clockwise as viewed looking at the motor shaft 120, and as dictated by the geometry and installation of the first and second couplings 130, 132 on the first and second timing pulley shafts 126, 128 relative to the geometry and installation of the first and second cranks 134, 136 on the first and second timing pulleys 112, 114, which lagging setup it will be appreciated effectively distributes the work of the motor 116 more evenly throughout the entire cycle and allows for more uniform, laminar flow of the compressed fluid throughout the system at all stages of compression, more about which will be said below in describing the operation of the piston-cylinder units 140, 170 in greater detail in connection with FIGS. 9-16. Again, it will be appreciated that a variety of other configurations and geometries of the piston-cylinder units 140, 170 and their attachment to the drive mechanism 110 or any other drive mechanism, including any particular phase shift or leading or lagging relationship between the units as connected to the drive mechanism, and thus the resulting compression effects, are possible without departing from the spirit and scope of the invention.

Figure 9:
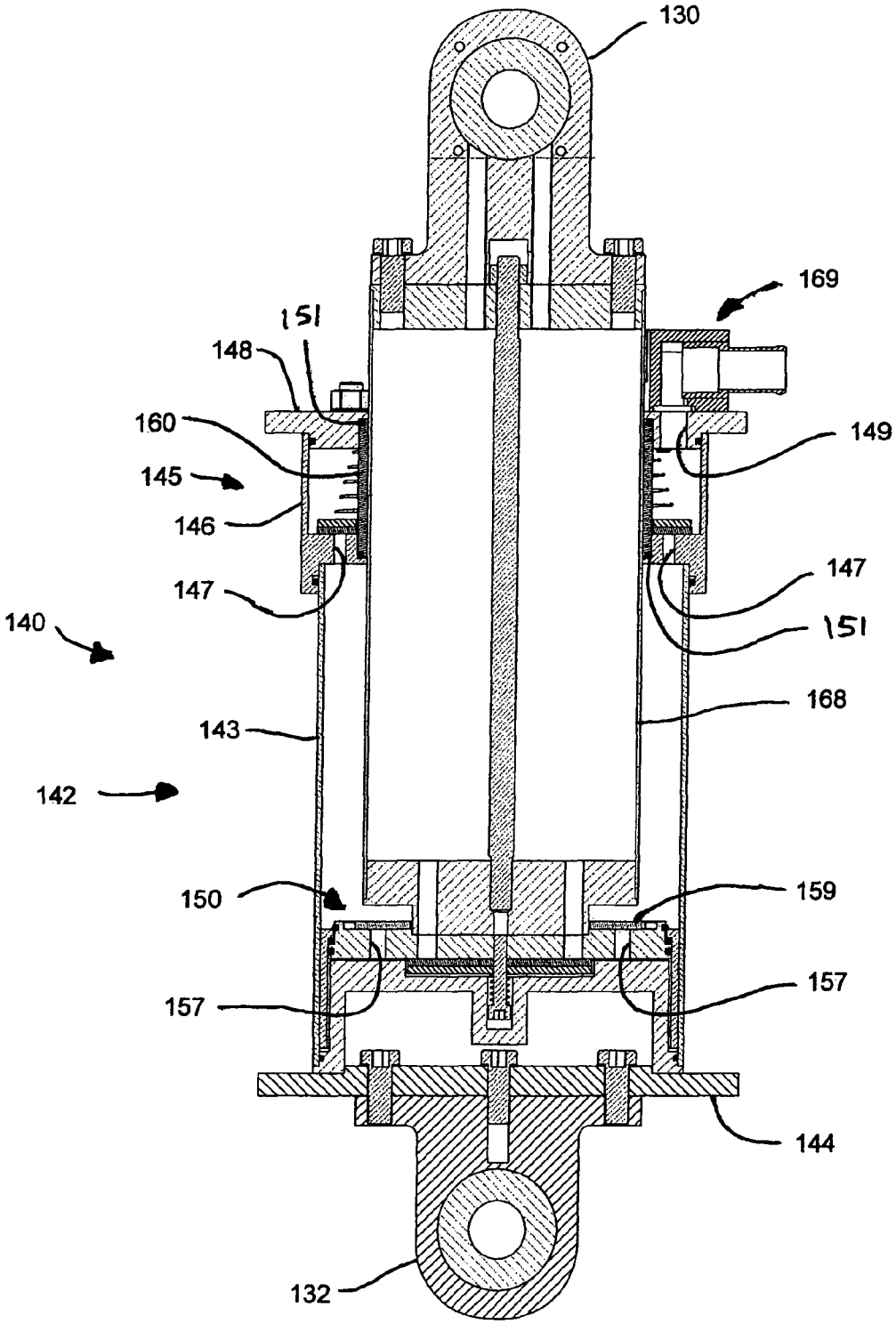
FIG. 9 is an enlarged sectional view of a first piston-cylinder unit thereof in a first operative position.
Figure 10:
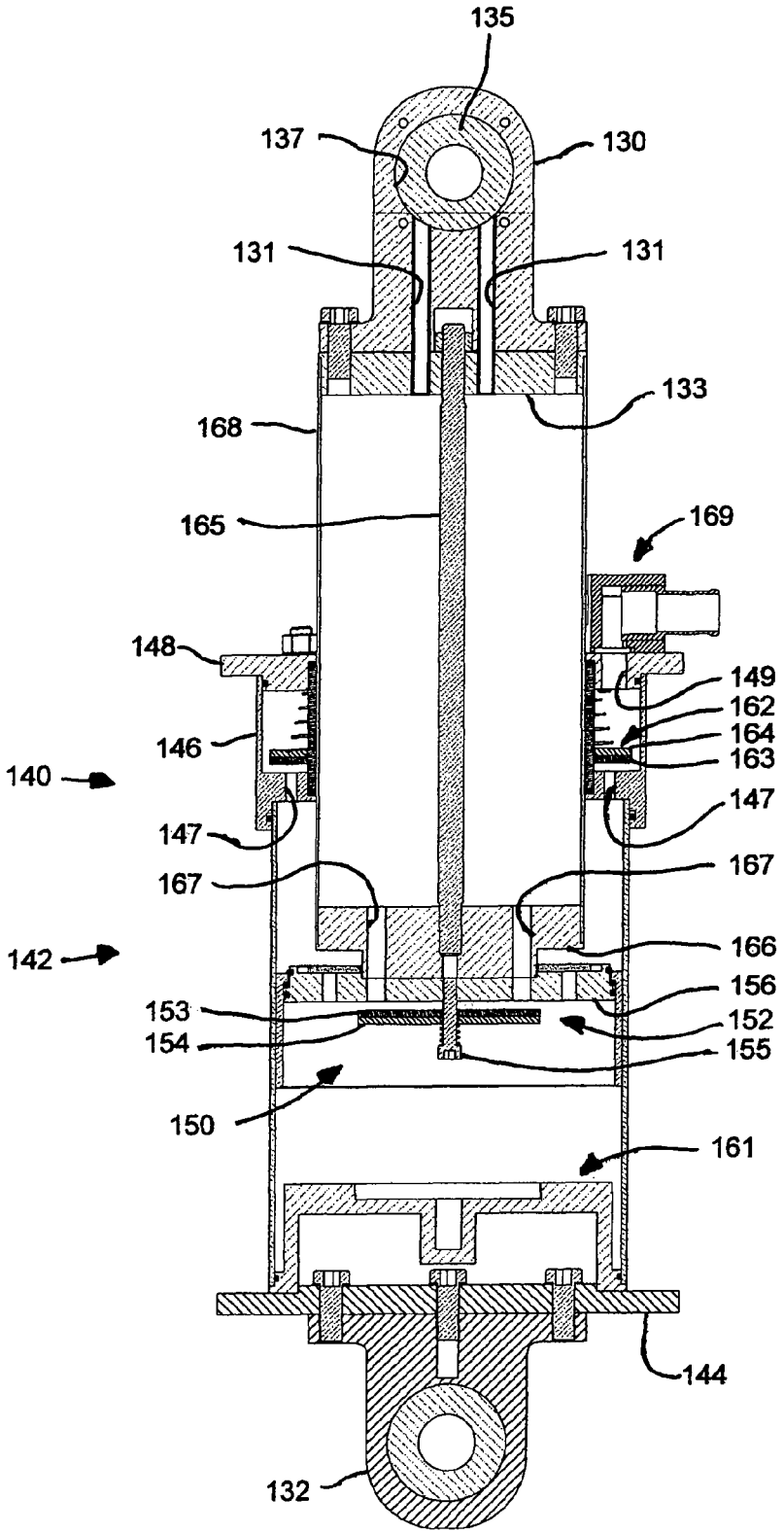
FIG. 10 is an enlarged sectional view of a first piston-cylinder unit thereof in a second operative position.

With respect to the piston-cylinder units, further aspects of the present invention again relate to various arrangements by which the piston is configured on the end of the piston rod so as to selectively allow for or control the flow and compression of fluid within the cylinder. Turning then to FIGS. 9-12, there are shown enlarged cross-sectional views of an exemplary embodiment of the first piston-cylinder unit 140 in four operative positions. Generally, it can again be seen that the piston-cylinder unit 140 includes the first cylinder 142 within which the first piston 150 is operable as driven by the first displacement rod 168 that is itself connected to the drive mechanism 110 (FIGS. 1-8) through the first coupling 130. The cylinder 142 includes a first cylinder wall 143 capped at its end opposite the first base 144 with a first collar assembly 145 through which the displacement rod 168 slidably and sealingly passes. In more detail, in the exemplary embodiment, the first collar assembly 145 includes a first lower collar member 146 installed on the first cylinder wall 143 and a first upper collar member 148 installed on the first lower collar member 146 such that an annular space is formed between them through which the compressed fluid exits after the second stage, more about which is said below. A first sleeve or bushing 160 may be installed between the lower and upper collar members 146, 148 for a reduced friction seal about the displacement rod 168 as it moves up and down within the cylinder 142. Moreover, it will be appreciated by those skilled in the art that by placing o-rings 151 within the first collar assembly 145 effectively at the top and bottom of the first bushing 160, or seated between the bushing 160 and the lower and upper collar members 146, 148, not only is the back side of the bushing 160 sealed, but the bushing 160 is thus also resiliently mounted within the collar assembly 145 so as to allow a relatively free alignment of the bushing 160 to avoid direct metallic contact and chafing of the bushing, in this case graphite. In the exemplary embodiment, the cylinder wall 143 and the displacement rod 168 are both carbon steel or cast iron, the lower and upper collar members 146, 148 are aluminum, and the bushing is graphite, though again it will be appreciated that any suitable materials now known or later developed may be employed. In a first operative position as shown in FIG. 9, the first piston 150 has just completed its down stroke and is at the bottommost position within the first cylinder 142. From this position, with reference now to FIG. 10, as the piston 150 starts back up as driven by the connection of the first displacement rod 168 to the drive mechanism 110 (FIGS. 1-8) through the first coupling 130, simultaneously, the second stage of compression is happening above the piston 150 to the fluid that was previously compressed during the first stage, more about which is said below, and new fluid is being drawn into the space below the piston 150, which fluid will then be compressed in the next first stage cycle. In more detail, with continued reference to FIG. 10, as the piston 150 travels upward within the cylinder 142 during this phase of operation, in the exemplary embodiment wherein the fluid to be compressed is comprised, at least in part, of air or some other gaseous substance existing in the space surrounding the piston-cylinder unit 140, such gaseous fluid is drawn into the cylinder 142 essentially through the hollow displacement rod 168. At this juncture it should be pointed out that while the displacement rod 168 is shown and described as being "hollow," as essentially being formed with a relatively thin annular wall having a relatively large space therein, numerous other constructions, such as bores, channels, or the like, may be formed in the displacement rod 168 or elsewhere in the piston-cylinder unit 140 for that matter, using any technique or construction now known or later developed by which the fluid may be drawn into the cylinder 142 through the displacement rod 168 or otherwise. In more detail regarding the exemplary fluid path, one or more top channels 131 are formed in the first coupling 130 at the upper end of the displacement rod 168 configured to communicate between the space outside the piston-cylinder unit 140 and the space within the hollow displacement rod 168. In the exemplary embodiment shown, in addition to the first coupling 130, the displacement rod 168 is further configured with at least one first top cap 133 adjacent the first coupling 130 and through which the one or more top channels 131 also pass. It will be appreciated that the geometry of the one or more parts effectively capping the upper end of the displacement rod 168 and facilitating pivoting connection of the rod 168 on the drive mechanism 110 (FIGS. 1-8) is merely illustrative and that the invention is not so limited. For example, the components shown as the first coupling 130 and the first top cap 133 may instead be formed as a single integral part and the whole displacement rod assembly may be held together using some variation on the connecting rod 165 shown in the exemplary embodiment. To further facilitate the pivoting and breathing action of the first displacement rod 168, as shown, the first coupling 130 may be configured with a first cross-hole 137 in which a first bearing 135 is installed, it being appreciated that the first bearing 135 is set within the first cross-hole 137 out of plane from the one or more top channels 131 so as to not occlude the flow path therethrough, the first cross-hole 137 then, in effect, becoming part of the flow path, or the fluid conduit between the space surrounding the first piston-cylinder unit 140 and the inside space of the first displacement rod 168. As shown in FIGS. 1-8, a filter 139 or the like may be placed over the opening to the first cross-hole 137, or on the side of the cross-hole 137 opposite the first bearing 135 so as to filter out particulate matter from the fluid being drawn into the first piston-cylinder unit 140. With continued reference to FIG. 10, at the end of the first displacement rod 168 opposite the first coupling 130, a first bottom cap 166 is installed having one or more bottom channels 167 selectively communicating between the space within the hollow displacement rod 168 and the space below the first piston 150 as controlled by the movement of a first piston valve 152. In the exemplary embodiment, the first piston valve 152 includes a stamped urethane washer 153 or the like, approximately one eighth inch to three sixteenth inch (⅛ in to 3⁄16 in) thick and 60-70 durometer, slidably installed on a first spring-biased bolt 155 so as to selectively seal the openings of the one or more bottom channels 167, more about which will be explained below. As shown, the first piston valve 152 may further include on the bottom side of the washer 153 a backing plate 154 for added support, particularly in higher pressure applications. It will be appreciated that the materials of construction of all components of the compression apparatus 100, and particularly the piston 150 may vary depending on the application, such that while, for example, the washer 153 of the first piston valve 152 is described as being urethane, the invention is not so limited, but instead may employ any suitable material now known or later developed without departing from its spirit and scope. Similarly, in the exemplary embodiment, the backing plate 154 and the first bottom cap 166 are made of aluminum, which materials again are merely illustrative. With the compression apparatus 100 so configured, as the first piston 150 travels upward within the first cylinder 142, it will be appreciated that pressure and inertial effects cooperate to open the first piston valve 152, or shift it downwardly, against the resistance of the spring-biased bolt 155. As such, the fluid being drawn into the first displacement rod 168 through the top channels 131 as explained above can then pass through the bottom channels 167 and around the first piston valve 152, or between the first piston valve 152, and specifically the washer 153, and the first body 156 of the first piston 150, into the space within the first cylinder 142 below the piston 150. This continues until the piston 150 reaches its full upstroke, as shown in the operative position illustrated in FIG. 11. Here, the first piston valve 152 closes, again both by inertial and pressure effects as the first piston 150 begins to reverse direction and as biased by the bolt 155. Thus, it will be appreciated that as the piston 150 then begins its down stroke, the fluid previously introduced into the space below the piston 150 as explained above in connection with FIG. 10 is now compressed. But, with reference now to FIG. 12 showing the first piston 150 midway through its down stroke, based once more on both inertial and pressure effects, a second piston valve 159 also configured as a washer and here located above the first piston 150, and specifically between the piston's body 156 and the first bottom cap 166 of the first displacement rod 168, is shifted upwardly so as to come out of contact with the body 156, thereby opening first through-holes 157 formed in the body 156 and enabling the fluid to pass through the first piston 150, and the through-holes 157 specifically, and into the annular space above the piston 150 between the first displacement rod 168 and the first cylinder wall 143. It will be appreciated that this does not work counter to compression of the fluid happening during this first stage, but rather that due to the relatively large diameter of the first displacement rod 168 and the resulting relatively small annular space or volume above the first piston 150 between the rod 168 and the first cylinder wall 143, the total volume in which the fluid is contained, or the space in which the fluid is bounded, during this first stage of compression continually decreases as the piston 150 travels downwardly toward the bottom of its stroke, or to the position shown in FIG. 9. Those skilled in the art will appreciate that the first displacement rod 168 thus cooperates with the first piston 150 during the first stage of compression in essentially displacing the compressible fluid. It will be further appreciated that due to the relatively large diameter of the displacement rod 168, on the upstroke when the piston-cylinder unit 140 is undergoing its second stage of compression, the effectively working surface for the compression happening in the second stage is essentially that portion of the upper surface of the piston 150 exposed around the displacement rod 168. Therefore, it will be further appreciated by those skilled in the art that by reducing the compressive working surface from the first stage to the second in this manner effectively provides greater leverage to the piston 150, and hence the motor 116, during the second stage when the pressure is being taken up higher relative to the first stage. Thus, the ratio between the effective working surfaces of during the first and second stages is one measure of, or one way to express, the leverage advantage between the stages, which effect is had irrespective of the volume, or the length of the stroke. Specifically, then, in the exemplary embodiment shown, the nominal inside diameter of the first cylinder wall 143 is six inches (6 in) and the nominal outside diameter of the first displacement rod 168 is four and three quarter inches (4¾ in), whereby the nominal annular space between the first displacement rod 168 and the first cylinder wall 143 is five eighths inch (⅝ in) all the way around. Accordingly, the resulting surface area ratio for the down and up strokes (the first and second stages) of the first piston-cylinder unit 140, or the ratio between the effective working surfaces for the compression happening on the down stroke (first stage) versus the up stroke (second stage), is approximately 2.7. This first piston-cylinder unit ratio was arrived at by calculating the nominal surface area for the down stroke, or the nominal surface area of the piston 150, which is essentially the inside cross-sectional area of the cylinder 142 of 28.3 $in^2$ ($(\Pi\times(6\ in.)^2)/4$), and dividing that by the nominal surface area above the piston 150, which is the piston surface area (28.3 $in^2$) minus the nominal cross-sectional area of the displacement rod 168 of 17.7 $in^2$ ($\Pi\times(4.75\ in.)^2)/4$): 10.6 $in^2$ (28.3 $in^2$−17.7 $in^2$). Thus 28.3 $in^2$ divided by 10.6 $in^2$ equals approximately 2.7, the working surface area ratio between the two strokes or two stages of the first piston-cylinder unit 140. It will be appreciated by those skilled in the art, as evidenced by the alternative exemplary embodiments described in more detail below, that a variety of such surface area ratios are possible without departing from the spirit and scope of the present invention, the approximate 2.7 ratio for the first piston-cylinder unit 140 being merely illustrative. Other such ratios depending on the application and the piston-cylinder set up may be arrived at and still operate on the same basic principle. With reference again to FIG. 9 and the down stroke in the first piston-cylinder unit 140, due to the incorporation in or installation adjacent to the base 144 of the first cylinder 142 of a first base cap 161 having a profile substantially conforming to that of the piston 150, including the necessary geometry to accommodate the piston wall 158 and the spring-biased bolt 155 and first piston valve 152, as best seen in FIGS. 10 and 12, at the bottom of the stroke the piston 150 substantially nests on or in the base cap 161, whereby the clearance pocket in the space or chamber below the first piston 150 is relatively minimal and the majority of the compressed fluid from the first stage of compression in the first piston-cylinder unit 140 is forced into the space above the piston 150 between the displacement rod 168 and the cylinder wall 143 as described above. As such, referring still to FIG. 9, when the piston 150 does reach the very bottom of its down stroke and begins to reverse for the upstroke, it will once more be appreciated that due to at least pressure and inertial effects, the second piston valve 159 above the piston 150 will close so as to seal off the through-holes 157 formed in the piston's body 156. It will be further appreciated that the piston wall 158 serves to seal against the inside surface of the cylinder wall 143, thereby cooperating with the second piston valve 159 to substantially seal off the compressible fluid in the space above the piston 150 as the piston 150 travels upward in the cylinder 142, thereby facilitating the second stage of compression in the first piston-cylinder unit 140. In the exemplary embodiment, the piston wall 158 is made of graphite, but may be formed of any suitable material now known or later developed. Based on the foregoing, upward travel of the piston 150 as shown at a midway location in FIG. 10 will serve to compress the fluid in the space above the piston 150 bounded by the displacement rod 168 and the cylinder wall 143 as acted on by the relatively smaller surface are of the top side of the piston 150 exposed around the displacement rod 168. This continues on the up stroke until the pressure above the piston 150 overcomes the spring-biased first lower collar member valve 162 and any residual pressure in the downstream system and the second stage compressed fluid can then pass through the first passages 147 formed in the lower collar member 146, into the space between the lower and upper collar members 146, 148, and eventually out the exit hole 149 formed in the upper collar member 148 and through the first connector 169 and the hose 108 to the second piston-cylinder unit 170 (FIGS. 1-8 and 13-16) for further compression as described below. It will again be appreciated by those skilled in the art that though a particular configuration of the first piston-cylinder unit 140 has thus been shown and described, the invention is not so limited. Rather, a variety of other components and configurations that are functionally equivalent may be employed in the compression apparatus 100 without departing from the spirit and scope of the invention. Moreover, it will be appreciated that o-rings, gaskets, or the like may be used liberally throughout the piston-cylinder units 140, 170 to seal between mating or engaging parts wherever necessary. The means of fabrication, though shown as bolted or interference-fit surfaces between which o-rings or the like are often placed as an additional protection or precaution against leaking or blow-by, may also vary and potentially employ any such method now known or later developed by which an assembly as shown and described herein may be produced. In applications wherein the compressible fluid is air, the o-rings may be EPDM, while in applications wherein the fluid is at least in part liquid, the o-rings may be Viton or Buna-N (Nitrile), for example. Once again, any suitable material now known or later developed may be employed.

Regarding the materials of construction of the piston-cylinder unit 140, as for other such piston-cylinder units, generally, again, the piston body or wall 158 may be made of a material such as graphite or aluminum alloy with little to no coefficient of expansion. The cylinder wall 143 may be generally constructed of cast iron, chromolly or stainless steel, or aluminum alloy and may be a solid, continuous material formed from any appropriate process now known or later developed. Alternatively, a separate sleeve or liner (not shown) may be press-fit within the inside diameter of the cylinder wall 143 or the inside surface of the cylinder wall 143 may otherwise be coated with a material other than that of the cylinder wall 143 itself for improved friction and wear performance. For example, a cast iron sleeve (not shown) may be inserted within an aluminum cylinder body 143. An aluminum cylinder wall 143 may also be hard anodized to again improve friction and wear. Once again, it will be appreciated by those skilled in the art that the described materials are merely exemplary and that any other materials now known or later developed as having properties suitable for any compression apparatus application contemplated herein may be used without departing from the spirit and scope of the invention.

Figure 11:
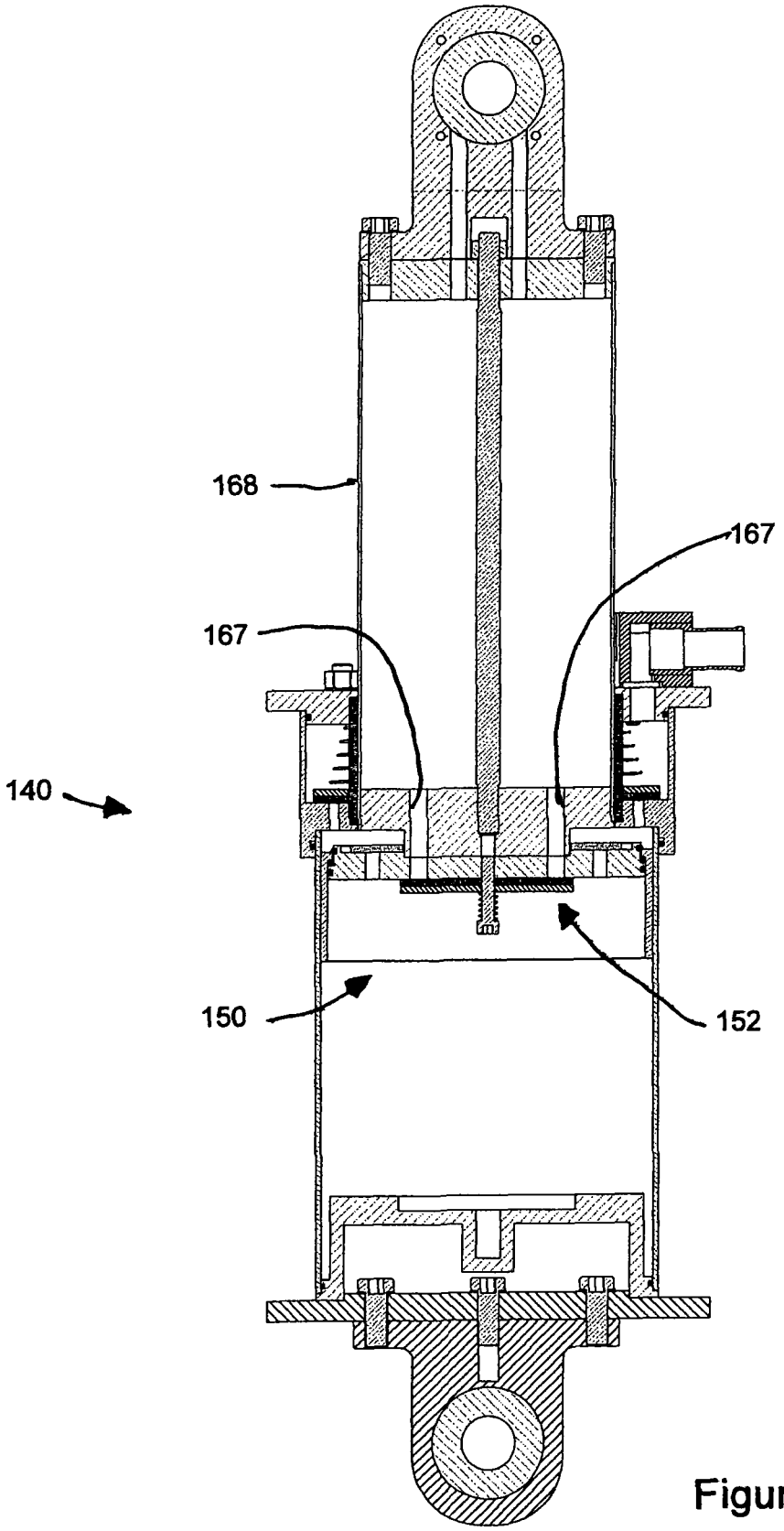
FIG. 11 is an enlarged sectional view of a first piston-cylinder unit thereof in a third operative position.
Figure 12:
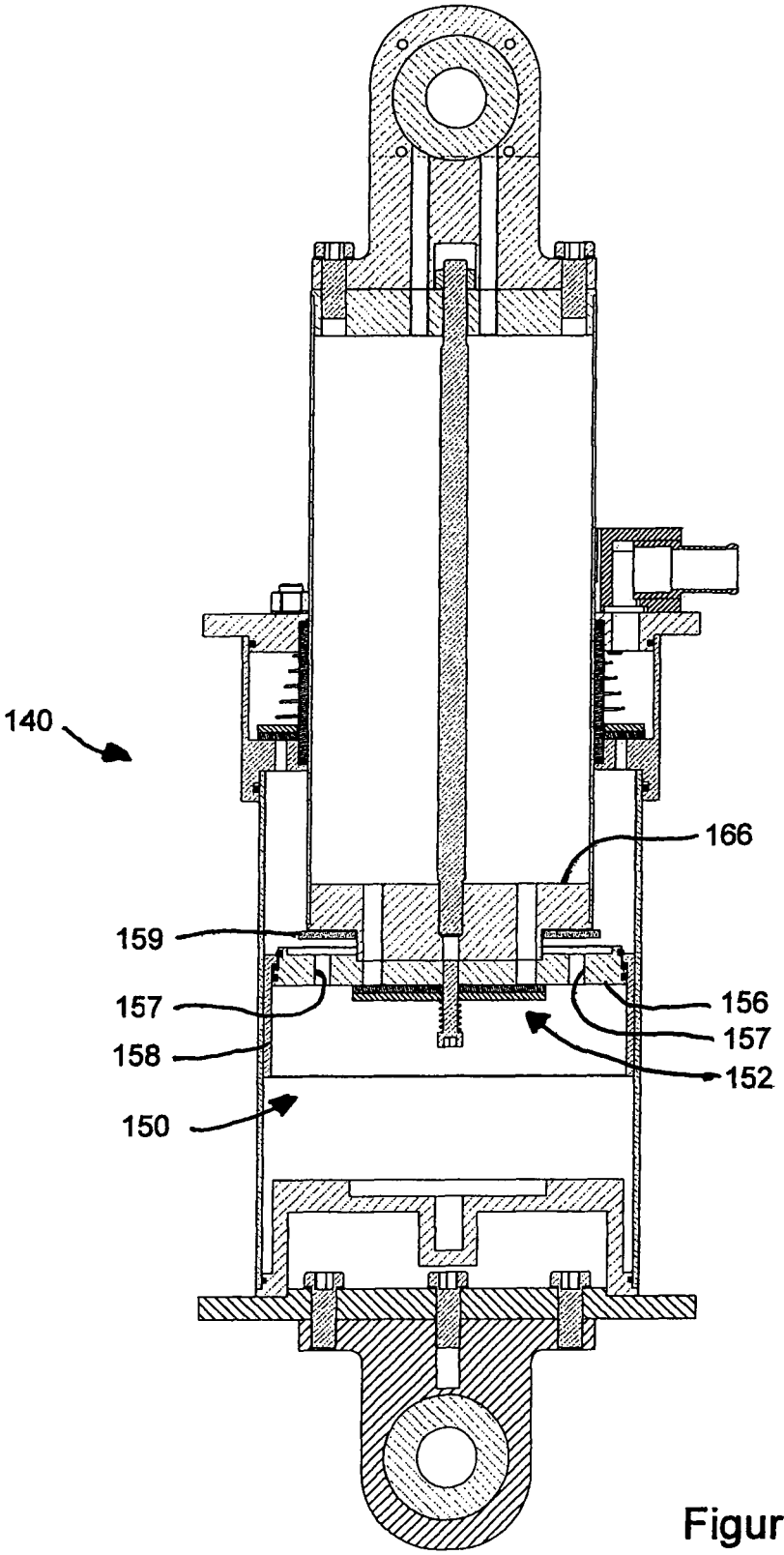
FIG. 12 is an enlarged sectional view of a first piston-cylinder unit thereof in a fourth operative position.
Figure 13:
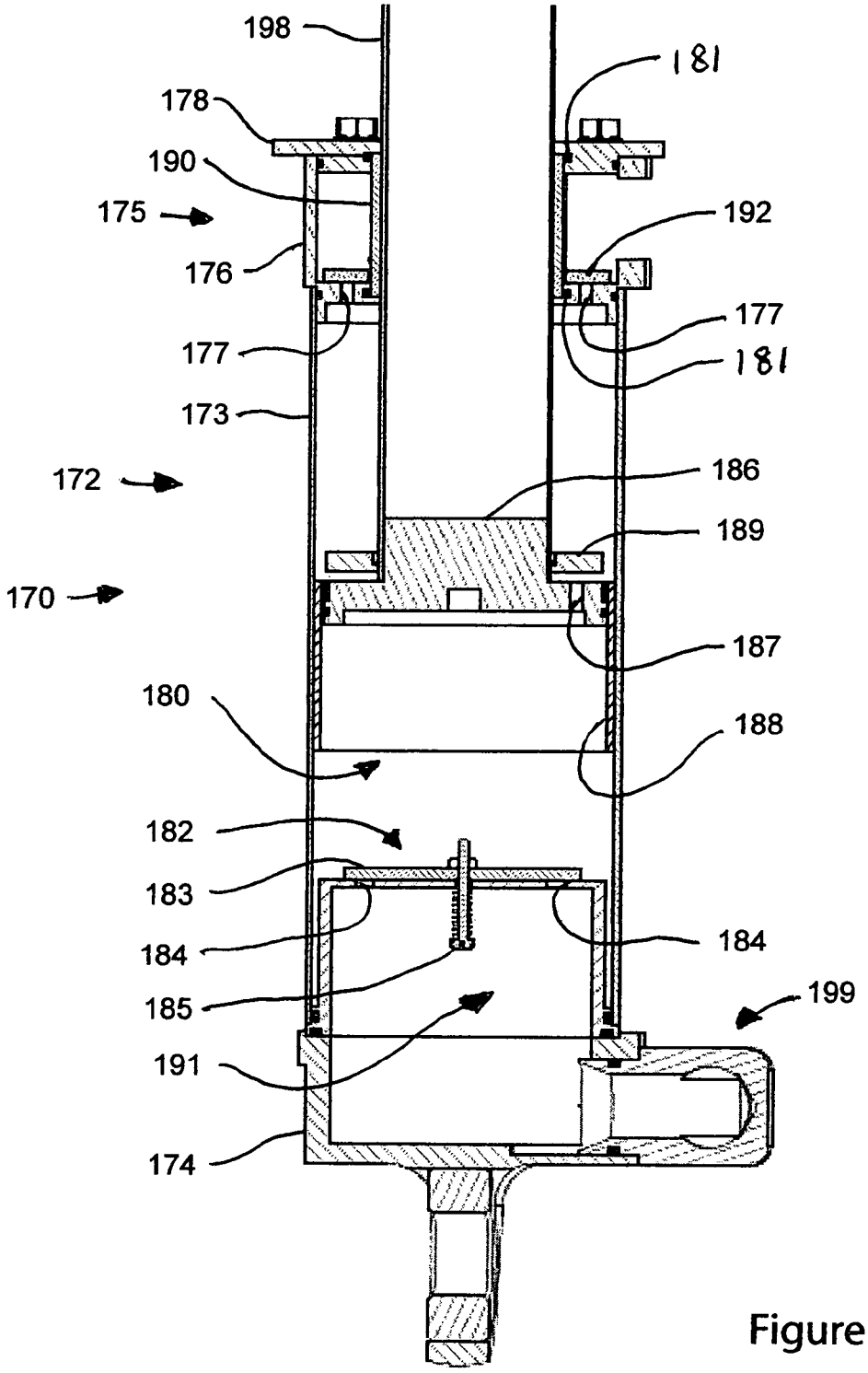
FIG. 13 is an enlarged partial sectional view of a second piston-cylinder unit thereof in a first operative position.
Figure 14:
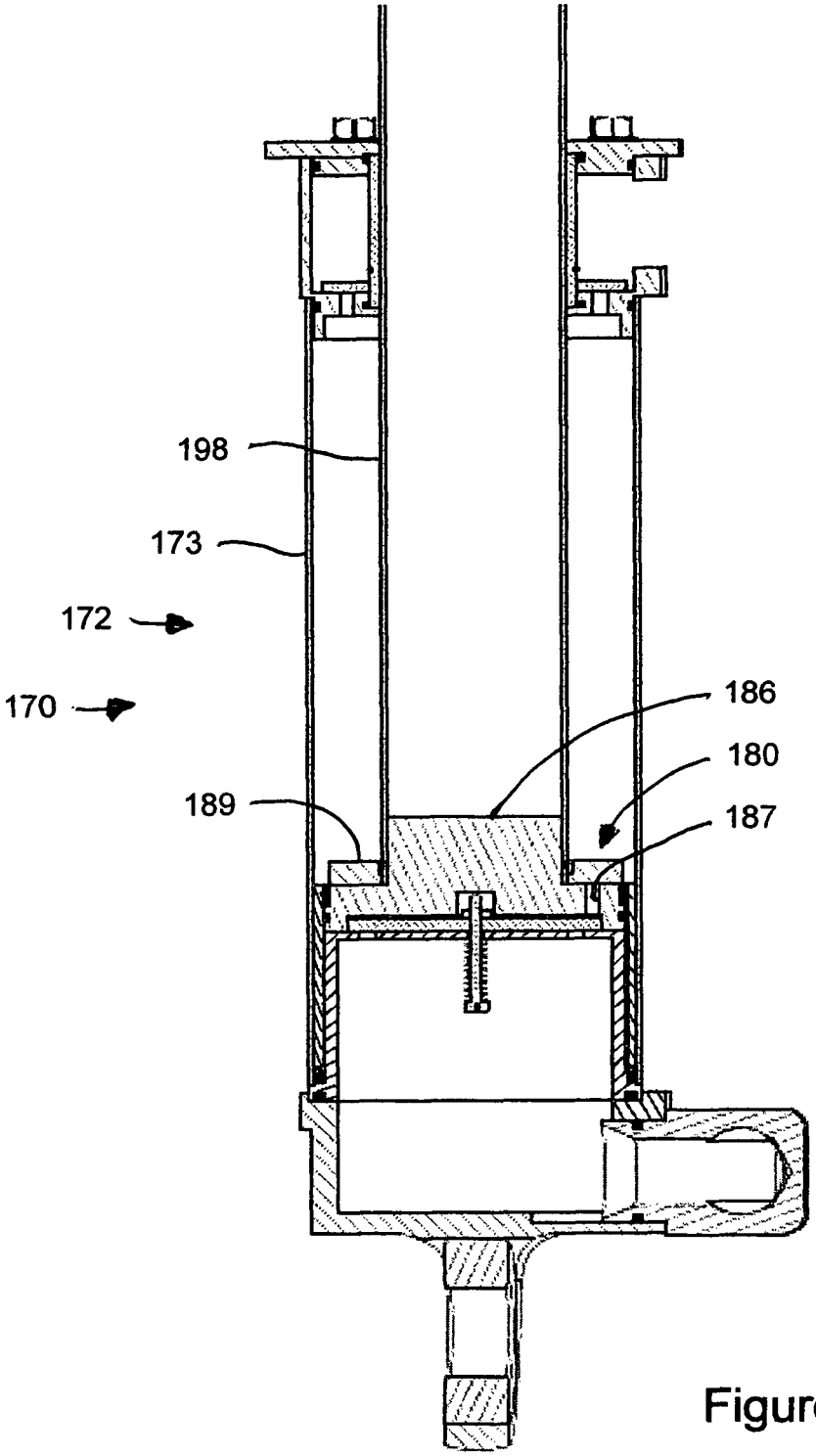
FIG. 14 is an enlarged partial sectional view of a second piston-cylinder unit thereof in a second operative position.
Figure 15:
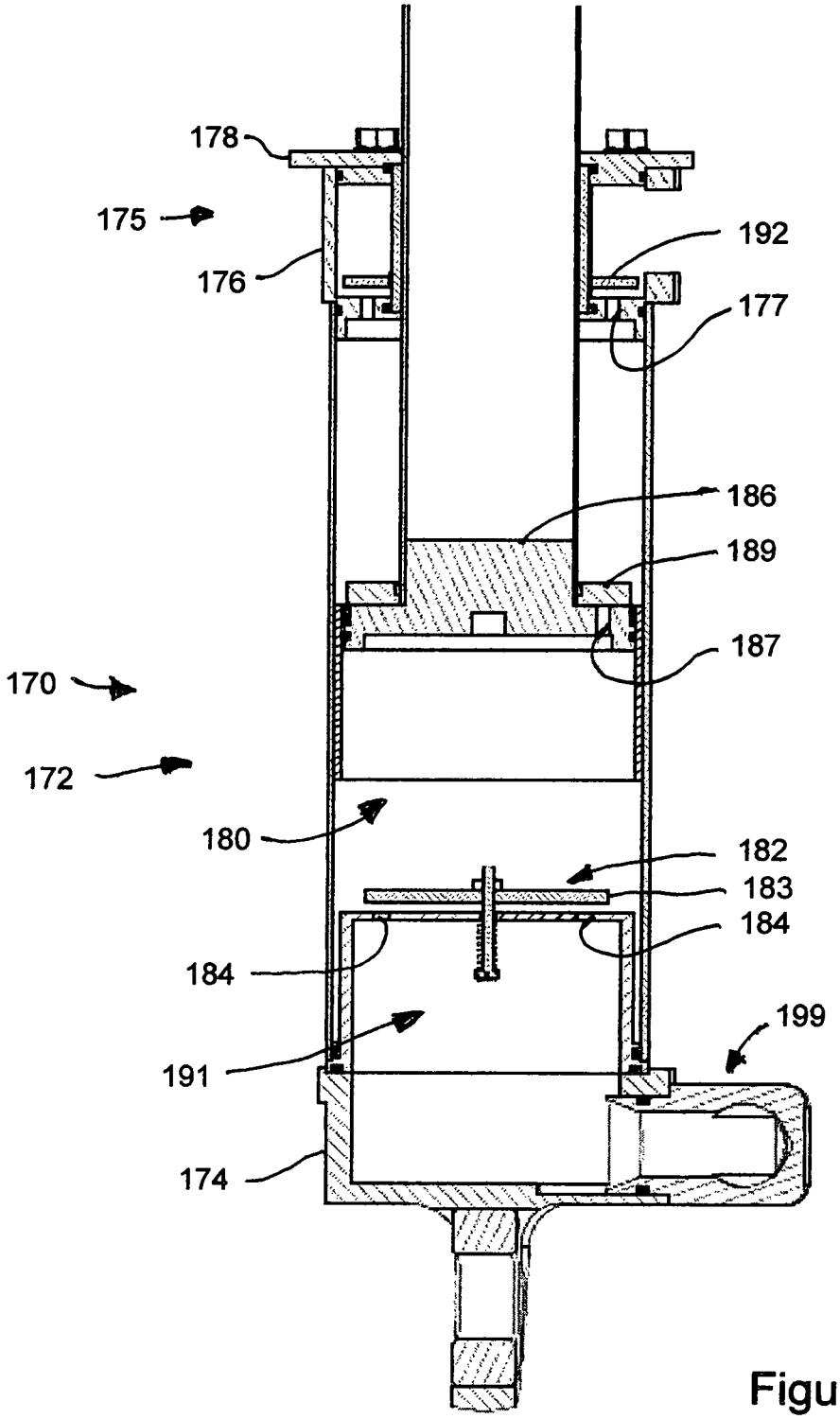
FIG. 15 is an enlarged partial sectional view of a second piston-cylinder unit thereof in a third operative position.

Turning now to FIGS. 13-16, there is shown a first exemplary embodiment of the second piston-cylinder unit 170 in four enlarged cross-sectional views representing four operative positions analogous to those shown for the first piston-cylinder unit 140 as shown in FIGS. 9-12. Generally, it can be seen that the second piston-cylinder unit 170 again includes the second cylinder 172 within which the second piston 180 is operable as driven by the second displacement rod 198 that is itself connected to the drive mechanism 110 (FIGS. 1-8) through the first timing pulley crank 134. The cylinder 172 includes a second cylinder wall 173 capped at its end opposite the second base 174 with a second collar assembly 175 through which the displacement rod 198 slidably and sealingly passes. In more detail, in the exemplary embodiment, the second collar assembly 175 includes a second lower collar member 176 installed on the second cylinder wall 173 and a second upper collar member 178 installed on the second lower collar member 176 such that an annular space is formed between them through which the compressed fluid exits after the fourth and final stage of compression, more about which is said below. A second sleeve or bushing 190 may be installed between the second lower and upper collar members 176, 178 for a reduced friction seal about the displacement rod 198 as it moves up and down within the cylinder 172. Again, it will be appreciated that by placing o-rings 181 within the second collar assembly 175 effectively at the top and bottom of the second bushing 190, or seated between the bushing 190 and the lower and upper collar members 176, 178, not only is the back side of the bushing 190 sealed, but the bushing 190 is thus also resiliently mounted within the collar assembly 175 so as to allow a relatively free alignment of the bushing 190 to avoid direct metallic contact and chafing of the bushing, in this case graphite. In the exemplary embodiment, as with the first piston-cylinder unit 140, the second cylinder wall 173 and the second displacement rod 198 are both carbon steel or cast iron, the second lower and upper collar members 176, 178 are aluminum, and the second bushing 190 is graphite, though once again it will be appreciated that any suitable materials now known or later developed may be employed. In a first operative position of the second piston-cylinder unit 170 as shown in FIG. 13, it can be seen that the piston 180 is roughly midway through its down stroke. It will be appreciated by those skilled in the art based on the kinematics of the drive mechanism 110 (FIGS. 1-8) and the set up of the first and second piston-cylinder units 140, 170 on opposite sides of the frame 102 approximately one to ninety degrees (1°-90°) out of phase, or the second piston-cylinder unit 170 lagging the first 140 by approximately one to ninety degrees (1°-90°), the first operative position of the second piston 180 within the second cylinder 172 as shown in FIG. 13 substantially corresponds to the first operative position of the first piston 150 within the first cylinder 142 as shown in FIG. 9. That is, the first operative positions of the first and second piston-cylinder units 140, 170 as shown in FIGS. 9 and 13 represent a particular point in time or "snap shot" of the movement of the drive mechanism 110 (FIGS. 1-8). Accordingly, it will be further appreciated that at the first operative position of the drive 110 as shown in FIGS. 9 and 13, the first piston-cylinder unit 140 is at the bottom of its stroke about to start back up while the second piston-cylinder unit 170 is roughly midway through its down stroke heading toward the bottom of its stoke. This phase shift of the first and second piston-cylinder units 140, 170 and the resulting function and advantages will be further appreciated based on the below discussion of the movement of the compressed fluid, and the timing thereof, out of the first piston-cylinder unit 140 at the completion of the second stage of compression in the exemplary compression apparatus 100 of FIGS. 1-8 and into the second piston-cylinder unit 170 to set up the third stage of compression, the second stage compressed fluid being pushed from the first piston-cylinder unit 140 into the second piston-cylinder unit 170 as it is completing its fourth stage of compression above the second piston 180, more about which is said below. Again, those skilled in the art will appreciate that such a phase shift as set up between the first and second piston-cylinder units 140, 170 also serves to distribute the work of the motor 116 more uniformly over its entire cycle, thereby reducing both power consumption and wear. With continued reference to FIG. 13 showing the second piston 180 midway through its down stroke, based once more on both inertial and pressure effects, an alternative second piston valve 189 also configured as a washer and here again located above the second piston 180 is shifted upwardly so as to come out of contact with the body 186 of the second piston 180, thereby opening second through-holes 187 formed in the piston body 186 and enabling the fluid to pass through the second piston 180, and the through-holes 187 specifically, and into the annular space above the piston 180 between the second displacement rod 198 and the second cylinder wall 173 and thereby be compressed due to the displacement of volume within the cylinder 172 by the piston 180 and the displacement rod 198 on their downward travel, as explained previously in connection with the first piston-cylinder unit 140. The fluid being compressed in this third stage is that delivered to the second piston-cylinder unit 170 from the second stage of the first piston-cylinder unit 140, more about which is said below. Specifically, as for the dimensions of the exemplary second piston-cylinder unit 170, the nominal inside diameter of the second cylinder wall 173 is three and one quarter inches (3¼ in) and the nominal outside diameter of the second displacement rod 198 is two and half inches (2½ in), such that the nominal annular space between the second displacement rod 198 and the second cylinder wall 173 is three eighths inch (⅜ in) all the way around. Accordingly, the resulting surface area ratio between the third and fourth stages of compression, or between the down stroke and the upstroke, as calculated similarly to the above for the first and second stages of compression in the first piston-cylinder unit 140, comes to approximately 2.4 for the second piston-cylinder unit 170. It will again be appreciated that the effective second piston-cylinder unit working surface ratio is exemplary of aspects and principles of the present invention, which is not limited thereto. In connection with the operative position shown in FIG. 13, those skilled in the art will appreciate that the cap valve 182 located on the second base cap 191 by which the second stage compressed fluid first enters the space within the second cylinder 172 below the second piston 180 is closed as by both the pressure effects above the cap valve 182 caused by the descending piston 180 and by the biasing effects of the second spring-biased bolt 185 on which the cap valve 182 is slidably installed, whereby in cooperation with the descending piston 180 and displacement rod 198, again, the compressed fluid within the cylinder 172 is further compressed in the third stage of compression within the second piston-cylinder unit 170 of the exemplary compression apparatus 100 of the present invention. Referring now to FIG. 14, as the second piston 180 continues its down stroke it eventually arrives at the bottommost position as shown, wherein the second piston wall 188 is received within an annular space formed between the second base cap 191 and the second cylinder wall 173. Moreover, as shown, the bottom surface of the body 186 of the second piston 180 is configured with a profile that substantially conforms to that of the second base cap 191, including the cap valve 182 located on the second base cap 191 and the protruding end of the spring-biased bolt 185. Again, those skilled in the art will appreciate that substantially seating the offset surfaces in this manner reduces the clearance pocket considerably, thereby further improving the efficiency and effectiveness of the compression apparatus 100, and the second piston-cylinder unit 170, particularly. As shown in the second operative position of FIG. 14, then, the second piston 180 has just completed its down stroke and is at the lowest position within the second cylinder 172. From this position, with reference now to FIG. 15, as the piston 180 starts back up as driven by the connection of the second displacement rod 198 to the drive mechanism 110 (FIGS. 1-8) through the first timing pulley crank 134, simultaneously, the fourth stage of compression is happening above the piston 180 to the fluid that was previously compressed during the third stage and additional compressed fluid is being pushed into the space below the piston 180 from the second stage of the first piston-cylinder unit 140, which fluid will then be compressed in the next third stage cycle. In more detail, with continued reference to FIG. 15, as the piston 180 travels upward within the cylinder 172 during this phase of operation, in the exemplary embodiment wherein two stages of compression have occurred in the upstream first piston-cylinder unit 140, once more, the compressed fluid exiting the first piston-cylinder unit 140 through the first connector 169 then passes through the hose 108 and into the second piston-cylinder unit 170, and specifically through the second connector 199 and into the space bounded by second base 174 and the second base cap 191. It will be appreciated that the increased pressure on the back side of the cap valve 182 coupled with the pressure drop, or slight vacuum, on the front side of the cap valve 182 as caused by the ascending piston 180 moving away from the second base cap 191 and toward the top end of the stroke essentially lifts the cap valve 182 out of contact with the second base cap 191 against the resistance of the second spring-biased bolt 185, whereby the cap channels 184 formed in the second base cap 191 are opened and allow the second stage compressed fluid to enter the space within the second cylinder 170 below the piston 180 as the piston 180 is on its upstroke. Those skilled in the art will appreciate that the pressurized fluid from the first piston-cylinder unit 140, or in the exemplary embodiment from the second stage of compression, is infilling into the space below the second piston 180, acting on the piston's relatively larger bottom surface and pushing the piston up, thereby aiding in the fourth stage of compression that is concurrently taking place in the space above the piston 180, or by the piston's relatively smaller top surface. As explained above, the piston's surface area differential, in this case approximately 2:1, allows for the lower pressure on the bottom side of the piston to have essentially a doubling effect on the top side reducing the amount of energy required for the fourth stage of compression. With continued reference to FIG. 15, as the second piston 180 continues on its upstroke, with compressed fluid being pushed into the space below the piston 180 as described above, it will be appreciated that inertial and pressure effects have at the same time closed the second piston valve 189 above the second piston 180 so as to seal off the through-holes 187 formed in the second piston's body 186. It will be further appreciated that the second piston wall 188 serves to seal against the inside surface of the second cylinder wall 173, thereby cooperating with the second piston valve 189 to substantially seal off the compressible fluid in the space above the second piston 180 as the piston 180 travels upward in the cylinder 172, thereby facilitating the fourth stage of compression in the second piston-cylinder unit 170. This process continues as the piston 180 travels upward until the pressure of the fourth stage overcomes or at least matches the downstream system pressure, in which case the second lower collar member valve 192 opens as shown in FIG. 15 and the fourth stage compressed fluid passes through the second passages 177 formed in the second lower collar member 176 and into the downstream system. Finally, referring to FIG. 16, there is shown the second piston 180 now fully at its uppermost position, or at the end of the upstroke and ready to start back on its down stroke. Here, the cap valve 182 closes both by pressure effects as the second piston 180 begins to reverse direction and as biased by the bolt 185. Thus, it will be appreciated that as the piston 180 then begins its down stroke, the fluid previously introduced into the space below the piston 180 as explained above in connection with FIG. 15, which again is the second stage compressed fluid from the first piston-cylinder unit 140, is now compressed in what is in the exemplary embodiment the third stage of compression.

Figure 16:
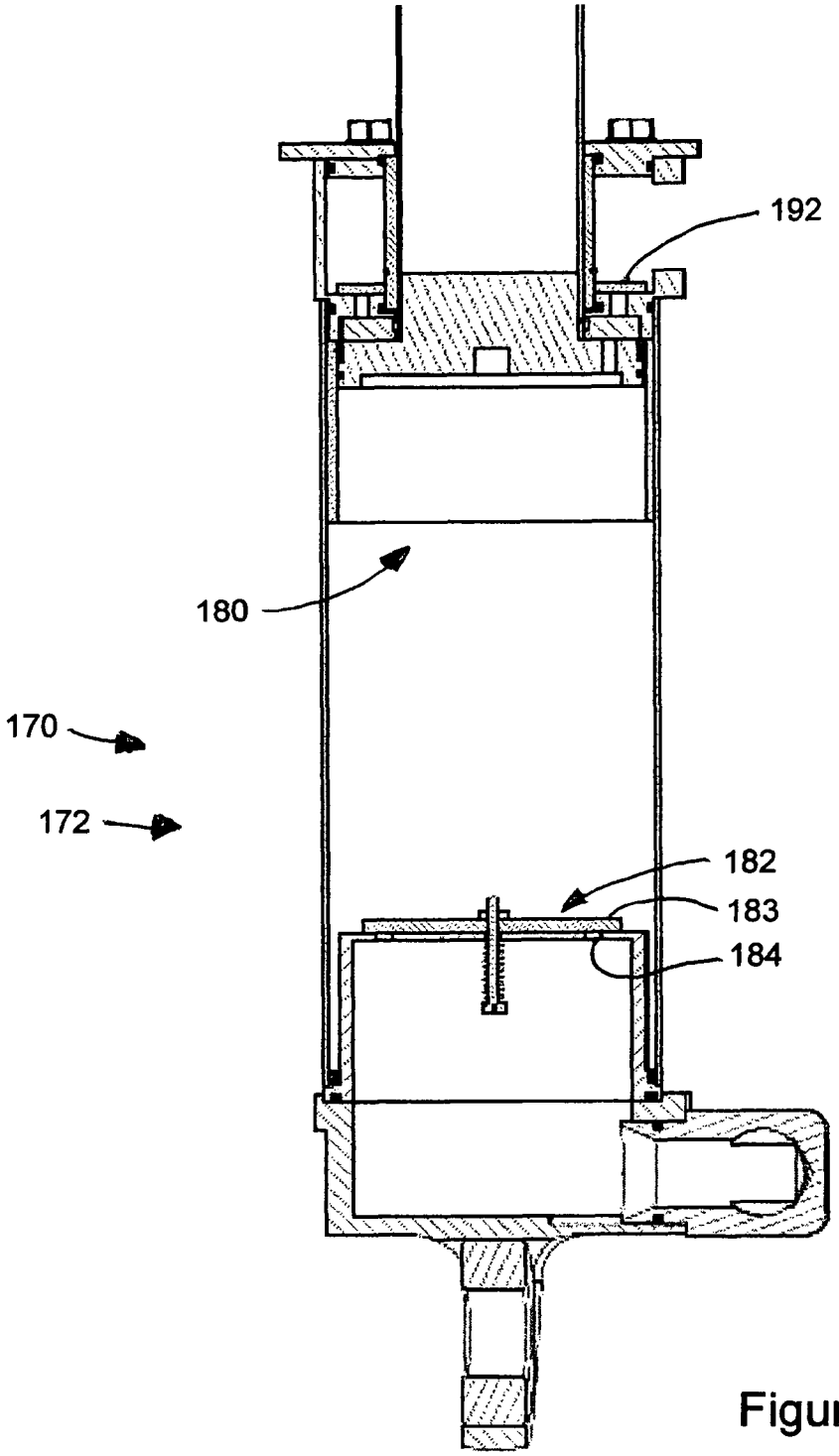
FIG. 16 is an enlarged partial sectional view of a second piston-cylinder unit thereof in a fourth operative position.
Figure 17:
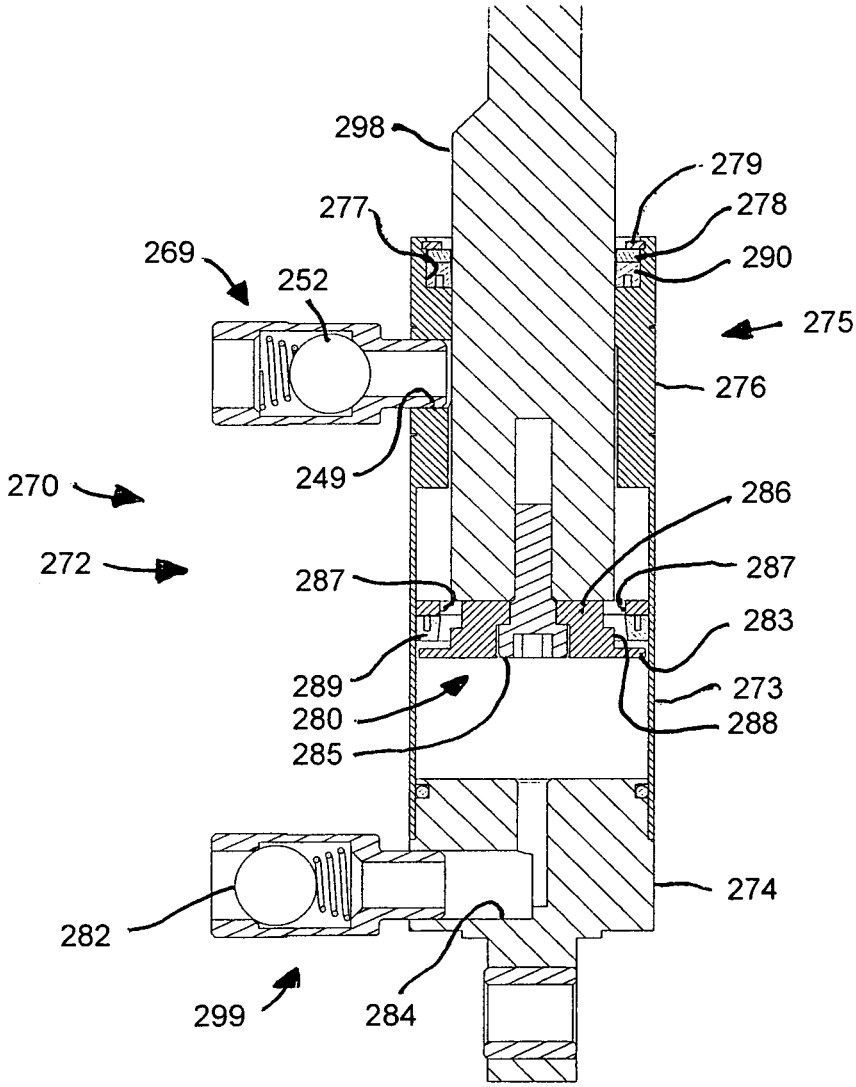
FIG. 17 is an enlarged partial sectional view of an alternative second piston-cylinder unit thereof in a first operative position.
Figure 18:
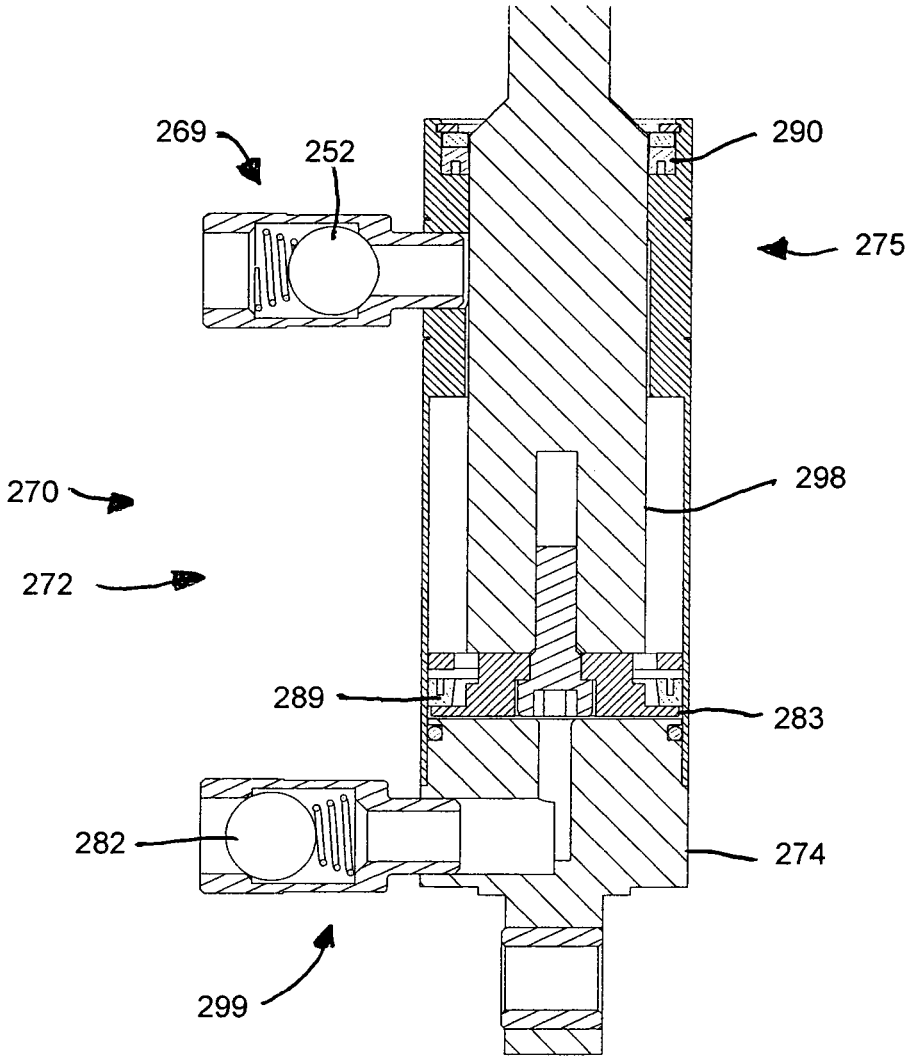
FIG. 18 is an enlarged partial sectional view of an alternative second piston-cylinder unit thereof in a second operative position.
Figure 19:
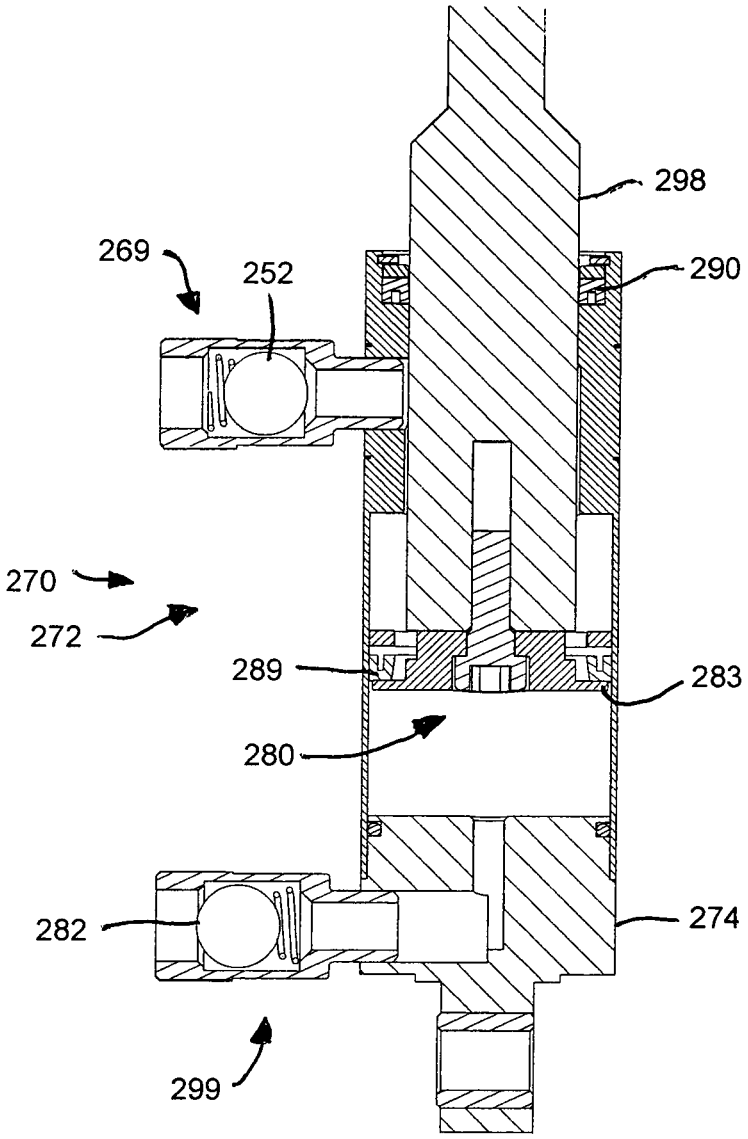
FIG. 19 is an enlarged partial sectional view of an alternative second piston-cylinder unit thereof in a third operative position.
Figure 20:
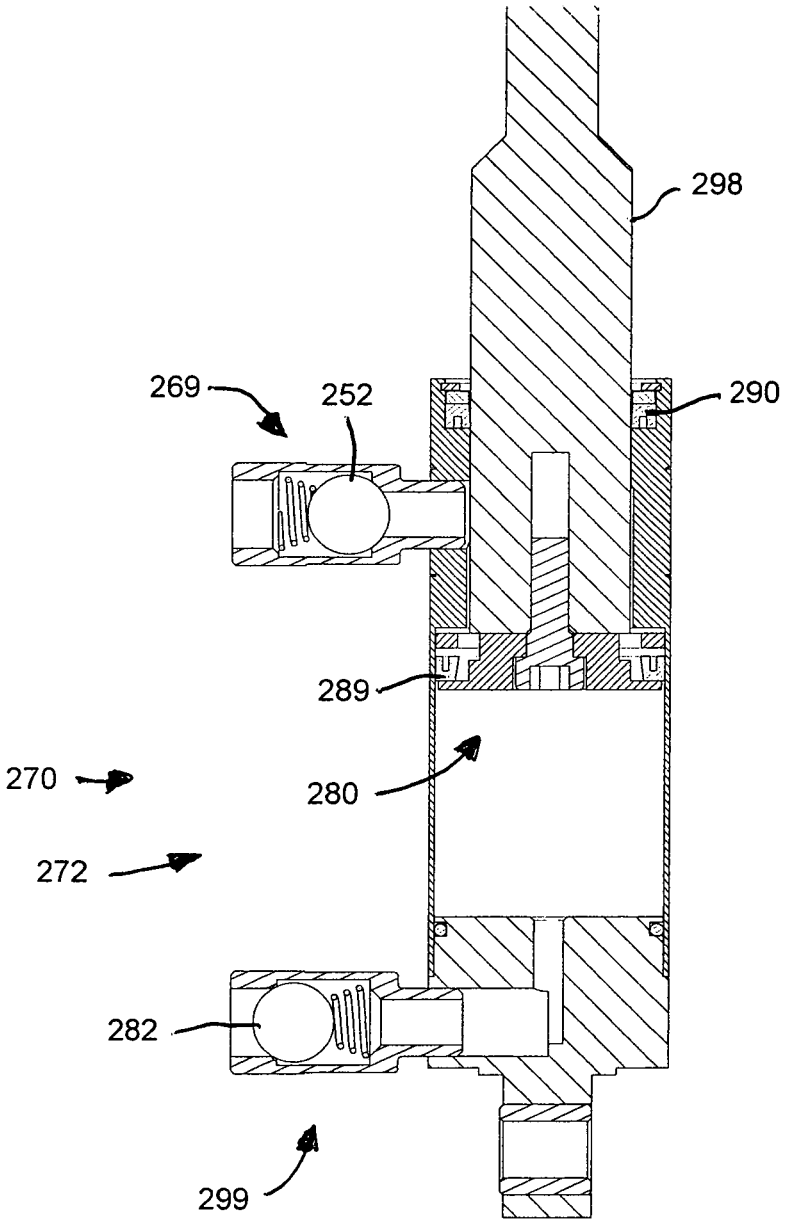
FIG. 20 is an enlarged partial sectional view of an alternative second piston-cylinder unit thereof in a fourth operative position.

Referring next to FIGS. 17-20, there is shown a second exemplary embodiment of the second piston-cylinder unit 270 again in four enlarged cross-sectional views representing essentially the same four operative positions as shown for the first exemplary embodiment of the second piston-cylinder unit 170 (FIGS. 13-16). Generally, it can be seen that here the alternative second piston-cylinder unit 270 again includes a second cylinder 272 within which a second piston 280 is operable as driven by a second displacement rod 298. The cylinder 272 again includes a second cylinder wall 273 capped at its end opposite the second base 274 with a second collar assembly 275 through which the displacement rod 298 slidably and sealingly passes. In more detail, in the alternative exemplary embodiment, the second collar assembly 275 is a single collar member 276 integral with the second cylinder wall 273. And rather than a valved annular space formed within the collar assembly 275, a first spring-biased ball valve connector 269 is installed at the exit 249 from the cylinder 272 formed in the collar member 276 at the cylinder's upper end, more about which will be said below. Similarly, rather than a base cap 191 with cap valve 182 at the lower end of the cylinder 172 as in the first exemplary second piston-cylinder unit 170 shown in FIGS. 13-16, here, a second spring-biased ball valve connector 299 is installed at the entrance 284 formed in the second base 274 at the cylinder's lower end, more about which will also be said below. As for the slidable passage of the second displacement rod 298 within the second cylinder 272, or through the collar member 276 of the upper collar assembly 275, in the alternative exemplary embodiment, a lip seal 290 is installed in a recess 277 formed in the collar member 276 and is retained therein by a keeper disk 278 and retaining ring 279. The lip seal 290 and keeper disk 278 and ring 279 may be made of any suitable material now known or later developed, though in the exemplary embodiment the lip seal is urethane, the keeper disk 278 is aluminum and the retaining ring to 279 is stainless steel. It will be further appreciated that the geometrical set up of the lip seal and keeper components is merely illustrative and that other such components and arrangements for effectuating a reduced-friction or sliding seal about the displacement rod may be employed in the present invention without departing from its spirit and scope. In a first operative position of the alternative second piston-cylinder unit 270 as shown in FIG. 17, it can be seen that the piston 280 is roughly midway through its down stroke. Again, the first operative position of the second piston 280 within the second cylinder 272 substantially corresponds to the first operative position of the first piston 150 within the first cylinder 142 as shown in FIG. 9. That is, the first operative positions of the first and second piston-cylinder units 140, 270 as shown in FIGS. 9 and 17 represent a particular "snap shot" of the movement of the drive mechanism 110 (FIGS. 1-8), with the attendant advantages of the first and second piston-cylinder units 140, 270 being out-of-phase, here again by roughly one to ninety degrees (1°-90°), once more being realized. With continued reference to FIG. 17 showing the alternative second piston 280 midway through its down stroke, it can be seen that an alternative valve arrangement is employed. A further alternative second piston valve 289 configured essentially as a lip seal is installed within a circumferential groove 288 formed in the piston body 286 so as to function as the piston side wall, or that portion of the piston 280 that comes into contact with and seals against the inside surface of the cylinder wall 273. The piston body 286 is shown as being installed on the end of the displacement rod 298 using a standard bolt 285, though it will be appreciated that any assembly method now known or later developed in the art may be employed without departing from the spirit and scope of the invention. In the exemplary embodiment, the thickness of the piston valve 289 is dimensionally less than the width of the circumferential groove 288, such that the valve 289 is able to slide up and down, or reciprocate, within the groove 288. In the top side of the piston body 286, through-holes 287 are once again formed thereabout, here intersecting and being in fluid communication with the circumferential groove 288, preferably such that the through-holes 287 are at least partially radially inset from the inside surface of the piston valve 289 so as to facilitate a selective flow path essentially behind the valve 289, or on the inside of the valve 289, and through the through-holes 287, more about which is said further below. On the bottom side of the piston body 286, below the circumferential groove 288, there is effectively formed a piston flange 283 the outside diameter of which is less than the inside diameter of the cylinder wall 273 such that a radially-outward annular space is formed for the selective passage of fluid from below the piston 280 to above. It will be appreciated that the outside diameter of the piston flange 283 is preferably greater than the inside diameter of the piston valve 289, both to support the valve 289 from below and to provide a lateral surface against which the valve 289 can selectively seal. Specifically, as shown in FIG. 17 with the piston 280 again on its down stroke within the alternative second piston-cylinder unit 270, based once more on both inertial and pressure effects, and also frictional effects, the piston valve 289 slidably opens, or shifts upward within the circumferential groove 288, thereby coming out of contact with the piston flange 283 and allowing fluid to flow from beneath the piston 280 through the annular space around the piston flange 283, underneath and then behind the lifted piston valve 289 and next through the through-holes 287 formed in the body 286 to the annular space above the piston 280 between the displacement rod 298 and the cylinder wall 273. As explained previously, the fluid so moving into the space above the piston 280 is yet still compressed due to the displacement of volume within the cylinder 272 by the piston 280 and the displacement rod 298 on their downward travel. The fluid being compressed in this third stage is that delivered to the alternative second piston-cylinder unit 270 from the second stage of the first piston-cylinder unit 140, more about which is said below. Again, it will be appreciated that though the exemplary embodiments relate to a multi-stage set-up, and a four-stage arrangement, specifically, the invention is not so limited, and cylinder and valve designs embodying aspects and principles of the present invention may also be employed in a number of other contexts, such that the illustrated context is to be understood as being merely exemplary. As for the dimensions of the exemplary alternative second piston-cylinder unit 270, the nominal inside diameter of the second cylinder wall 273 is one and three eighths inch (1⅜ in) and the nominal outside diameter of the second displacement rod 298 is one and one eighth inch (1⅛ in), such that the nominal annular space between the second displacement rod 298 and the second cylinder wall 273 is one quarter inch (¼ in) all the way around. Accordingly, the resulting surface area ratio between the third and fourth stages of compression, or between the down stroke and the upstroke, as calculated similarly to the above for the first and second stages of compression in the first piston-cylinder unit 140 and in the third and fourth stages of compression in the exemplary second piston-cylinder unit 170, comes to approximately 3.0 for the alternative second piston-cylinder unit 270. It will again be appreciated that the effective second piston-cylinder unit working surface ratio is exemplary of aspects and principles of the present invention, which is not limited thereto; rather, as will be appreciated from the foregoing, a ratio of the effective working surface below the piston versus that above in any piston-cylinder unit on the order of 1.1 to 20 may be employed in the present invention without departing from its spirit and scope, though it will be appreciated that other ratios even outside of this range may also result from particular geometries embodying the aspects and principles of the present invention and selected and employed to suit a particular context. For example, and generally speaking, the lower the density of the compressible fluid, the higher the surface area ratio that may be employed, as relatively less work would be required to increase the pressure of such a fluid, in which case relatively bigger jumps from an initial to subsequent stage of compression may be possible and desirable. And the converse is also true, that for relatively higher density of gas or liquid and gas being compressed, it may be desirable to employ relatively lower surface area ratios between stages so as to build the pressure up more gradually and thus require relatively less work from the drive mechanism. In connection with the operative position shown in FIG. 17, those skilled in the art will appreciate that the second spring-biased ball valve connector 299 installed in the cylinder base 274, and particularly the second ball 282 located therein, is closed as by both the pressure effects above the base 274 caused by the descending piston 280 and by the biasing effects of the spring against which the second ball 282 is nested within the connector 299. Similarly, the first spring-biased ball valve connector 269 installed within the collar assembly 275 at the upper end of the cylinder 272 is also closed, and the first ball 252 particularly as being biased by the spring against which it is seated within the first connector 269. Those skilled in the art will appreciate that while ball valves are shown and described in connection with the first and second connectors 269 and 299, piston-type check valves and any other such check valves or one-way valves now known or later developed may be employed in the present invention without departing from its spirit and scope. Finally, it will be appreciated that the lip seal 290 as retained in slidable engagement about the displacement rod 298 seals the outside diameter thereof, whereby in cooperation with the descending piston 280 and displacement rod 298 and the other seals described above, again, the compressed fluid within the cylinder 272 is further compressed in the third stage of compression within the alternative second piston-cylinder unit 270, the fluid effectively having nowhere to escape and so being squeezed by the downwardly traveling piston 280 and displacement rod 298 as together they take up more and more of the volume within the cylinder 272. Referring now to FIG. 18, as the second piston 280 continues its down stroke it eventually arrives at the bottommost position as shown, wherein the piston flange 283 is substantially adjacent the cylinder base 274 so as to again reduce the clearance pocket and further improve the efficiency and effectiveness of the compression apparatus 100, and of the alternative second piston-cylinder unit 270, particularly. As shown in the second operative position of FIG. 18, then, the second piston 280 has just completed its down stroke and is at the bottommost position within the second cylinder 272, at which time pressure and inertial effects have now closed, or shifted downwardly within the piston body's circumferential groove 288 the piston valve 289. From this position, with reference now to FIG. 19, as the piston 280 starts back up, simultaneously, the fourth stage of compression is happening above the piston 280 to the fluid that was previously compressed during the third stage and additional compressed fluid is being pushed into the space below the piston 280 from the second stage of the first piston-cylinder unit 140, which fluid will then be compressed in the next third stage cycle. In more detail, with continued reference to FIG. 19, as the piston 280 travels upward within the cylinder 272 during this phase of operation, in the exemplary embodiment wherein two stages of compression have occurred in the upstream first piston-cylinder unit 140, once more, the compressed fluid exiting the first piston-cylinder unit 140 through the first connector 169 then passes through the hose 108 and into the second piston-cylinder unit 270, and specifically through the second connector 299, around the ball 282 as now unseated against the biasing spring due to both the increased pressure on the back side of the ball 282 and the pressure drop on the front side of the ball 282 as caused by the ascending piston 280 moving away from the second base 274 and toward the top end of the stroke, through the entrance 284 within the base 274, and into the space below the piston 280 as the piston 280 is on its upstroke. With continued reference to FIG. 19, as the second piston 280 continues on its upstroke, receiving pressurized fluid into the space below the piston 280 as described above so as to again help lift the piston 280, it will be appreciated that frictional drag and pressure effects have at the same time again closed the piston valve 289 by it having shifted downward within the circumferential groove 288 formed in the second piston's body 286 and thus sealing against the piston flange 283 below, which valve 289 again serves to seal against the inside surface of the second cylinder wall 273, whereby fluid cannot pass from one side of the piston 280 to the other through the through-holes 287, thereby facilitating the fourth stage of compression in the alternative second piston-cylinder unit 270. This process continues as the piston 280 travels upward until the pressure of the fourth stage overcomes or at least matches the downstream system pressure in combination with the biasing spring within the first connector 269, in which case the first connector 269 opens, the first ball 252 coming unseated against the resistance of the spring as a result of the increasing pressure, whereby the fourth stage compressed fluid passes through the first connector 269 and into the downstream system. Finally, referring to FIG. 20, there is shown the second piston 280 now fully at its uppermost position, or at the end of the upstroke and ready to start back on its down stroke. Here, the first and second connectors 269, 299 again close both by pressure effects as the second piston 280 begins to reverse direction and as biased by the springs against which the first and second balls 252, 282 are seated. Thus, it will be appreciated that as the piston 280 then begins its down stroke, the fluid previously introduced into the space below the piston 280 as explained above in connection with FIG. 19, which again is the second stage compressed fluid from the first piston-cylinder unit 140, is now compressed in what is in the exemplary embodiment the third stage of compression. It will be appreciated that such an alternative valve set up, particularly the piston valve 289 that is configured as a urethane lip seal in the exemplary embodiment, may preferably be employed in liquid lubricated contexts wherein both gases and liquids make up the compressible fluid. More generally, it will be appreciated that while a particular further exemplary piston-cylinder set up is shown and described, the invention is not so limited. Rather, a variety of other configurations and materials may be employed without departing from the spirit and scope of the invention. As such, while a particular number and size of through-holes and passages, particular wall thicknesses, and the like are shown and described, the invention is not so limited. Moreover, as established above relative to a particular multi-stage piston-cylinder unit's surface area ratio, and thus the dimensions of the piston, cylinder and displacement rod, all such geometries may vary depending on the application. By way of further example, while multiple components are often shown as being installed one on the other with o-rings or the like therebetween in the conventional fashion so as to form a seal between mating surfaces, two or more such components may instead be formed and installed integrally so as to eliminate the need for such o-rings. Or, sealing means now known or later developed other than o-rings may also be employed. Thus, those skilled in the art will appreciate that while the present invention is presented in at least three different embodiments of the piston-cylinder unit one or more of which make up the compression apparatus, a virtually infinite variety of such units geometrically and as employed in one or more single or multi-stage cylinder arrangements on one or more drive mechanisms of various types come within the spirit and scope of the invention.

In use of an exemplary multi-stage compression apparatus 100 as shown in the embodiment of FIGS. 1-8, in the exemplary context of an industrial air compressor, i.e., where air is the fluid or compressible medium on which the apparatus 100 acts, it will be appreciated based on the above discussion relating to the exemplary first and second piston-cylinder units 140, 170 shown in FIGS. 9-16 that illustrated is a four-stage set-up, with each piston-cylinder unit 140, 170 being double-acting. Once again, those skilled in the art will appreciate that any combination and number of single-acting or double-acting piston-cylinder units may be employed in such a compression apparatus according to aspects of the present invention without departing from its spirit and scope, such that the illustrated embodiment is to be understood as merely exemplary and non-limiting. With continued reference to FIGS. 1-8, in operation, as the motor 116 is powered, rotation of the drive shaft 120 and drive pulley 118 installed thereon serves to turn the timing pulleys 112, 114 through engagement of the timing belt 122. As above-described, such rotation of the timing pulleys 112, 114 translates to spatial movement of the piston rods and cylinders relative to one another so as to reciprocate the piston within its cylinder and do the work of compression described in conjunction with the operation of the piston valves and, in the exemplary embodiment, the relatively large diameter displacement rod. It will be appreciated that such reciprocating movement of the piston essentially vertically within the cylinder is simultaneous with spatial oscillation or reciprocation of the cylinder both laterally and vertically, depending on the rotational positions of the pulleys. But because such reciprocating or oscillating movement of the piston-cylinder units 140, 170 is effectively balanced through the corresponding movement of both the top of the displacement rod and the base of the cylinder that results from the substantially matched offset cranks on the respective pulleys, or the opposite couplings in the case of the piston-cylinder unit installed opposite the pulleys. Those skilled in the art will again appreciate that a number of other drive mechanisms and arrangements may be employed for relatively balanced, dynamic movement of the one or more piston-cylinder units without departing from the spirit and scope of the invention. In the exemplary embodiment, on the upstroke of the first piston-cylinder unit 140, ambient air is filtered by filter 139 and drawn into the space below the piston 150 through the displacement rod 168 as described above in connection with FIG. 10. After reaching the top of its stroke as shown in FIG. 11, this ambient air is then compressed above and below the piston 150 as by both the piston 150 and the displacement rod 168 descending within the cylinder 142, as described above in connection with FIG. 12. It will be appreciated that after the piston 150 reaches the bottom of its stoke as shown in FIG. 9, the air thus compressed during the first stage of compression within the first piston-cylinder unit 140 and then trapped above the piston 150 as it starts back on its up stroke is then compressed during a second stage of compression in the first piston-cylinder unit 140 and pushed past the lower collar member valve 162 into the space between the lower and upper collar members 146, 148 of the first cylinder's collar assembly 145, as also described above in connection with FIG. 10. Those skilled in the art will appreciate that the space within the collar assembly 145 thus serves as a reaction chamber capturing or holding a reserve volume of compressed air that serves to effectively chase or push the compressed air forward within the system so that the next compression stage has air entering the cylinder below the piston at a pressure higher than ambient, thereby helping lift the piston on its up stroke and effectively pre-charging the second cylinder 172 for the compression stroke. Specifically, the compressed air from the second stage compression within the first piston-cylinder unit 140 effectively fills the collar assembly 145 and the air line 108 connected from the first connector 169 at the upper end of the first piston-cylinder unit 140 to the second connector 199 at the lower end of the second piston-cylinder unit 170. In the exemplary embodiment, the second piston-cylinder unit 170 is further formed at its lower end with a base 174 and base cap 191 that together form effectively a second volume or reaction chamber in which the second stage compressed air from the first piston-cylinder unit 140 may be stored. Then, when the second piston-cylinder unit 170 is on its up stroke as shown in FIG. 15, the second stage compressed air is able to overcome the cap valve 182 located on the second base cap 191 and enter the space within the second cylinder 172 below the second piston 180, thereby helping push the piston 180 up as it works against the air above the piston 180 in the fourth stage of compression. It will thus be appreciated that the pushing pressure of compressed air from the second stage not only serves to help lift the piston but effectively creates a reduced pressure differential above and below the piston so that the effective work of the piston is also reduced. It will be further appreciated that the surface area ratio above and below the piston 180 further reduces the relative work of the piston 180, and thus the drive mechanism 110, on its up stroke, as explained further in the text herein. Once the piston 180 has reached the top end of its stroke as shown in FIG. 16, the piston 180 then starts back down as shown in FIG. 13, thereby further compressing the second stage compressed air in a third stage of compression, again in the exemplary embodiment both below and above the piston 180 in cooperation with the second displacement rod 198, as explained above in connection with FIG. 13. After reaching the bottom of its stroke as shown in FIG. 14, the piston then starts back up as described above, whereby the third stage compressed air trapped above the piston 180 is finally compressed in the exemplary embodiment in a fourth stage of compression and then discharged to the system, which could be further compression apparatuses or stages, a holding tank, or a device operating on compressed air. It will be appreciated that a virtually infinite number of resulting or final air or other fluid pressures can be achieved to suit a particular application by simply scaling or ganging piston-cylinder units according to aspects of the present invention. It will be further appreciated that such multi-stage set ups and the "pushing" or "chasing" effect achieved through such arrangements, or the introduction of pressurized fluid on the side of multi-stage pistons opposite the direction of their travel, along with the "internal breathing" valve arrangements of the piston-cylinder units according to aspects of the invention, can vary according to the application and, specifically, that while the exemplary embodiment of FIGS. 1-8 incorporates in such a compression apparatus piston-cylinder units operating on the principle of the displacement rod in the first and third stages of compression, other piston-cylinder units according to further aspects of the present invention and the prior patent applications cited and incorporated herein may also be employed without departing from the spirit and scope of the invention.

Figure 21:
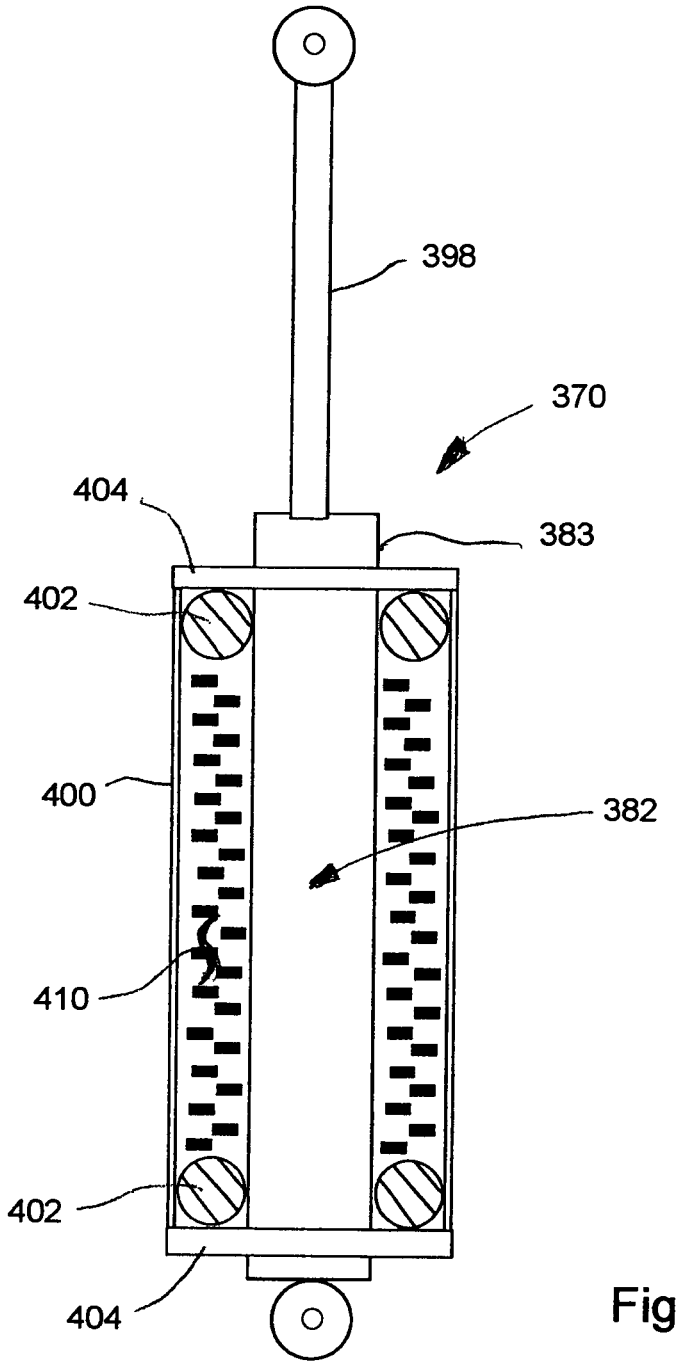
FIG. 21 is an enlarged schematic view of a piston-cylinder unit thereof having a passive cooling tube.
Figure 22:
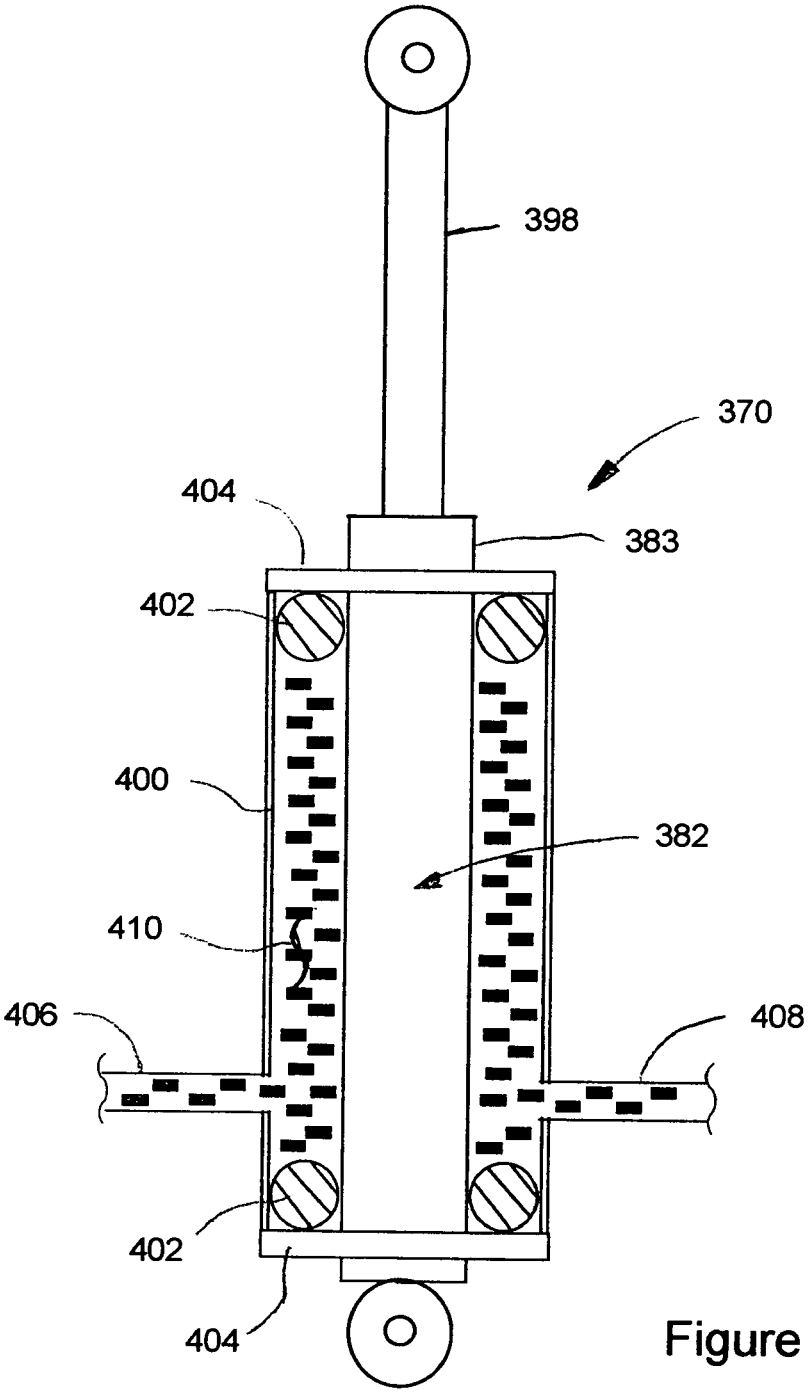
FIG. 22 is an enlarged schematic view of a piston-cylinder unit thereof having an active cooling tube.

Turning now to FIGS. 21 and 22, there are shown passive and active cooling tube arrangements that may be employed on piston-cylinder units in accordance with aspects of the present invention. First, referring to FIG. 21, there is shown in schematic form a passive, fluid-cooled piston-cylinder unit 370 essentially comprised of a cylinder 382 in which a piston (generally shown in FIGS. 9-20) operates through its connection to the displacement rod 398, the cylinder 382 being surrounded by a sealed, preferably hermetically sealed, substantially concentric tube 400 so as to form an annular space in which a fluid 410 resides. In the exemplary embodiments, in order to seal off the annular space, o-rings 402 are installed at opposite ends of the cylinder 382 between the cylinder wall 383 and the outer cooling tube 400, with end caps 404 then installed on the ends of the tube 400 in order to retain the o-rings 402 and the tube 400 in place as an integral unit about the cylinder 382. While an annular outer tube or tube 400 has been shown and described as being sealed concentrically about the cylinder by way of opposite o-rings 402, those skilled in the art will appreciate that the invention is not so limited. Rather, a number of shapes and configurations of the outer tube and means for forming a seal between the tube and the outside surface of the cylinder body are possible without departing from the spirit and scope of the invention. In terms of the fluid within the annular space, it may be water with or without an additive such as coolant or mineral oil or any other such fluid now known or later developed in the art as having good heat exchange properties. It will be appreciated by those skilled in the art that the lateral oscillating movement of the piston-cylinder unit 370 during use as it is driven by the drive mechanism 110, as explained above in connection with FIGS. 1-8, will serve to agitate the fluid 410 and continually move the fluid over the surface of the cylinder wall 383, thereby allowing for both conductive and convective heat transfer. By the same token, the heat entering the fluid 410 is transferred out of the fluid and into the outer tube 400, where further conductive and convective heat transfer takes place with ambient air or other surroundings, which is also constantly replenished at the outer surface of the tube 400, again, by virtue of the oscillating movement of the piston-cylinder unit 370 during operation of the drive mechanism 110 (FIGS. 1-8). Similarly, in the alternative dynamically-cooled embodiment of the piston-cylinder unit 370 of FIG. 22, there is again shown a cylinder 382 surrounded by a tube 400 sealed at opposite ends by o-rings 402 retained by end caps 404, only an active fluid-cooled arrangement is disclosed in that there are at least two ports 406, 408 formed in the outer tube 400 and configured to provide communication with the annular space between the tube 400 and the cylinder wall 383. In this way, the fluid 410 may be continually refreshed during use so as to further enable the conductive and convective heat transfer out of the cylinder 382. In an exemplary embodiment where a first port 406 serves as an inlet and a second port 408 serves as an outlet, it will be appreciated by those skilled in the art that a re-circulating, closed loop can be configured much like that of a standard refrigerator, whereby a heat exchange fluid 410 such as Freon can be employed and continually recharged and re-supplied to the annular space within the tube 400 so as to further improve the cooling of the cylinder 382. Such an approach would be particularly well-suited to high pressure applications where potentially more heat would build up within the compression unit piston-cylinder unit 370 during use. Once again, those skilled in the art will appreciate that numerous other configurations of the tube, the one or more ports communicating therethrough with the space in which the fluid resides, and the means for forming a seal between the tube and the outside surface of the cylinder body are possible without departing from the spirit and scope of the invention.

Figure 24:
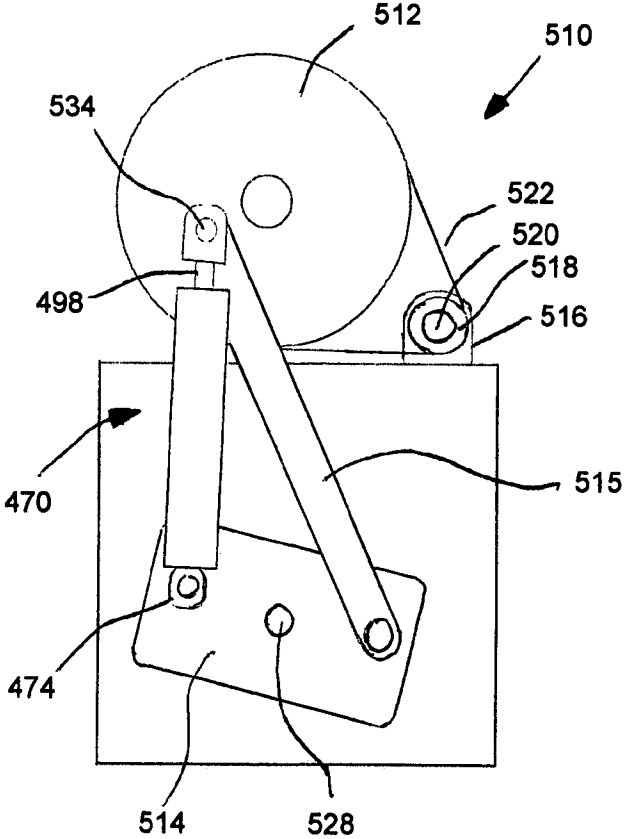
FIG. 24 is a schematic view of the alternative drive mechanism of FIG. 23 in a second operative position.
Figure 23:
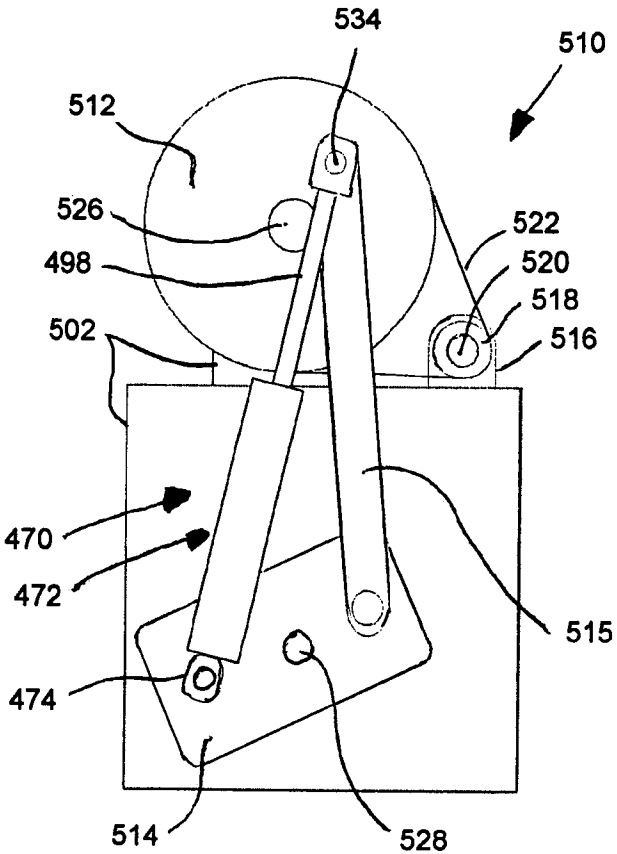
FIG. 23 is a schematic view of an alternative drive mechanism in a first operative position.

Referring now to the schematics of FIGS. 23 and 24, there is diagrammed an alternative drive mechanism 510 for at least one piston-cylinder unit 470 according to still further aspects of the present invention. Here, a motor 516 and single flywheel 512 are mounted on a frame 502 such that a pulley 518 installed on the motor's shaft 520 drives a belt 522 operably connected to the flywheel 512, which rotates about a first shaft 526. The belt 522 may be a drive belt, such as a poly V-belt or other industrial belt or any such belt now known or later developed. Opposite the flywheel 512 on the frame 502, a first linkage 514 is pivotably installed on a second shaft 528. To one end of the first linkage 514, the base 474 of the cylinder 472 is pivotably installed. A second linkage 515 is pivotably installed to the end of the first linkage 514 opposite the connection of the cylinder base 474, such that the piston-cylinder unit 470 and the second linkage 515 are in a sense installed on the first linkage 514 in "see saw" fashion about the second shaft 528. The free ends of the displacement rod 498 operating within the piston-cylinder unit 470 and of the second linkage 515 are then pivotably connected to a crank 534 installed on the flywheel 512 offset from the flywheel's shaft 526. As such, it will be appreciated that as the flywheel 512 rotates as driven by the motor 516 through the belt 522, the crank 534 sweeps through a circular path having a radius equal to the offset distance between the axes of the first shaft 526 and of the crank 534. The spatial travel of the crank 534 about the first shaft 526 translates to oscillatory movement of the piston-cylinder unit 470 as dictated by the first and second linkages 514 and 515. Specifically, assuming for the sake of example that the flywheel 512 is being driven counter-clockwise, as the crank 534 shown in the quadrant between the noon and three o'clock positions travels toward the noon position, this will serve to pull the displacement rod 498 out of the cylinder 472 on the upstroke of the piston-cylinder unit 470. This will likewise pull the second linkage 515 also connected to the crank 534 upward, thereby toggling the first linkage 514 counter-clockwise about the second shaft 528, which movement in turn raises the end of the first linkage 514 at which the second linkage 515 is connected, thereby lowering the opposite end of the first linkage 514 at which the cylinder base 474 is connected. It will thus be appreciated that such movement of the first linkage 514 as caused by the connection between one end of the first linkage 514 and the crank 534 through the rigid second linkage 515 causes the cylinder base 474 to shift downwardly as the displacement rod 498 is shifting upwardly as being connected to the crank 534. The result is the amplification of the stroke of the piston-cylinder unit 470 by having the displacement rod 498 and cylinder base 514 spatially moving in substantially opposite directions. As the flywheel 512 continues its counter-clockwise rotation, the crank 534 will eventually come to a second position as shown in FIG. 24 wherein the second linkage 515 has pushed the end of the first linkage 514 to which it is connected back down as the distance between the crank 534 and the second shaft 528 has gotten closer. It will be appreciated that such toggling of the first linkage 514 about the second shaft 528 serves to at the same time raise the end of the first linkage 514 to which the cylinder base 474 is connected. As such, in this operative position, the displacement rod 498 is being driven or shifted downward while the cylinder base 474 is being shifted upward, thereby effectuating the down stroke of the piston-cylinder unit 470. The oscillating action of the piston-cylinder unit 470 as caused by the alternative drive mechanism 510 thus continues with each revolution of the flywheel 512. Those skilled in the art will appreciate that by simply varying the lengths of the first and second linkages, the positions of the pivot points relative to each other, and the geometry of the piston-cylinder unit, a variety of other such compression apparatus setups may be achieved without departing from the spirit and scope of the invention. In any such configuration, it will be further appreciated that in addition to effectively increasing stroke length by simultaneously shifting both the cylinder and the rod as above described, such movement is also dynamically effected through the intermittent speed of the mechanism that naturally results from such a kinematic arrangement. Or, put another way, to get the same stroke length without setting up the base of the cylinder on an oscillating linkage as shown, the crank 534 would have to be further from the first shaft 526, in which case the side-to-side wagging of the piston-cylinder unit 470 would also be increased by the same amount. Instead, with the present arrangement, the longer stroke is achieved without having to offset the crank 534 relatively further, thereby reducing inertial and side-load effects on the piston-cylinder unit 470. Therefore, it will again be appreciated that other geometries can be employed based on aspects and principles of the present invention without departing from its spirit and scope.

Turning now to the alternative exemplary embodiments shown in FIGS. 25 and 26, the further illustrated compression apparatus according to yet further aspects of the present invention employs a direct drive brush-less DC motor, though again any such drive motor or other device now known or later developed may be employed in any such compression apparatus of the present invention. Where a DC motor is used, it will be appreciated that the motor also functions as a flywheel storing inertial energy. The motor shaft is connected to opposite drive arms with a crank pin on both sides of the motor. One side of the motor is driving a first piston-cylinder unit and the other is driving a second piston-cylinder unit, as explained above in connection with the exemplary embodiment of FIGS. 1-8 and more fully below in connection with the alternative embodiments of FIGS. 25 and 26. Such a drive mechanism once again reduces piston speed over the top and bottom of each stroke, providing improved dynamic movement of the piston and increased leverage and power of the piston itself during the cycle, all with little to no side load on the piston or piston rod. As above, a relatively long stroke, single- or double-acting piston-cylinder arrangement enables further reduced speeds so as to significantly lower inertial and reversal losses in some applications while still meeting pressure and flow rate output requirements. Incorporating the general principles of operation of the various compressor mechanisms disclosed herein and in the above-referenced prior patent applications, the efficiency of the compression apparatus is enhanced through the use of integrated internal breathing of the cylinder, whereby ambient air or other fluid is drawn into the cylinder, at least in the first stage of compression, via the hollow piston rod and piston valve. Piston ring and inlet and outlet valve designs reduce both blow by and contaminants within the fluid stream in an oil-less environment. On the upstroke in at least the first stage cylinder, fluid is drawn through the hollow piston rod down to the piston where pressure differential and inertial or frictional effects open the piston valve allowing the fluid to fill the cylinder. In the exemplary embodiment, at about ¾ of full upstroke the fluid above the piston is forced into the cylinder's lower chamber with a super-charged effect. Where the two cylinders operate independently so as to, for example, charge a common tank at substantially the same pressure, the second cylinder operates much as the first, taking in ambient fluid through the hollow piston rod. Whereas, if the two or more cylinders operate in a multi-stage, in-series arrangement, only the first cylinder would take in ambient fluid through the hollow piston rod, while the remaining cylinders would most likely be fed compressed fluid from the previous cylinder directly, as also explained above in the context of the first exemplary embodiment shown in FIGS. 1-8, or by way of a surge tank as explained in more detail below in connection with the further alternative embodiment shown in FIG. 26. In any case, on the down stroke, pressure in the cylinder's lower chamber closes the piston valve, so that the piston compresses the fluid through the outlet valve, while more fluid is being fed into the top chamber of the cylinder. Depending on the application, the multiple cylinders connected to a common drive as shown may be anywhere from zero to one-hundred-eighty degrees (0-180°) out of phase when the cylinders are single-acting, or effectively up to ninety degrees out of phase from either direction, depending on which cylinder is leading and which is lagging, when one or more of the cylinders are double-acting. In a double-acting cylinder scenario, the above general principles of operation apply, only fluid is drawn through the hollow piston rod down to the piston where the pressure differential and inertial or frictional effects open either the top or bottom piston valve, depending on where the piston is in its stroke. On the return action, pressure closes the appropriate piston valve, so that the piston compresses the fluid in one chamber and then pushes the compressed fluid through an outlet valve, all while more fluid is being drawn through the hollow piston rod and into the opposite chamber on the other side of the piston. Thus, whether single-acting or double-acting, the compression apparatus enables more efficient and quiet operation with relatively cleaner and cooler fluid output. These and other functional advantages of the present invention will be appreciated by those skilled in the art. As such, it will be further appreciated that while exemplary embodiments of the compression apparatus are shown and described, the invention is not so limited.

Figure 25:
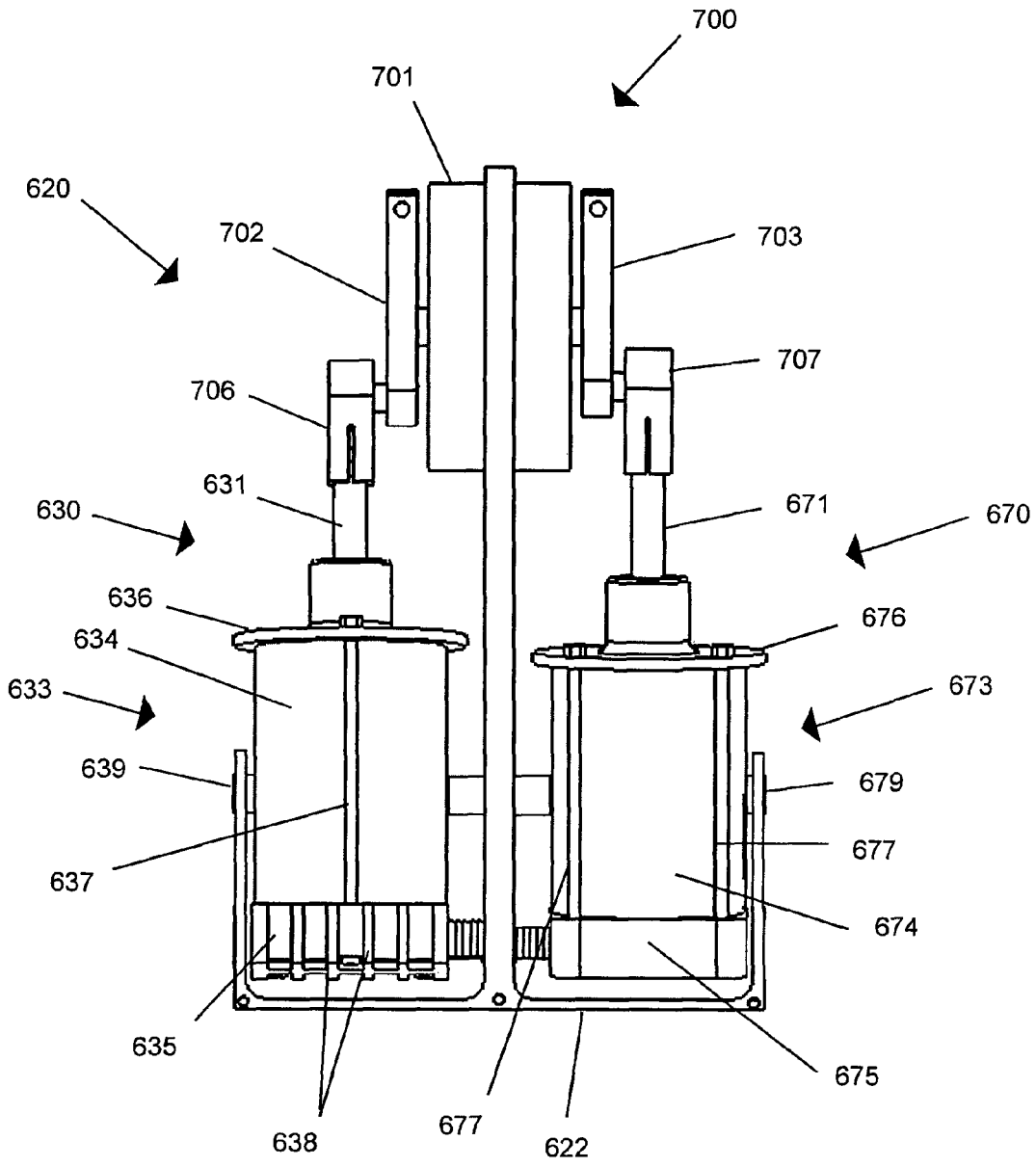
FIG. 25 is a side schematic view of an alternative embodiment of the compression apparatus of the present invention.

Referring to FIG. 25, in a first alternative exemplary embodiment, the compression apparatus 620 of the present invention generally includes first and second compressor piston-cylinder units 630, 670, both connected to a common drive mechanism 700 so as to shift the respective piston rods 631, 671 and pistons (not shown) up and down within the cylinders 633, 673 and thereby compress the air or other such compressible medium introduced into each cylinder 633, 673 employing the various means described in the incorporated references and further herein for the additional illustrative embodiments. The piston rods 631, 671 are shown as being attached at their free ends, or ends opposite the pistons operating within the cylinders 633, 673, to the drive mechanism 700, and the motor 701, specifically, on offset arms 702, 703 having bearings or the like (not shown) press fit within intake blocks 706, 707, as further shown and described in the incorporated references, for the purpose of introducing air or other fluid into at least the first cylinder 633 through the hollow piston rod 631 in the case of a multi-stage arrangement and also the second cylinder 673 through a hollow piston rod 671 in a case as in FIG. 25 where the two piston-cylinder units 630, 670 effectively operate independently while sharing a common drive mechanism 700. It will be appreciated by those skilled in the art that numerous other drive mechanisms and means for connecting the piston rods thereto are possible in the present invention without departing from its spirit and scope, such that the intake block and arm arrangement shown and described is to be understood as merely illustrative. For example, one or more pulleys as shown in FIGS. 1-8 or a flywheel as disclosed in various ones of the prior applications incorporated herein by reference and further shown in FIGS. 23 and 24, whether round or elliptical or of some other configuration, may be employed for inertial and dynamic loading effects in particular applications, with relatively larger motors and/or flywheels typically being employed in higher pressure applications where more leverage is needed on each compressive stroke and, simultaneously, the larger size helps reduce belt stretch and so further improves the overall efficiency of the compression apparatus.

With continued reference to FIG. 25, each piston-cylinder unit 630, 670 again includes a cylinder 633, 673 having a body 634, 674 mounted on a base 635, 675 at its lower end and having a cap 636, 676 at its upper end. While the cap 636, 676 is shown in FIG. 25 as being secured to the respective base 635, 675 by three tie rods 637, 677, it will be appreciated that both the base 635, 675 and cap 636, 676 can be secured to the cylinder body 634, 674 by any means now known or later developed in the art, including forming at least one of the base 635, 675 or cap 636, 676 integral with the cylinder body 634, 674, or by employing tie straps or other fasteners or fastening means now known or later developed. Each base 635, 675 may be formed with cooling fins 638 to aid in heat dissipation. Rather than the base 635, 675 being pivotally installed on the frame 622, as in alternative embodiments, in the exemplary embodiment of FIG. 25, studs 639, 679 pivotally installed from the frame 622 to the piston-cylinder units 630, 670 at some intermediate location between each base 635, 675 and the respective cap 636, 676 instead allow the compressor units 630, 670 to pivot at a location substantially closer to the center of gravity, thereby minimizing inertial effects and, thus, balancing requirements. Specifically, in the embodiment of FIG. 25, the studs 639, 679 may be rigidly mounted to or formed on the wall of the cylinder 634, 674 so as to extend substantially perpendicularly therefrom and then pass into a corresponding hole in the frame 622. As such, the frame 622 would then likely contain a bearing within which the journal portion of the respective studs 639, 679 rode. Or, in an alternative embodiment, tie straps (not shown) used to secure the bases 635, 675 and caps 636, 676 on the respective cylinder walls 634, 674 may also provide structure into which may be installed either the studs 639, 679 in a rigid arrangement with the bearings again being located within respective holes in the frame 622, or the studs 639, 679 may extend from the frame 622 and engage on their journal portions bearings press-fit or otherwise installed in corresponding holes in the tie straps. Or, bearings may be installed in both the frame 622 and the tie straps. In any event, while no particular size and arrangement of the studs 639, 679 and the respective bearing surfaces is required in the present invention, a general observation has been made that the larger the journals and bearings, the less vibratory or knocking noise generated in the compression apparatus 620 during operation. Again, those skilled in the art will appreciate that various combinations and configurations of journals and bearings for the purpose of pivoting the one or more piston-cylinder units of the compression apparatus are possible without departing from the spirit and scope of the invention.

Figure 26:
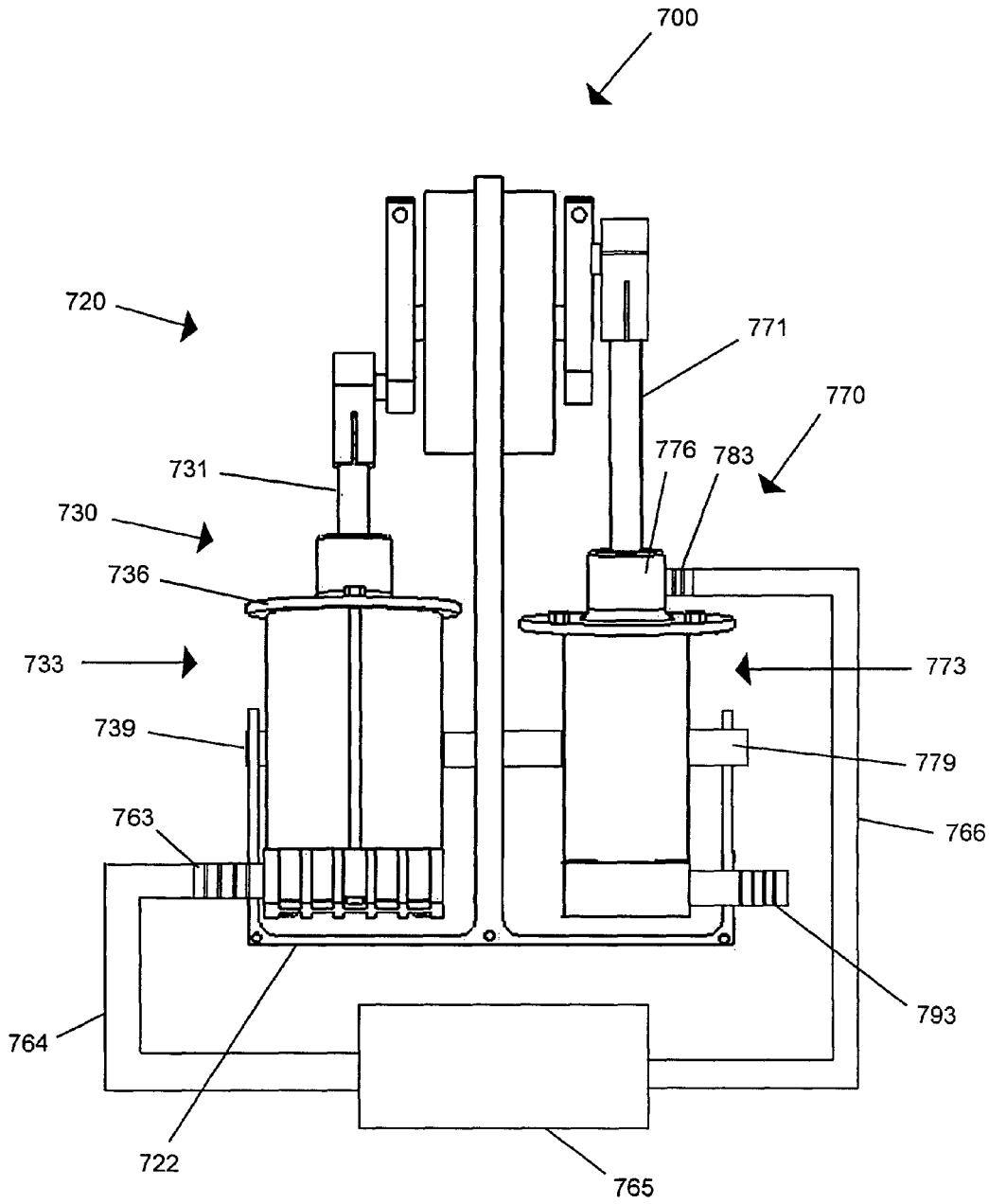
FIG. 26 is a side schematic view of a further alternative embodiment of the compression apparatus of the present invention.

Turning now to FIG. 26, in a further alternative exemplary embodiment, the compression apparatus 720 of the present invention again generally includes first and second compressor piston-cylinder units 730, 770, both connected to a common drive mechanism 700 so as to shift the respective piston rods 731, 771 and pistons (not shown) up and down within the cylinders 733, 773 and thereby compress the air or other such compressible medium introduced into each cylinder 733, 773 as above-described. Moreover, the first stage piston-cylinder unit 730 is generally as in FIG. 25, with air or other fluid being pulled into the cylinder 733 through the hollow piston rod 731. However, in the multi-stage embodiment of FIG. 26, the compressed fluid exits the first stage cylinder unit 730 through the exit valve 763 not to a holding tank or the like, but instead through a first line 764 to an intermediate surge tank 765 before then passing through a second line 766 and into the second stage piston-cylinder unit 770 through an inlet valve 783 formed in its upper cap 776. In more detail, it will be appreciated by those skilled in the art that the surge tank 765 essentially formed within the arrangement of lines 764, 766 connecting the first and second piston-cylinder units 730, 770 serves to effectively chase the compressed fluid forward within the system with a reserve volume of fluid so that the subsequent compression stage has fluid entering the cylinder above the piston at a pressure higher than ambient, thereby helping the piston on its down stroke or up stroke, as the case may be, and effectively pre-charging the cylinder for the compression stroke. Put another way, as explained above in connection with the first exemplary embodiment of the compression apparatus 100 during use, the pressure actually felt by the piston, and against which the piston must work, is only the difference between the pressure in the preceding compression stage and that of the current stage. For example, if in the first stage the compression unit 730 compresses fluid to a nominal pressure of 125 psi and in the second stage the compression unit 770 then compresses the fluid up to a nominal pressure of 250 psi, the pressure the second stage piston is actually seeing is roughly 125 psi, the difference between the pressure above the piston and the maximum pressure reached below the piston. Or, the range of pressures felt by the piston is 0 psi to 125 psi. By way of comparison, in a conventional compressor arrangement where fluid at 125 psi supplied from the preceding stage is simply injected into the next stage cylinder below the piston for further compression, while the total increase in pressure will again be 125 psi to get the fluid leaving the second stage up to 250 psi, the actual pressure felt by the piston, or against which the second stage piston must work, ranges from 125 psi to 250 psi at the end of its stroke. While the above example is merely for illustration and is grossly over-simplified, the point is made that it is more efficient to introduce compressed fluid into a subsequent stage cylinder above rather than below the piston, assuming the compressive work is to be done on the down stroke of a single-acting cylinder, or more generally on the side of the piston opposite the direction it is traveling at the time the preceding stage compressed fluid is introduced. An "internal breathing" piston arrangement as employed in the compression apparatus of the present invention facilitates such a fluid flow. And because the piston doesn't have to work as hard, neither does the drive mechanism, thereby resulting in further efficiency gains. It will be appreciated that the nominal pressures cited in the above example are not necessarily the pressures applied or existing above and below the piston throughout the stroke, but merely at one possible instant in the stroke, and so are given merely for illustration. Moreover, the above nominal pressures and discussion do not take into account any additional leverage advantages achieved due to surface area ratios above and below the piston, particularly where a relatively large diameter piston rod is employed to take advantage of such effects. Returning to the surge tank 765, by providing an intermediate storage of charged or compressed fluid from the preceding stage, the system cannot back up and such a supply of compressed fluid is practically continuously available to the subsequent compression stage for pre-charging, even on start-up. It will be further appreciated, then, that the use of the intermediate surge tank 765 encourages and improves the efficiency of subsequent compression stages while also aiding with heat dissipation by simply providing further surface area for heat exchange with the environment. However, those skilled in the art will also appreciate that the same benefits can be achieved through other constructions consistent with the principles of the present invention, such as simply forming a sufficiently large reaction chamber at the exit of any piston-cylinder unit in which chamber the compressed fluid may gather and remain pre-charged for subsequent stages of compression. As in FIG. 25, studs 739, 779 are pivotally installed from the frame 722 to the piston-cylinder units 730, 770 at some intermediate location along each to allow the units 730, 770 to pivot at a location substantially closer to the center of gravity. This effect further improves the efficiency of the compression apparatus while assisting with balancing concerns. Relatedly, again, though the piston-cylinder units 730, 770 may be anywhere from zero to one-hundred-eighty degrees (0-180°) out of phase, as shown in FIG. 26, in the exemplary embodiment of the multi-stage arrangement, the single-acting piston-cylinder units are approximately one-hundred-eighty degrees (180°) out of phase to further improve operation by having each unit essentially reach its peak compression or peak work substantially opposite the other. The compressed fluid exiting the second stage piston-cylinder unit 770 through the exit valve 793 may then pass to further compression stages (not shown) or to a storage tank (not shown). While a particular multi-stage compression apparatus has been shown and described involving two single-acting piston-cylinder units, those skilled in the art will appreciate that numerous other configurations and combinations of features are possible without departing from the spirit and scope of the invention. Specifically, virtually any number of stages may be employed in parallel or in series, with each piston-cylinder unit within any such arrangement being either single- or double-acting, to achieve particular pressure and flow rate requirements for a certain application.

Referring now to FIGS. 27-47, there is shown in a variety of views an improved combination compressor and vacuum pump apparatus and method of use that builds on the disclosures of the preceding exemplary embodiments and the prior patent applications incorporated herein by reference. Thus, while the further exemplary embodiments shown and described below are focused on a particular design of a compressor piston-cylinder arrangement and a vacuum pump piston-cylinder arrangement and of a corresponding motor and drive mechanism and other such features, all in the particular context of delivering the air requirements for a portable oxygen concentrator as is used in the health care industry, it will be appreciated by those skilled in the art that the present invention is applicable to or may work in conjunction with any such compression or vacuum system that involves or employs a compressible fluid or medium, whether gas or liquid and gas, and that includes a power source to drive the drive mechanism and further includes other peripheral valves, fixtures and the like not pertinent to the present disclosure, any such apparatus being scalable to suit a variety of applications.

Figure 27:
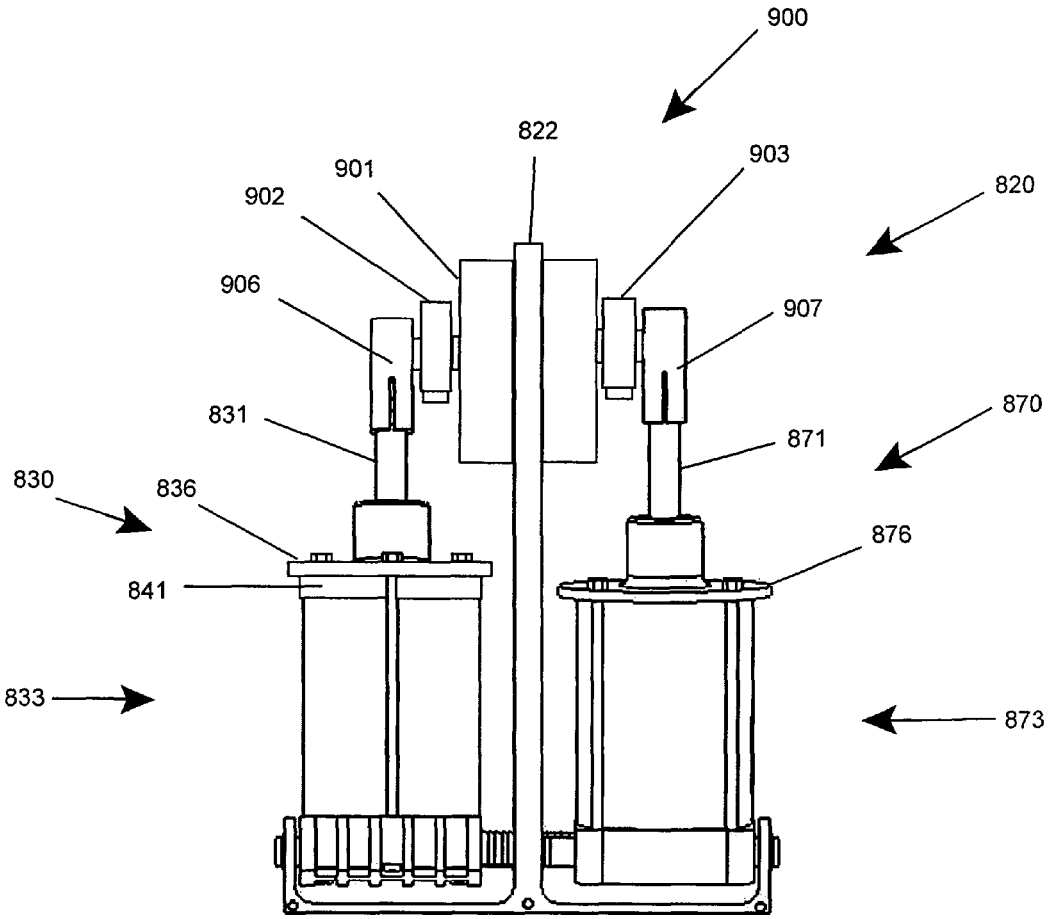
FIG. 27 is a front schematic view of a further alternative embodiment of the compression apparatus of the present invention.

Turning first to FIG. 27, the combination compressor and vacuum pump apparatus 820 according to additional aspects of the present invention shown and described herein in an exemplary embodiment generally includes a compressor piston-cylinder unit 830 and a vacuum pump piston-cylinder unit 870, both connected to a common drive mechanism 900 so as to shift the respective hollow first and second piston rods 831, 871 and first and second pistons 832, 872 (FIGS. 36 and 43) up and down within the respective first and second cylinders 833, 873 and thereby compress the air or other such compressible medium introduced into the cylinder, or pull such medium through the cylinder in the case of the vacuum pump, employing the various means described above and in the incorporated references and further below in the illustrative embodiment. The first and second piston rods 831, 871 are shown as being attached at their respective first and second free ends, or ends opposite the pistons 832, 872, to the drive mechanism 900 on offset arms 902, 903 having bearings 904, 905 (FIGS. 28 and 29) or the like press fit within intake blocks 906, 907, best shown in the enlarged perspective view of FIG. 30 for the compressor unit 830, as further shown and described in the incorporated references, for the purpose of introducing air or other fluid into the cylinder 833 through the hollow piston rod 831 in the case of the compressor unit 830, or in the case of the vacuum pump unit 870, exhausting air or other fluid from the cylinder 873 through the hollow piston rod 871, more about which is said below.

Figure 28:
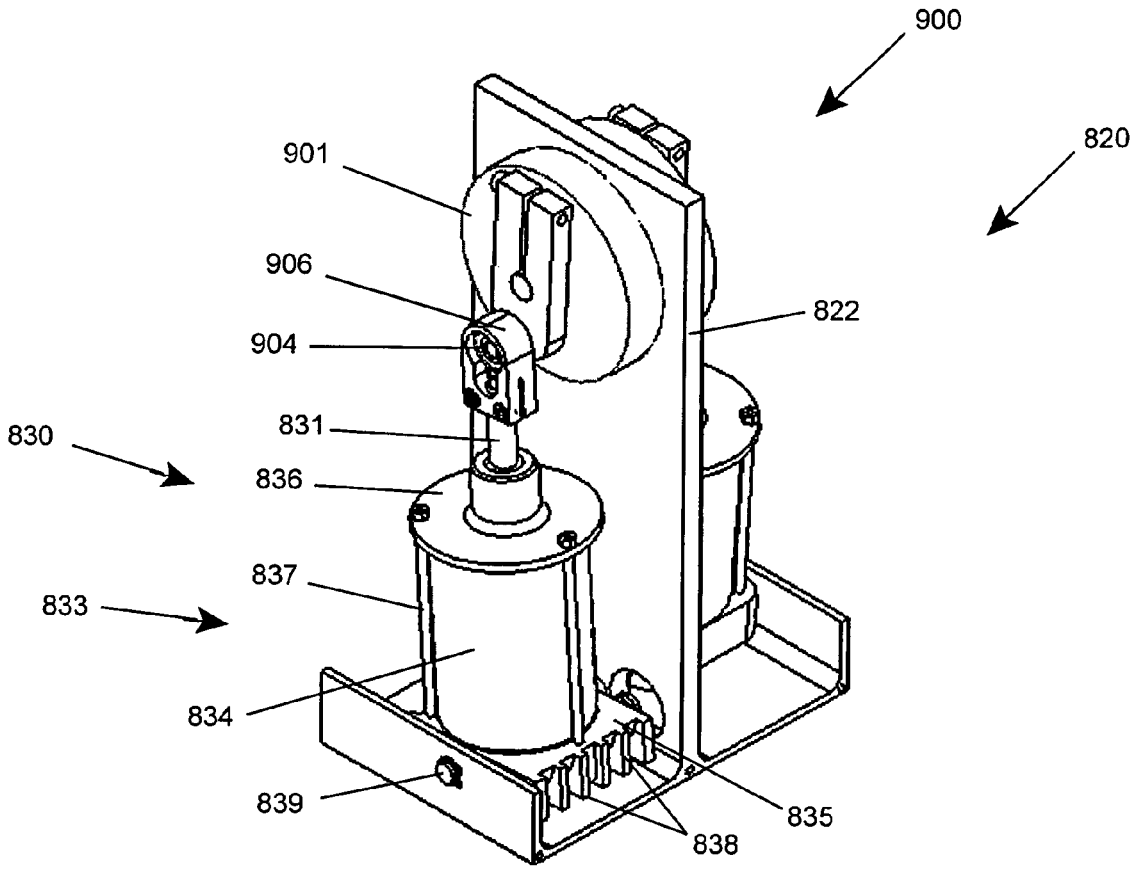
FIG. 28 is a left perspective view thereof.

Turning now to FIG. 28, more specifically, there is shown a left perspective view of the combination compressor and vacuum pump apparatus 820 on which the compressor unit 830 is pivotally installed. Specifically, the compressor unit 830 includes a cylinder 833 having a body 834 mounted on a pivoting base 835 at its lower end and having a cap 836 at its upper end. While the cap 836 is shown as being secured to the base 835 by three tie rods 837, it will be appreciated that both the base 835 and cap 836 can be secured to the cylinder body 834 by any means now known or later developed in the art, including forming at least one of the base 835 or cap 836 integral with the cylinder body 834. As shown, the base 835 may be formed with cooling fins 838 to aid in heat dissipation. The base 835 may be pivotally installed on the frame 822 via one or more pins 839.

Figure 29:
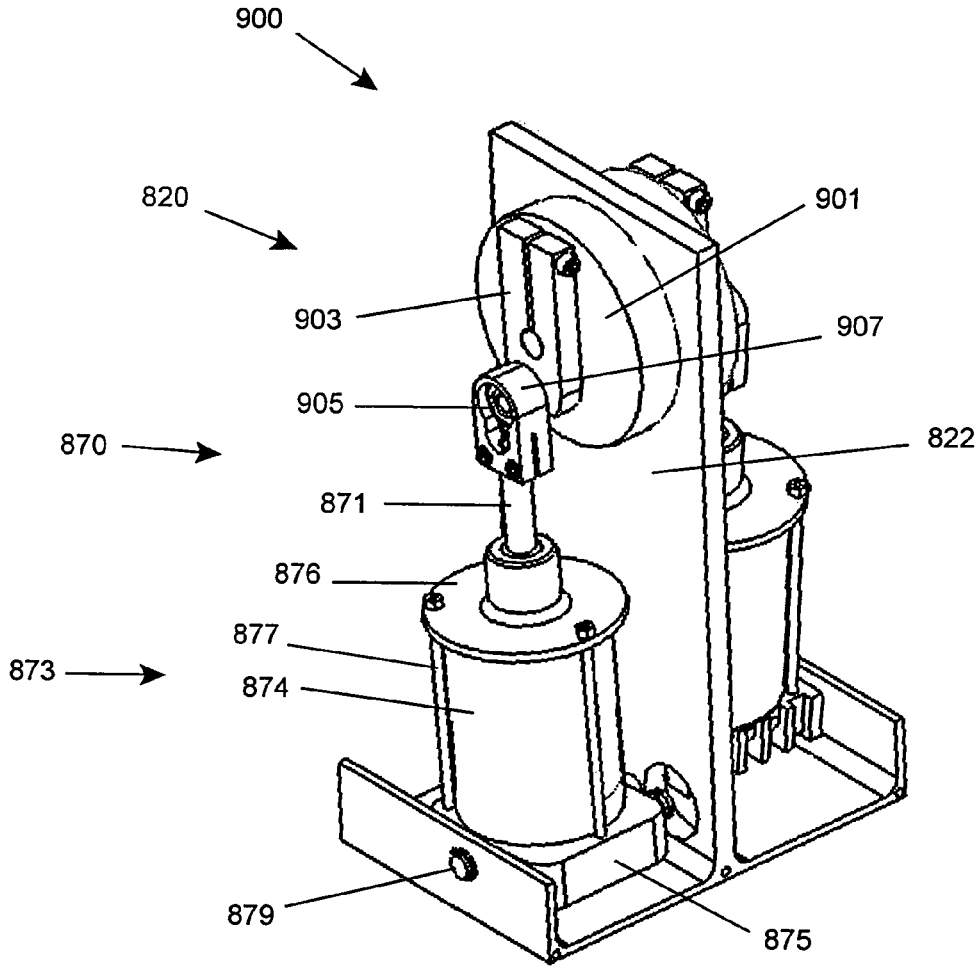
FIG. 29 is a right perspective view thereof.

Turning to FIG. 29, there is shown a right perspective view of the combination compressor and vacuum pump apparatus 820 on which the vacuum pump unit 870 is pivotally installed. Specifically, the vacuum pump unit 870 includes a cylinder 873 having a body 874 mounted on a pivoting base 875 at its lower end and having a cap 876 at its upper end. While the cap 876 is again shown as being secured to the base 875 by three tie rods 877, it will be appreciated that both the base 875 and cap 876 can be secured to the cylinder body 874 by any means now known or later developed in the art, including forming at least one of the base 875 or cap 876 integral with the cylinder body 874. The base 875 may be pivotally installed on the frame 822 via one or more pins 879. More generally, it will be appreciated that various arrangements of the cylinders 830, 870 beyond that shown and described are possible in the present invention without departing from its spirit and scope.

As seen in both FIGS. 28 and 29, a brushless DC motor 901 is installed in a direct drive arrangement within the frame 822 so as to simultaneously drive both the compressor 830 and the vacuum pump 870. The motor may be custom designed/wound to run most efficiently at 1,000 rpm or less. A microprocessor control (not shown) can generally react dynamically at speeds of under 1,000 rpm so as to control the speed and torque of the motor 901 during various phases of relative work within the rotational cycle. While a particular drive arrangement and motor is shown and described, it will be appreciated by those skilled in the art that numerous other configurations are possible without departing from the spirit and scope of the invention, depending, in part, on motor selection. For example, the apparatus could employ indirect drive for gearing the motor, as through a belt and pulley or other kinematic arrangement.

Figure 30:
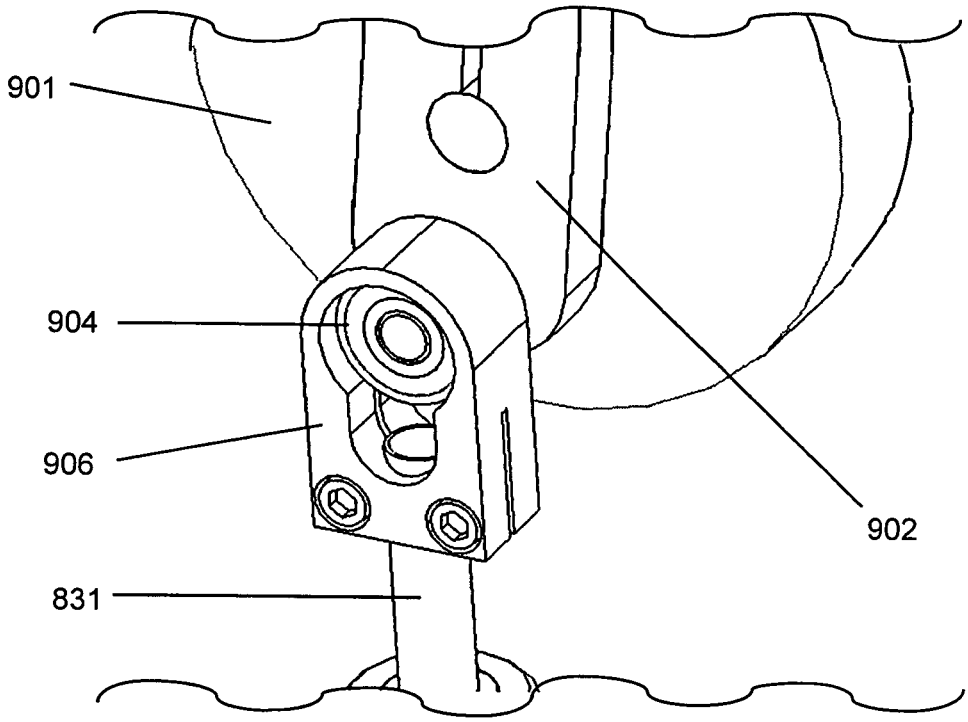
FIG. 30 is an enlarged partial perspective view thereof.

Once again, FIG. 30 is an enlarged partial perspective view of the compressor unit 830 of the combination apparatus 820 showing the details of the piston rod 831 attached at its free upper end to the motor 901 on an offset arm 902 having a bearing 904 or the like press fit within the intake block 906.

Figure 31:
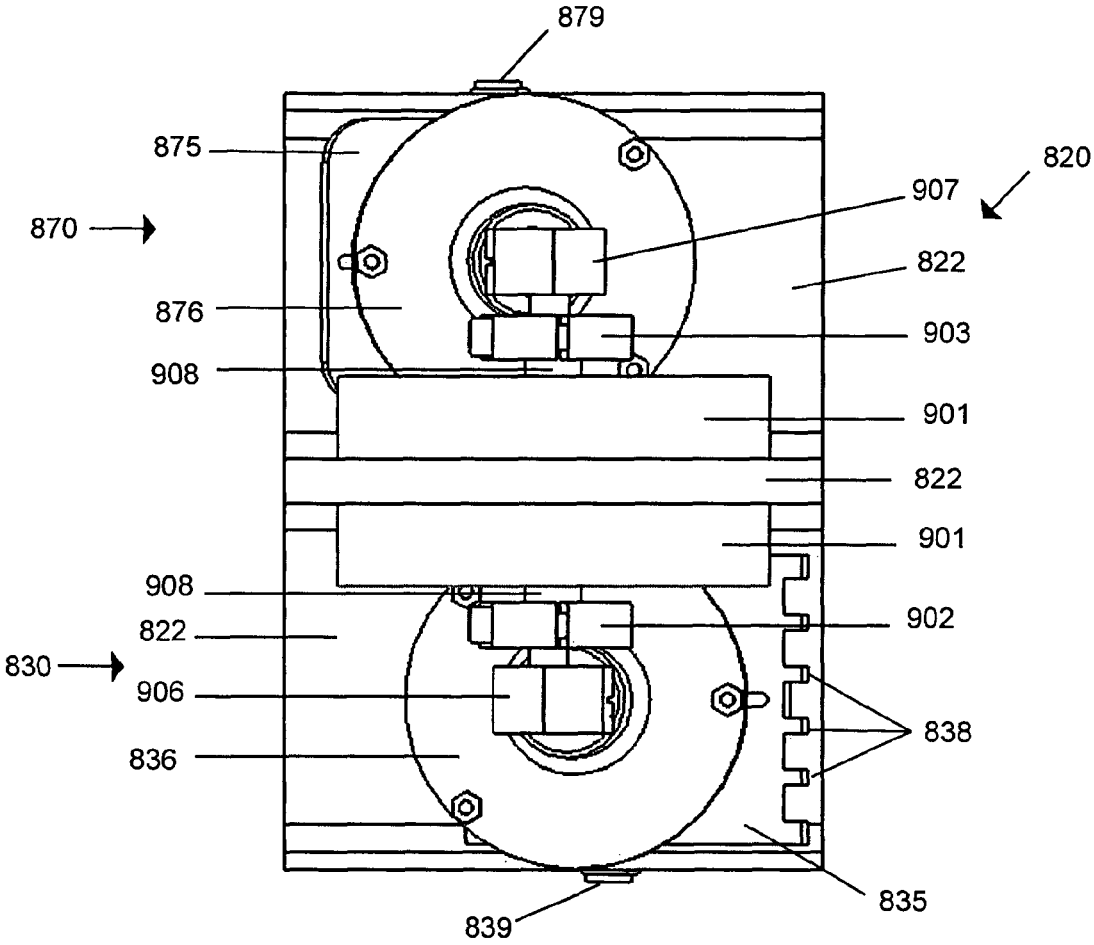
FIG. 31 is a top view thereof.
Figure 32:
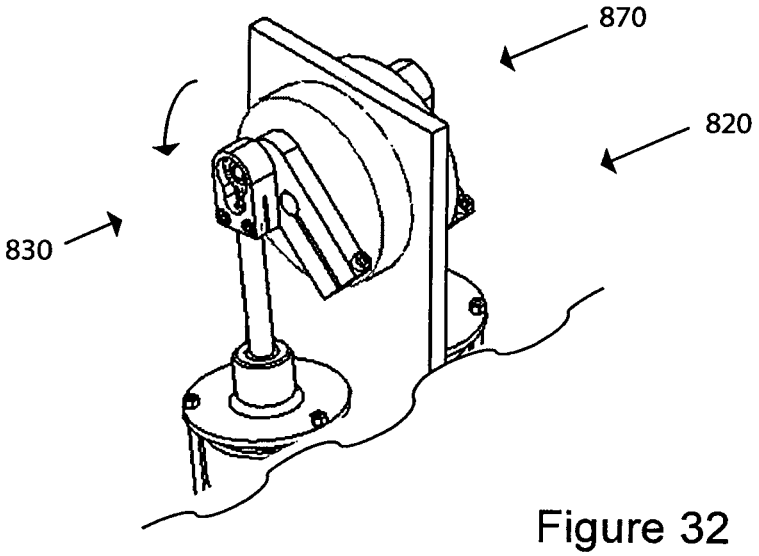
FIG. 32 is an enlarged partial perspective schematic view thereof.
Figure 33:
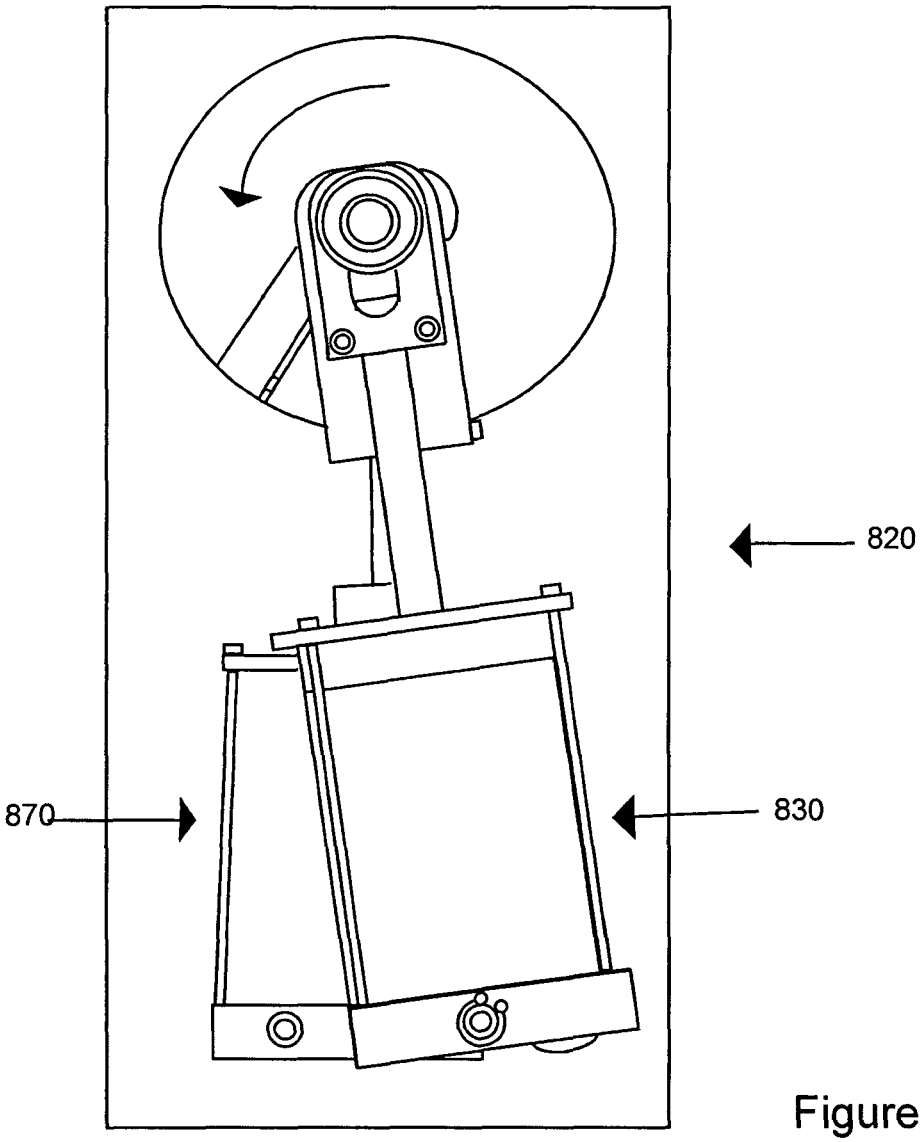
FIG. 33 is a left side schematic view thereof in a first phase of operation.
Figure 34:
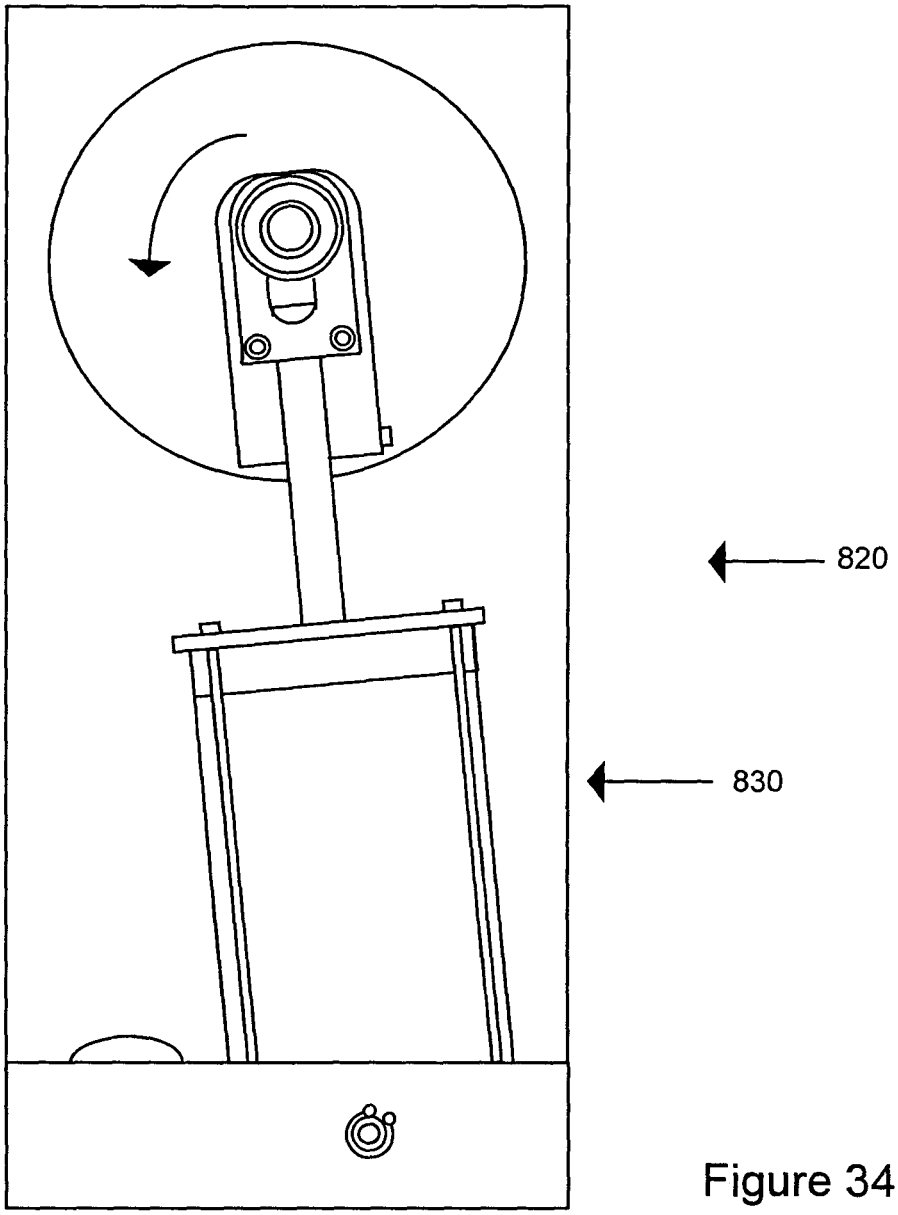
FIG. 34 is a left side view thereof in the first phase of operation.
Figure 35:
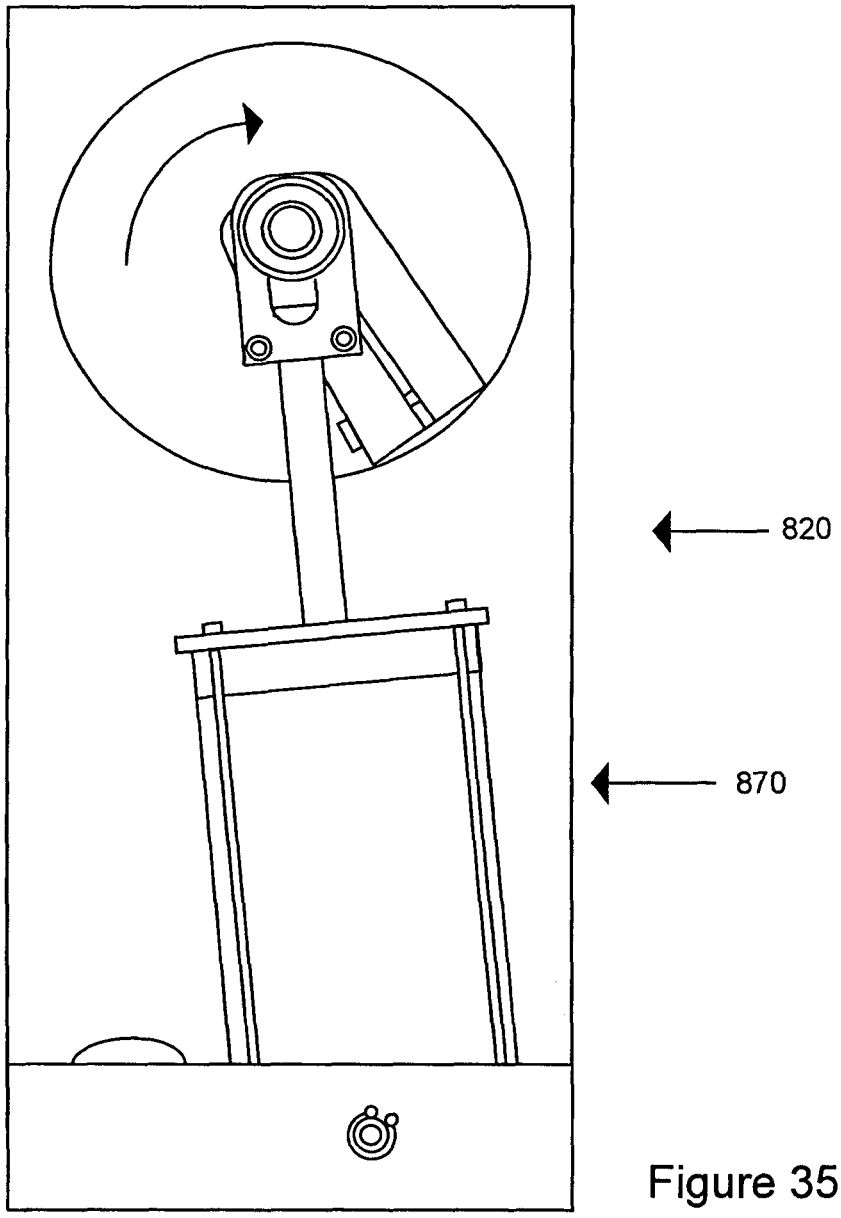
FIG. 35 is a right side view thereof in the first phase of operation.

Turning next to FIG. 31, there is shown a top view of the of the combination compressor and vacuum pump apparatus 820 of the present invention showing the compressor unit 830 and the vacuum pump unit 870 in their side-by-side configuration. As best seen in this view, the units are each operably connected to the motor 901 via their respective offset arms 902, 903 mounted on a common drive shaft 908 of the motor 901. As then shown in FIGS. 32 and 33, in the exemplary embodiment, the arms 902, 903 are mounted on the drive shaft 908 so as to be radially offset with respect to each other such that the vacuum pump 870 lags the compressor 830 by approximately thirty degrees (30°). As will be appreciated, the offset is achieved not only by the angular positions of the respective arms 902, 903 but also by the off-axis orientation of the respective pivot pins 839, 879. It will be appreciated by those skilled in the art that the offset of the compressor and vacuum pump units 830, 870 is merely exemplary and can vary depending on the relative sizes and configurations of the cylinders, the performance requirements for the overall apparatus and other such factors. Specifically, the compressor unit 830 and vacuum pump unit 870 may be 100% in phase (0° out of phase), may be 180° out of phase, or anything in between. In FIGS. 32 and 33, arrows are shown on the motor 901 to indicate the direction of rotation of the motor 901, which in the exemplary embodiment is counter-clockwise as looking at the compressor 830, or the left side of the apparatus 820, and clockwise as looking at the vacuum pump 870, or the right side of the apparatus 820, whereby, again, the vacuum pump 870 follows the compressor 830 through the cycle. For example, when the vacuum pump 870 is roughly at its top-dead-center position as shown in FIG. 32, the compressor 830 has already rotated roughly 30° further counter-clockwise from its top-dead-center position, and so on. The same can be seen with reference to the respective left and right side views in FIGS. 34 and 35 of the combination compressor and vacuum pump apparatus 820 at the same phase positions as shown in FIGS. 32 and 33.

Figure 36:
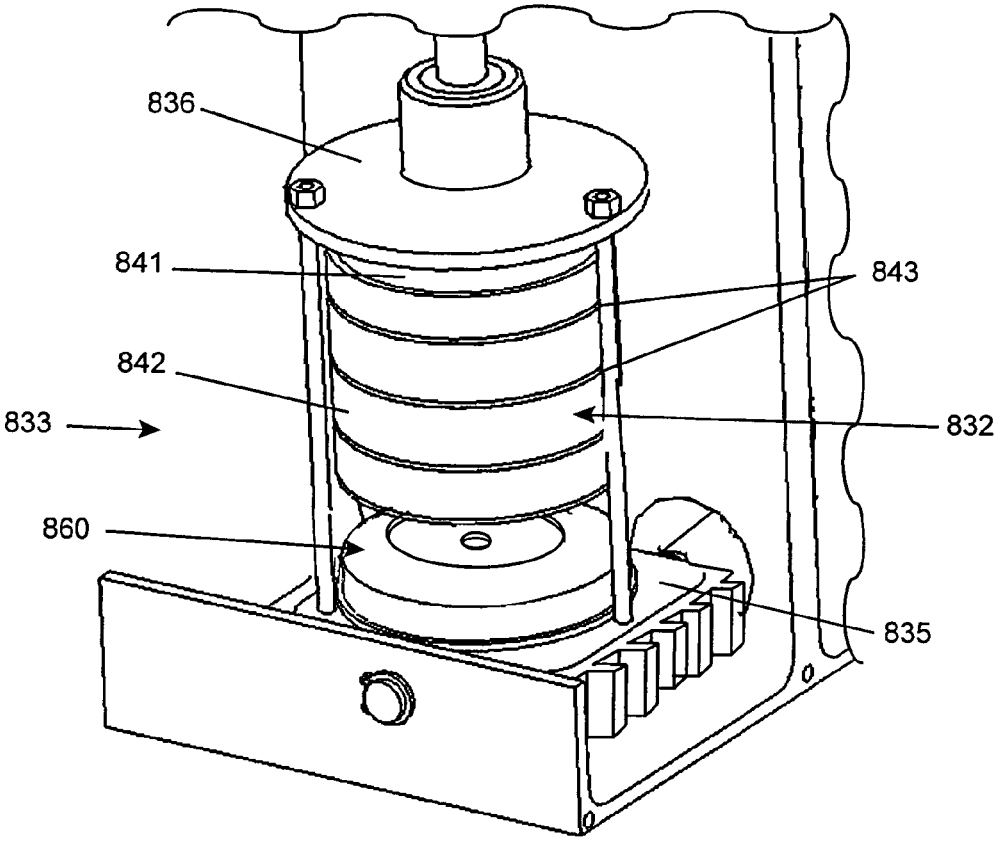
FIG. 36 is an enlarged partial left perspective view thereof, partially cut-away.

With respect to the piston-cylinder units, here in the further alternative exemplary embodiment of the combination compressor and vacuum pump apparatus 820, still further aspects of the present invention relate to various configurations of the piston and its installation on the end of the piston rod so as to be operable within the cylinder. Referring now to FIG. 36 there is shown an enlarged partial perspective view of the cylinder 833 of the compressor unit 830 with the cylinder body 834 removed for ease of viewing the interior piston 832. The piston 832 is configured as an "air gap" piston having an annular piston wall or body 842 formed with circumferential, spaced-apart grooves 843 thereabout rather than separate piston rings or o-rings. In the exemplary embodiment, the piston 832 is on the order of two inches (2 in) long with three to four grooves 843 spaced approximately one quarter inch to one half inch (¼ in to ½ in) apart along the piston body 842, though any number and spacing of grooves is possible depending on the application. The piston body 842 itself may again be constructed of a material such as graphite or aluminum alloy with little to no coefficient of expansion. In such an "air gap" piston arrangement, the clearance between the outside wall of the piston body 842 and the inside wall of the cylinder (not shown) is approximately half a thousandth of an inch plus or minus half a thousandth (0.0005 in+/−0.0005 in), again, depending on the application, and particularly, the pressure, positive or negative, that the piston will see. For the compressor unit 830, specifically, it will be appreciated that because most of the work is being done as the piston 832 approaches its bottom-dead-center position, or the end of its down stroke, wherein virtually the entire length of the piston body 842 will be called upon to effectuate a surface-to-surface seal with the inside wall of the cylinder body 834, it is not so when the piston 832 is doing the relatively easy work of gathering air or other fluid on its upstroke. As such, while the above clearance of approximately 0.0005 in+/−0.0005 in is preferable for at least that portion of the stroke near to the bottom of the down stroke, or the phase of operation of maximum compression, at the upper end of the cylinder, or nearer to the end of the piston's upstroke, a greater clearance between the piston body 842 and either the inside surface of the cylinder wall or the inside surface of the upper cap 836 may be employed without compromising the operation or performance of the compressor unit 830 and actually furthering the life of the unit by reducing the work and wear of the moving parts where not necessary. This increased clearance at the top end of the compressor cylinder 833 may be achieved in a number of ways, including but not limited to an enlarged or stepped bore within the cylinder body 834 at its upper end or a relatively constant diameter cylinder body 834 having a relatively shorter overall length, with the additional distance or total length of the cylinder 833 being taken up by a relatively longer downwardly extending skirt 841 on the upper cap 836, which skirt 841 could thus have an inside diameter that is slightly larger than that of the cylinder body 834. In the exemplary embodiment of the compressor unit 830, the nominal stroke for the piston 832 is one inch (1 in) and the nominal diameter of the cylinder body 834 is two inches (2 in). Even so, because the cylinder body 834 is constructed of cast iron, chromolly steel, aluminum alloy, or other such material and the cap 835 is constructed of relatively lighter weight Delrin or certain other aluminum or magnesium alloys or other such material, increasing the size of the cap 835 relative to the cylinder body 834 may potentially reduce the weight at the upper end of the cylinder 833 and thus minimize vibration. Those skilled in the art will once more appreciate that a virtually infinite number of cylinder stroke lengths and diameters may be specified within a combination compressor and vacuum pump apparatus according to the present invention without departing from its spirit and scope. With continued reference to FIG. 36, at the lower end of the compressor cylinder 833 mounted on or integral with the base 835 is an annular exit valve assembly 860 that selectively allows for the escape or exit of compressed air from the lower chamber of the compressor cylinder 833 during use, more about which is said below in connection with FIGS. 40 and 41. Once more, o-rings may be employed to effectuate air-tight seals between any mating surfaces, such as between the exit valve assembly 860 and the lower end of the compressor cylinder body 834, such o-rings being typically formed of a urethane or EPDM (ethylene propylene) material. The bottom valve assembly 860 and cylinder base 835 may be formed of an aluminum or magnesium for improved heat dissipation, with or without the cooling fins 838. Briefly, in FIG. 37 there is shown a similar view to that of FIG. 36, now with the piston body 842 also removed to better view the piston base 844 including an upwardly extending collar 845 for stabilizing the piston 832 on the piston rod 831 and further including one or more through-holes 846 for selectively communicating between the hollow space within the piston 832 above the piston base 844 and bounded by the piston body 834, or effectively the upper chamber of the cylinder 830, and the opposite lower chamber in which the compression takes place.

Figure 38:
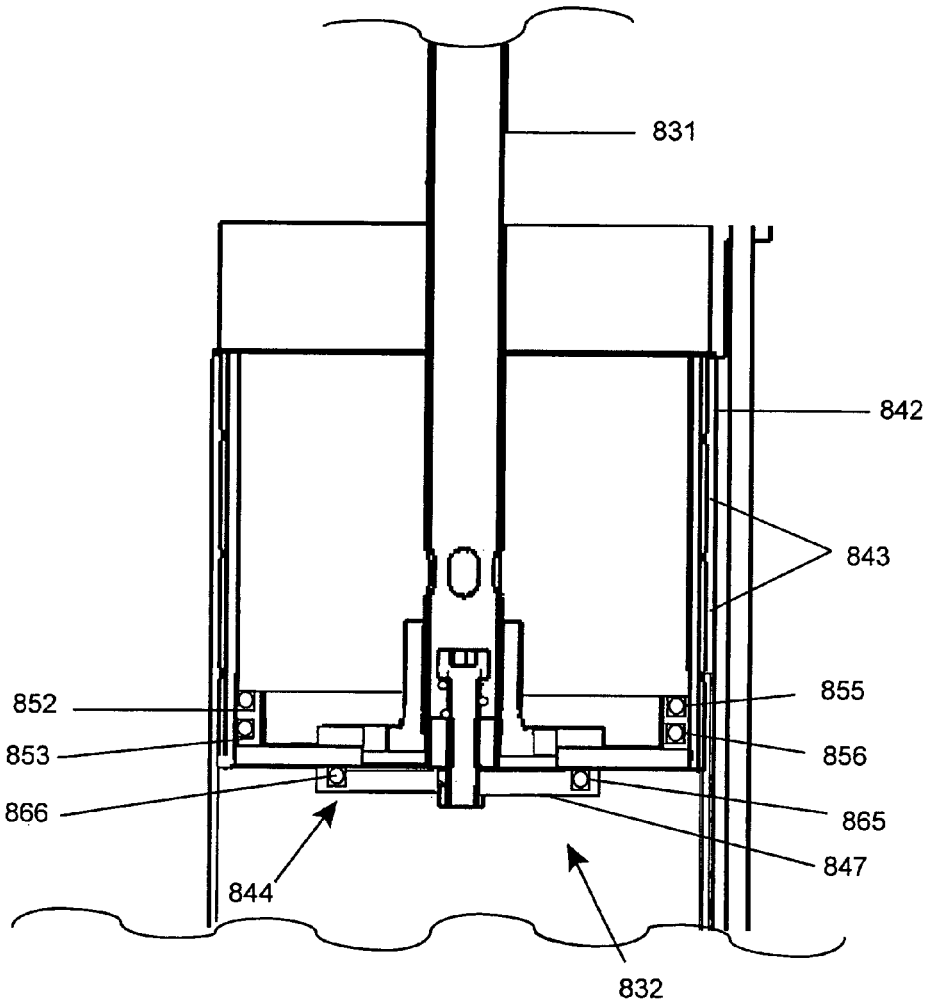
FIG. 38 is an enlarged partial schematic view of an exemplary piston-cylinder unit thereof.
Figure 39:
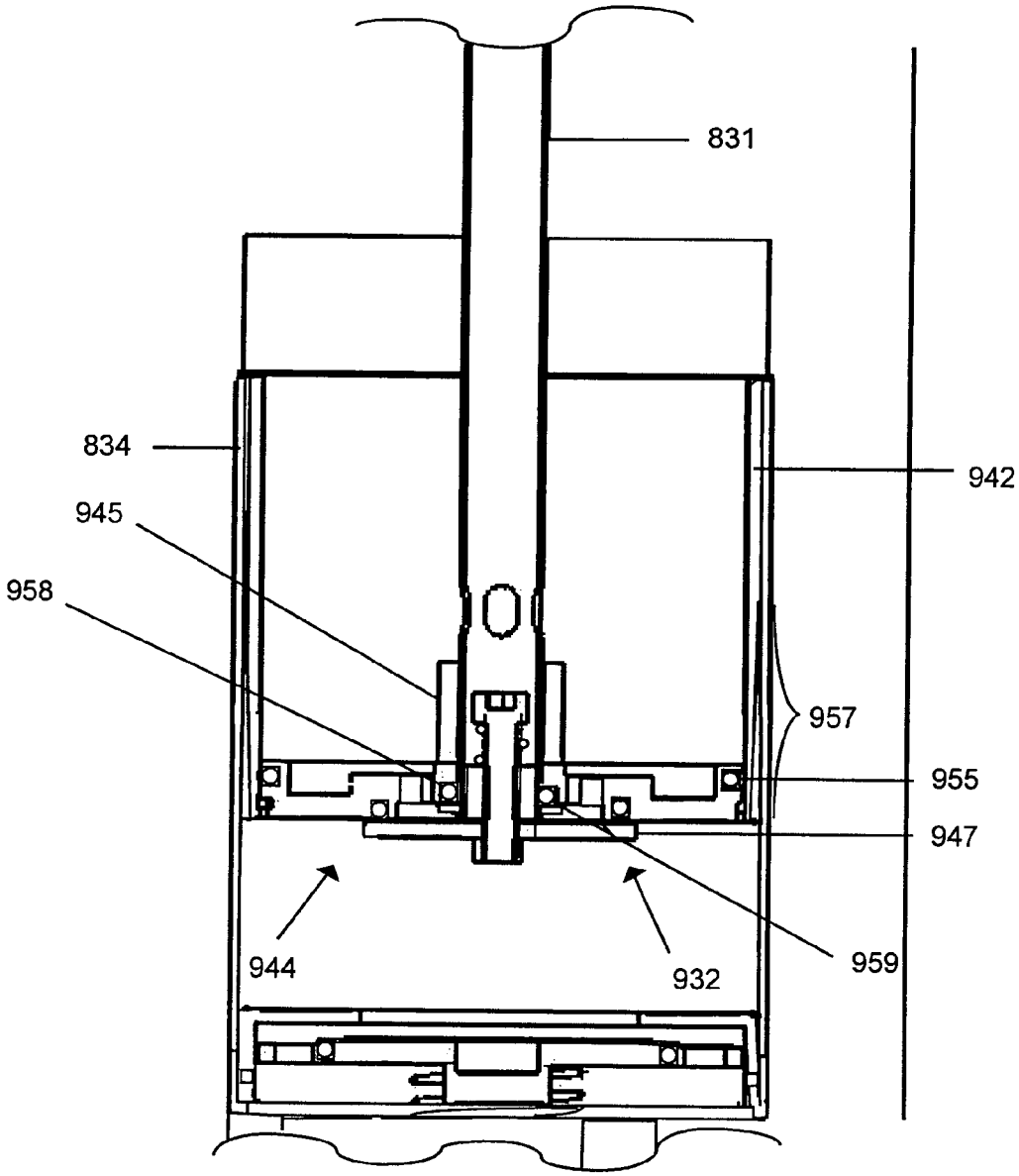
FIG. 39 is an enlarged partial schematic view of an alternative exemplary piston-cylinder unit thereof.

Referring now to FIGS. 38 and 39, there are shown two enlarged partial schematic views of exemplary piston-cylinder arrangements according to still further aspects of the present invention. While a compression configuration and a hollow piston rod 831 typically employed in a first stage or single-stage set-up as for the compressor unit 830 in FIG. 27 is shown, the "internal breathing" piston 832 with various valve arrangements may be employed within any compression or vacuum stage, whether pulling ambient air in through the hollow piston rod, receiving pre-charged air from a preceding compression or vacuum stage through a valve in the cylinder's cap, or pushing air out through the hollow piston rod. First, in FIG. 38, there is shown a relatively long piston skirt 842 installed on the piston base sub-assembly 844 to form the piston assembly 832. Specifically, two offset, substantially parallel o-rings 855, 856 seated within channels 852, 853 in the outer wall of the piston base 844 are employed to secure the piston body 842 on the base 844 in a "rooted" or "resilient mounting" fashion to further prevent any side-load during operation of the piston within the cylinder and thereby encourage centering and even wear. Moreover, the rooted installation of the piston body 842 on the base 844 serves to insulate in a resilient manner the graphite piston body 842 from touching the piston base 844 during movement, preventing or minimizing mechanical failures brought on by a rigid installation or through the varying thermal expansions of the dissimilar materials of the two components. It is contemplated that the upper o-ring 855 would position for radial loading, while the lower o-ring 856 would position for axial loading, though it will be appreciated that this is not necessary and that the sizes and materials of the o-rings and the sizes and shapes of the corresponding channels will dictate, at least in part, the function of each o-ring. It will be further appreciated that while two o-rings are shown and described, other numbers of o-rings may be employed without departing from the spirit and scope of the present invention. In the exemplary embodiment, the piston 832 is again configured as an "air gap" piston wherein the annular piston body 842 is formed with circumferential, spaced-apart grooves 843 therealong rather than separate piston rings or o-rings, though it will be appreciated that any combination of such sealing means may be employed depending on the application, even including a relatively shorter skirt or shorter length piston body not having grooves, but instead perhaps having a relatively thicker wall.

Turning to FIG. 39, there is shown an alternative embodiment of the piston skirt 942 of the piston 932 wherein at least a portion 957 of the skirt 942 is tapered. By tapering the skirt 942 from its upper end or some intermediate point along the skirt 942, as shown, to the skirt's lower end, or the working end of the piston, less wall-to-wall contact between the skirt 942 and the inside surface of the cylinder body 834 is achieved when less sealing is needed, as in the air-gathering and initial compression portions of the stroke. It will be appreciated that then as the pressure builds in the lower chamber when the piston 932 is on its down stroke there will be a slight outward pressure on the base of the piston skirt 942 as exerted by the additional force on the piston base 944, which force translates to at least radial force on the at least one o-ring 955, thereby forcing the skirt slightly outwardly and bringing even the tapered portion 957 of the skirt into more substantial contact with the cylinder wall 834. Depending on the application, and thus the pressure and forces to be seen by the piston and the materials and construction of the piston components, and hence the flex and expansion properties of these components, it will be appreciated that the taper on the outer wall of the piston skirt 942 may be optimized to achieve the necessary sealing as the pressure builds while minimizing, or not unnecessarily incurring, surface contact or forces between the piston and cylinder. It will be further appreciated that such tapers, while potentially of any configuration and angle, will in most applications likely be on the order of five thousandths of an inch (0.005 in) or less and, as such, that the taper shown in FIG. 39 is exaggerated merely for illustration. As shown in FIGS. 38 and 39, the exemplary floating disk valve 847, 947 may be solid with the sealing o-ring seated opposite the disk valve 947 within the piston base 944 (FIGS. 39-41), or in an alternative embodiment the o-ring 866 may be seated within a corresponding groove 865 or channel formed in the surface of the disk valve 847 itself (FIG. 38). These and other configurations of the valve are possible without departing from the spirit and scope of the invention, such as a simple urethane disk in place of the disk valve with o-ring as shown and described above in connection with FIGS. 9-16.

Figure 40:
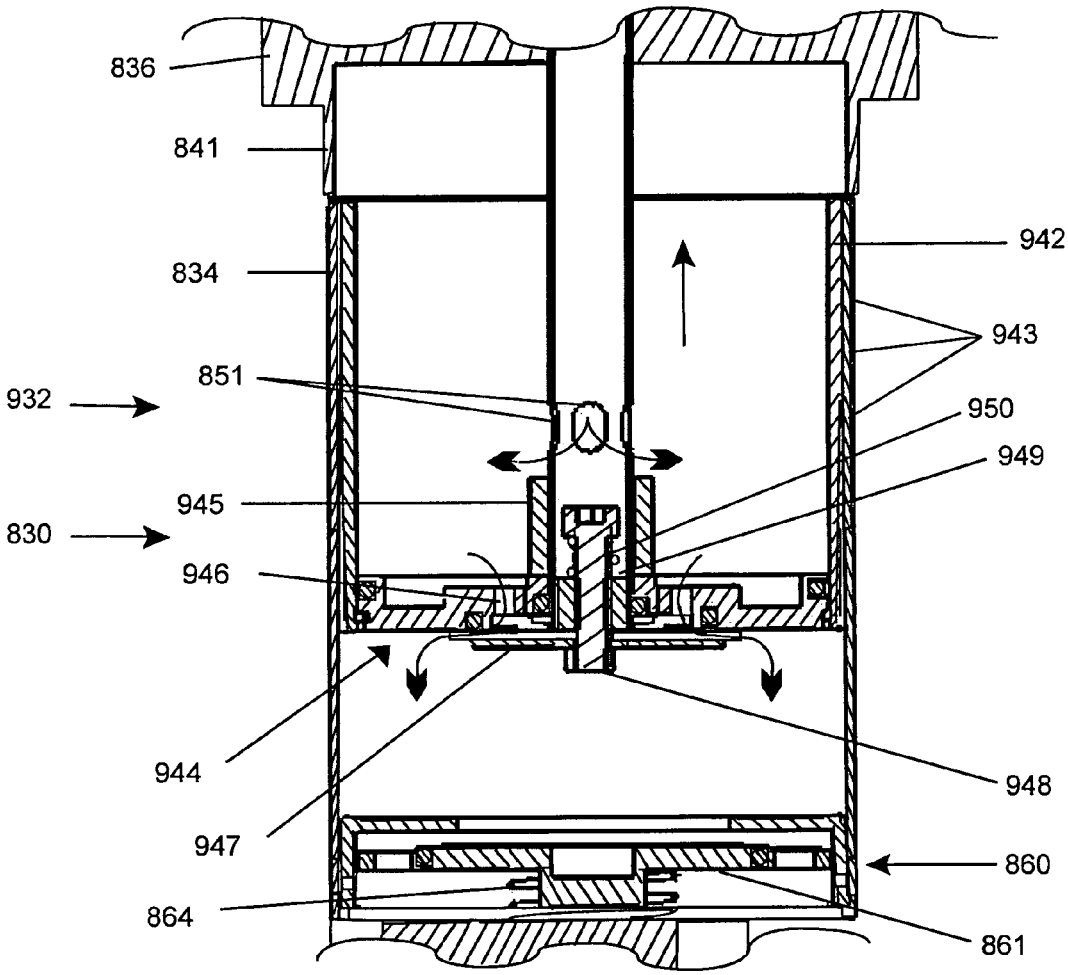
FIG. 40 is an enlarged partial cross-sectional view of a further alternative exemplary piston-cylinder unit thereof on its upstroke.
Figure 41:
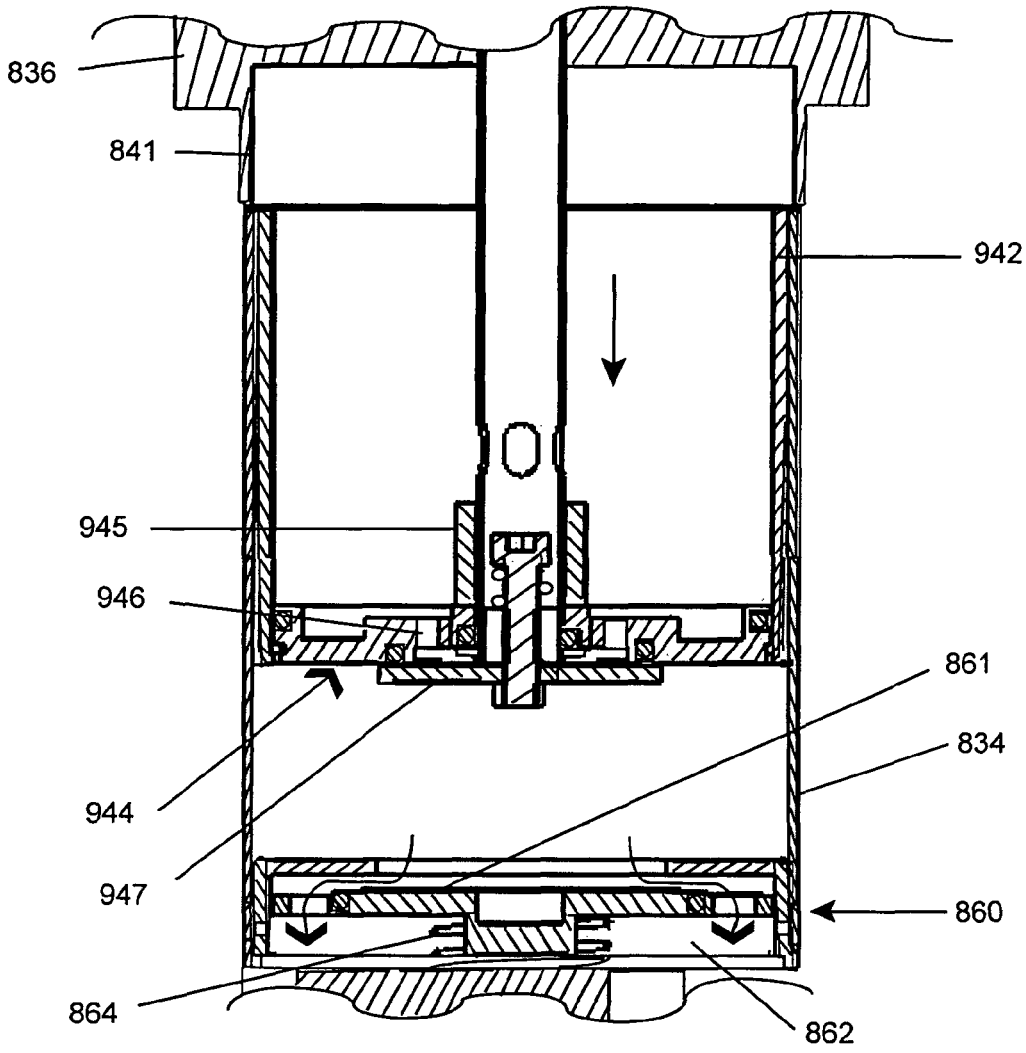
FIG. 41 is a partial cross-sectional view of the alternative exemplary piston-cylinder unit thereof shown in FIG. 40 now on its down stroke.
Figure 42:
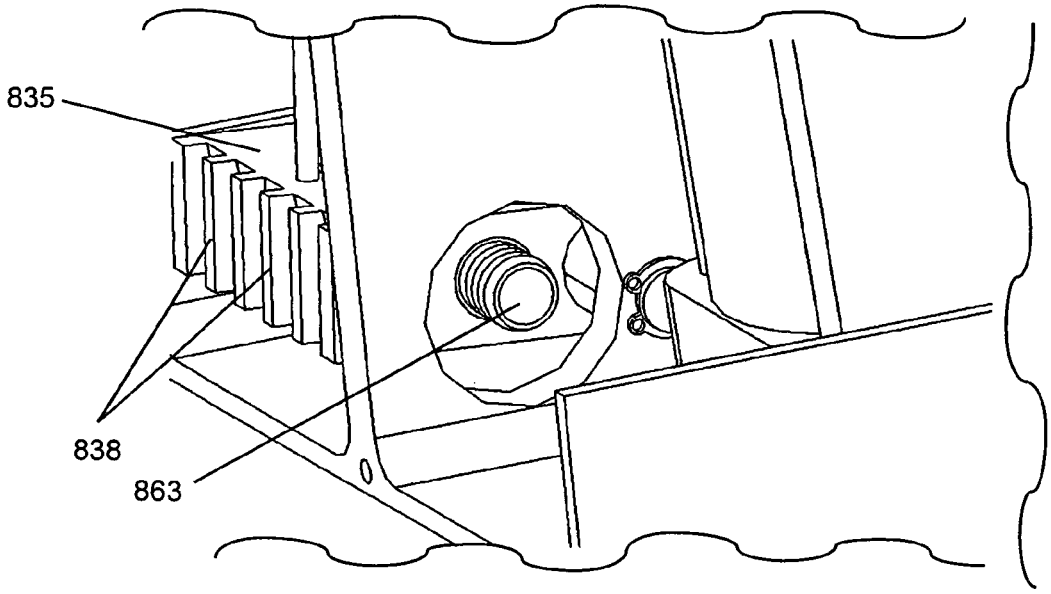
FIG. 42 is an enlarged partial right perspective view thereof.

Turning now to FIG. 40, there is shown a cross-sectional view of the compressor cylinder 830 wherein the piston 932 is on its upstroke. In this phase of the stroke, the piston valve 947 is pulled open by the pressure differential in the lower chamber as the piston 932 starts up, and to a lesser degree also by inertial and/or gravitational effects on the valve 947. The valve 947 opens against a biasing spring 950 positioned between the upper end of a mounting bolt or pin 948 passed through a plug 949 in the lower end of the piston rod 831. It will be appreciated that this and other such biasing springs employed in the present invention to selectively close various piston and inlet or exit valves also address valve float issues, which may be more or less prevalent depending on the speed of the motor and whether direct drive is employed, and hence depending on the dynamic movement of the piston itself, and the operation of the apparatus in orientations other than upright, such that gravitational effects not only are not to be relied upon for the successful operation of the valves, but are addressed when they actually would tend to work against proper valve operation. As such, air passing down the hollow bore of the piston rod 831 exits through one or more cross-holes 851 formed in the rod 831 above the collar 945 and, after being pre-compressed in the upper chamber as the piston moves upward, passes through the one or more through-holes 946 formed in the piston base 944 and around the open piston valve 947 into the lower chamber, which is closed at the bottom by the exit valve 861, biased so by a spring 864. Then, as shown in FIG. 41, when the piston 932 starts on its down stroke the piston valve 947 closes through the cooperation of the biasing spring 950, the increasing pressure in the lower chamber, and to some extent inertial effects. As such, whatever air or other fluid is in the lower chamber when the piston 932 begins its down stroke with the valve 947 now closed is then compressed. Eventually, the pressure in the lower chamber is then sufficient to open the lower exit valve 861 of the exit valve assembly 860 against the exit valve biasing spring 864 so that the compressed air can exit the cylinder by passing around the lower valve 861 and into the absorption or reaction chamber 862 and eventually out through the exit port 863 (FIG. 42). Those skilled in the art will appreciate that the reaction chamber 862, and its relatively larger volume as compared to the clearance pocket, enables improved discharge of the compressed air with relatively lower pressure differentials between that of the cylinder and that of the system. FIG. 42 is a close-up perspective view of the outlet port 863.

Figure 37:
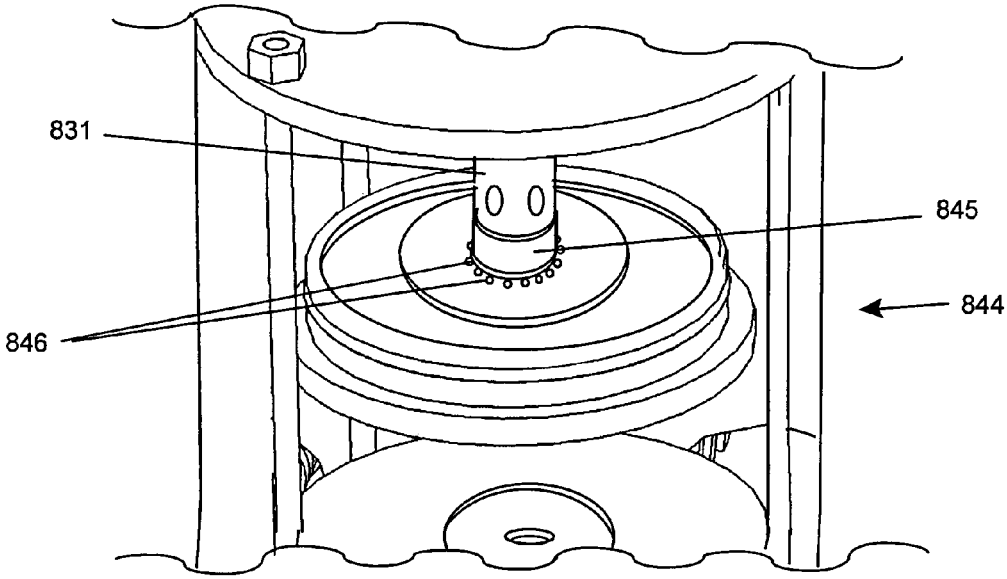
FIG. 37 is an enlarged partial left perspective view thereof, further partially cut-away.
Figure 43:
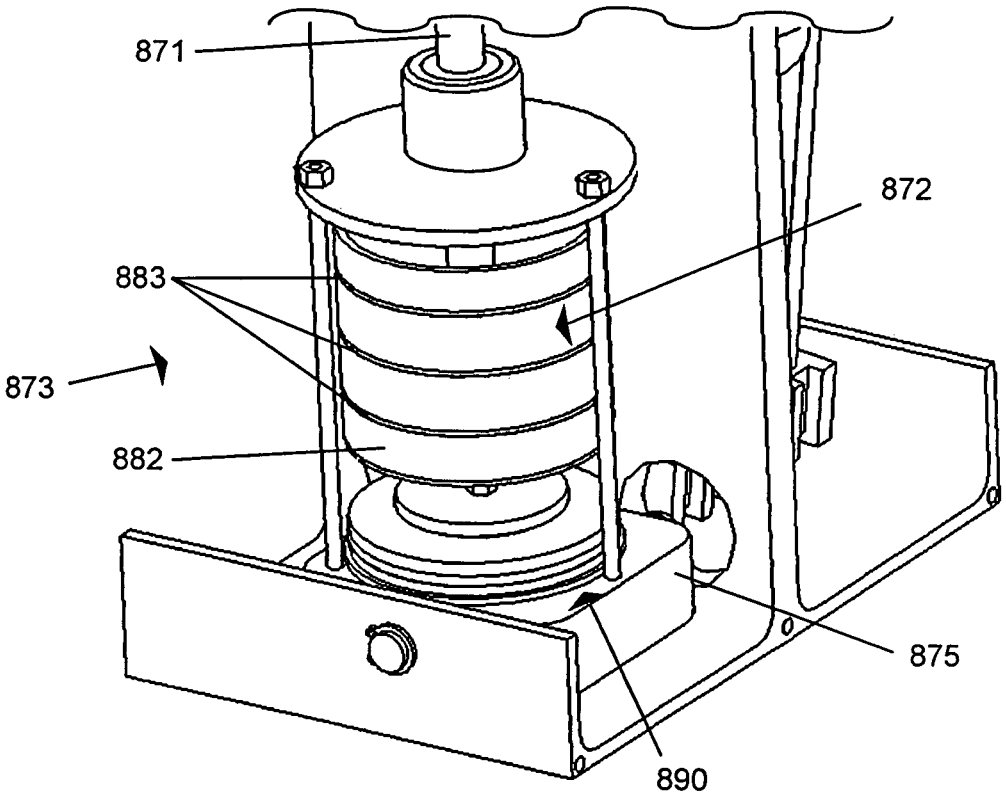
FIG. 43 is an enlarged partial right perspective view thereof, partially cut-away.
Figure 44:
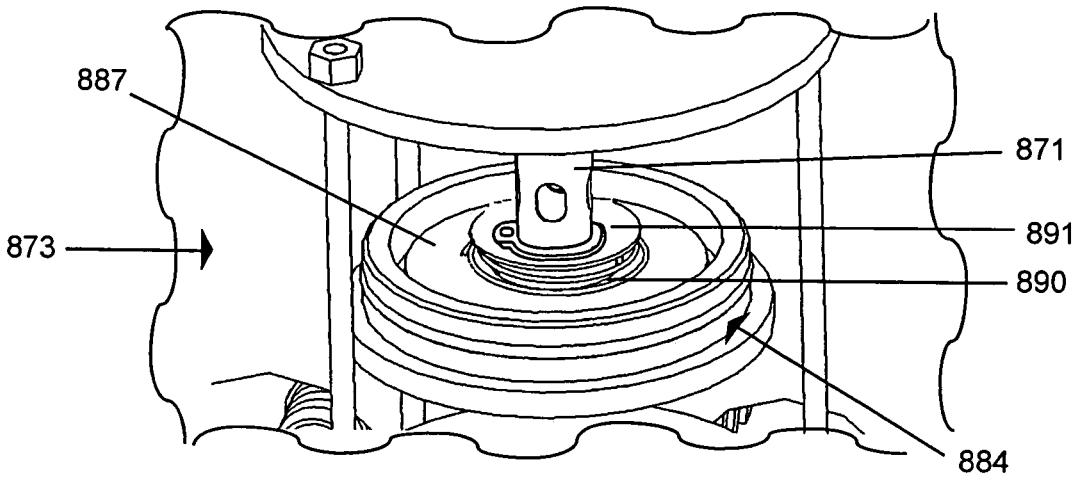
FIG. 44 is an enlarged partial right perspective view thereof, further partially cut-away.
Figure 45:
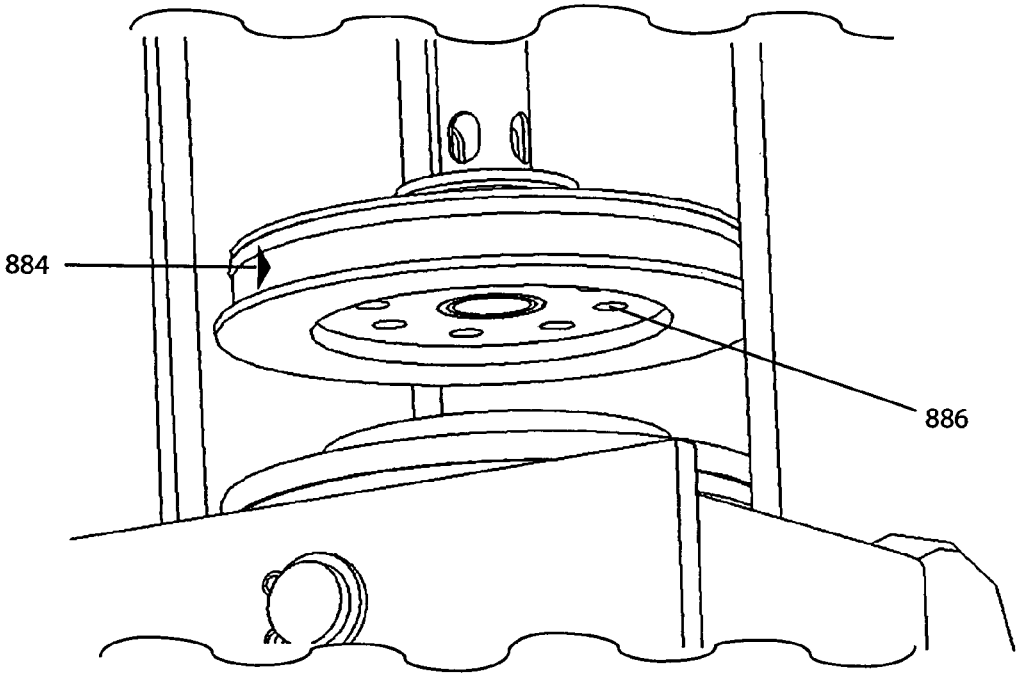
FIG. 45 is an enlarged partial right perspective view as partially cut-away as shown in FIG. 44, as now viewed substantially from below.
Figure 46:
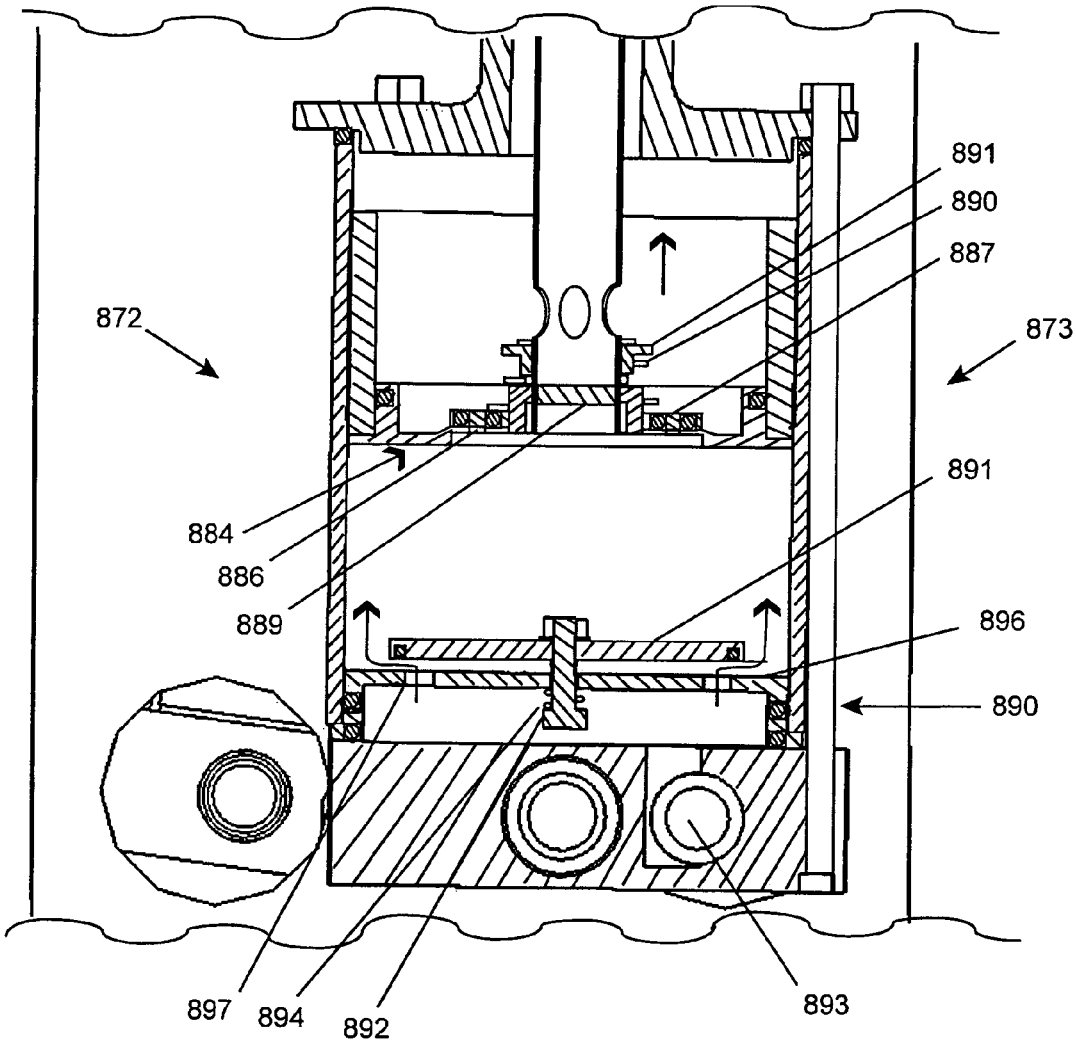
FIG. 46 is an enlarged partial cross-sectional view of a further alternative exemplary piston-cylinder unit thereof on its upstroke.
Figure 47:
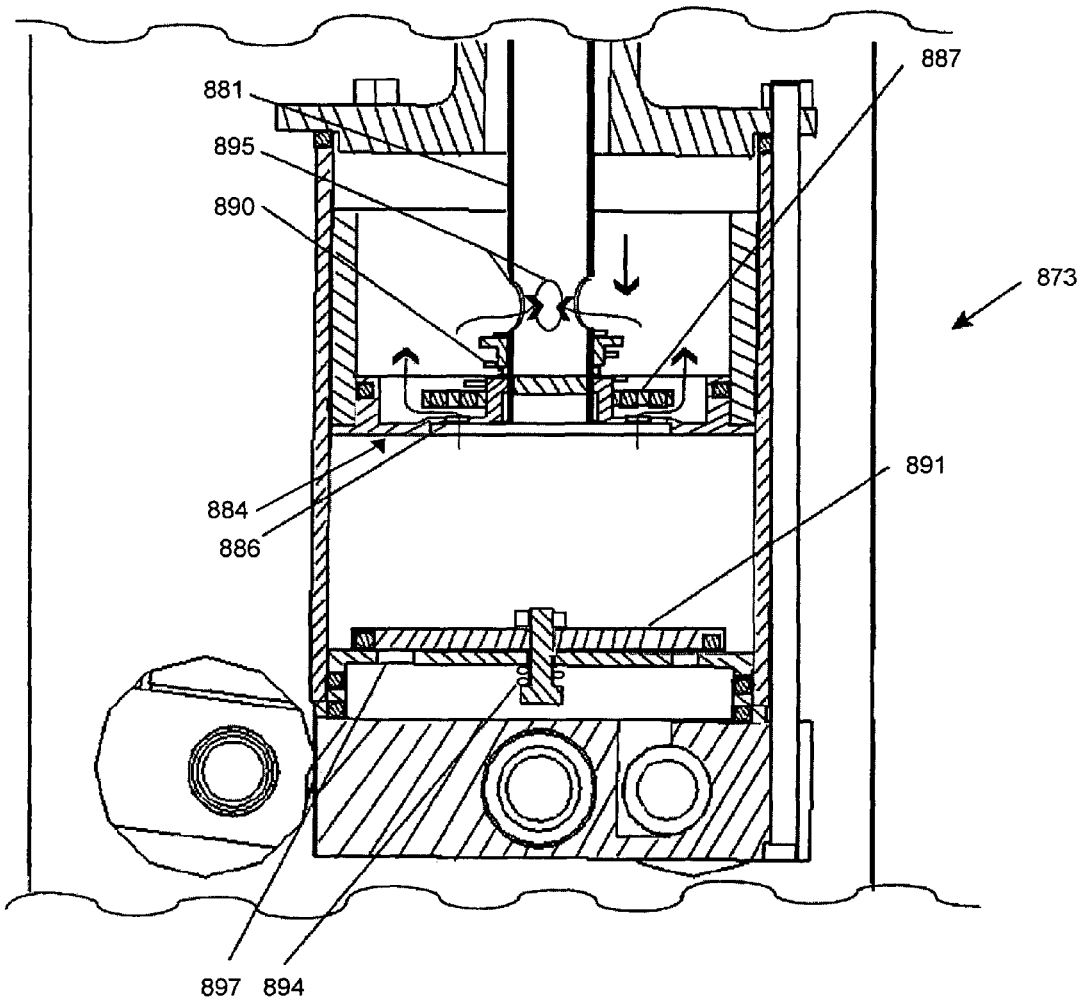
FIG. 47 is a partial cross-sectional view of the alternative exemplary piston-cylinder unit thereof shown in FIG. 20 now on its down stroke.

Referring now to FIGS. 43-45, there are shown enlarged, partial perspective views of the vacuum pump cylinder 870 analogous to those view of FIGS. 36 and 37 for the compressor unit 830. First, in FIG. 43, the vacuum piston 872 is again shown with the cylinder body 874 removed and as having an annular piston body 882 therein formed with circumferential, spaced-apart grooves 883 therealong. At the lower end of the vacuum pump cylinder 873 mounted on or integral with the base 875 is an annular inlet valve assembly 890 that selectively allows for the passage of air into the lower chamber on the piston's upstroke so as to effectively pull a vacuum, which air is then evacuated through the piston rod 871 on the piston's down stroke, as explained below in connection with FIGS. 46 and 47. The base 875 and/or inlet valve assembly 890 may be glass-filled nylon, Delrin, aluminum, or magnesium, though, again, it will be appreciated that any material now known or later developed may be employed without departing from the spirit and scope of the invention. In FIG. 44 there is shown a further enlarged perspective view of the vacuum pump cylinder 873 now with the cylinder body 874 also removed to reveal the piston valve 887 as again a floating disk now installed on the upper side of the piston base 884. The valve 887 is biased closed against the piston base 884 so as to selectively seal the through-holes 886 formed therein, as best seen in FIG. 45. A spring 890 secured about the piston rod 871 relative to the valve 887 by a keeper washer 891 or the like provides the biasing force in the exemplary embodiment, though it will be appreciated by those skilled in the art that a variety of mechanical arrangements for achieving the necessary selective opening and closing of the vacuum piston valve 887, or any other such valve incorporated in the present invention, are possible without departing from the spirit and scope of the invention. Once again, the lower end of the piston rod 871 is plugged by a plug 889, as best seen in FIGS. 46 and 47. In the exemplary vacuum pump unit 870, the cylinder 873 again has a roughly two inch (2 in) nominal diameter with a nominal stroke length of one and a quarter inch (1¼ in).

During operation of the vacuum pump cylinder 870, then, as shown in FIGS. 46 and 47, first, when the piston 872 is on its upstroke as in FIG. 46, the lower inlet valve 891 of the inlet valve assembly 890 is opened by the vacuum force against the resistance of the biasing spring 894 held in place by and operating against a bolt 892 that is integral with the valve disk 891 and passes through the upper wall 896 of the inlet valve assembly 890. With the lower inlet valve 891 so opened, air can be pulled into the lower chamber from the inlet port 893 by passing through the hollow interior of the inlet valve assembly 890 and through-holes 897 formed in the assembly's upper wall 896 and then around the raised inlet valve 891 and into the lower chamber of the vacuum pump cylinder 873 below the piston 872. It will be appreciated that the vacuum in the lower chamber is possible because the selectively openable piston valve 887 is closed against the upper surface of the piston base 884, again, as by primarily the biasing spring 890, though in part also by inertial effects and gravitational effects. Finally, referring to FIG. 47, the vacuum pump piston 872 is now on its down stroke, which amounts to the exhaust stroke for the vacuum pump unit 870. As the piston 872 starts on its way down, the decreasing vacuum in the lower chamber in cooperation with the biasing spring 894, at equilibrium serves to now close the lower inlet valve 891. The corresponding or resulting decrease in pressure turning into vacuum within the upper chamber itself as the piston 872 moves downwardly then forces the piston valve 887 open against its respective biasing spring 890. This allows the air in the lower chamber drawn in on the preceding upstroke to pass through through-holes 886 formed in the piston base 884 and around the piston valve 887 into the upper chamber or the space within the cylinder 873 above the piston 872. Then, when the piston 872 starts back on its upstroke and the piston valve 887 again closes, it will be appreciated that the air in the upper chamber would then simply flow through the cross-holes 895 formed in the piston rod 881 and then up the hollow bore of the piston rod 871 and out of the system through the block 907 (FIG. 29). As such, those skilled in the art will thus appreciate that while on the compressor side, air is drawn in through the piston rod, compressed in the lower chamber and pushed out through the lower valve all in cooperation with a selectively openable piston valve, on the vacuum pump side, air is instead drawn in through the lower valve as a vacuum is pulled in the lower chamber and then evacuated through the piston rod after passing through the selectively openable piston valve and entering the upper chamber. It will be further appreciated that the opposite arrangement for both compression and vacuum could just as easily be achieved by doing the work in the upper chamber above the piston. Accordingly, the invention is not limited to any particular air flow or direction for compression or vacuum and the exemplary embodiments are to be understood as merely illustrative.

As best shown in FIGS. 38-41, 46, and 47, each of the piston valves and lower exit or inlet valves is in the exemplary embodiments generally selectively openable through a floating disk that is biased against a surface having through-holes. To effectively seal those through-holes when the respective disk is shifted in the direction of the surface in which the through-holes are formed, it will be appreciated that, as shown, one or more o-rings are positioned in the appropriately sized and located retention channels so that such o-rings are squeezed between engaging surfaces and thereby form a relatively air-tight seal. Specifically, in the compressor piston-cylinder unit 830, a single o-ring 866 may be installed within a groove in either the piston base 944 or the valve disk 847, in either case, in the exemplary embodiments, the o-ring 866 being located radially outward of the through-holes 846 so as to achieve a sufficient seal, while in the vacuum pump piston-cylinder unit 870, the valve disk 887 is configured with two concentric grooves in which are seated two o-rings, the locations of the grooves and o-rings being respectively radially inward and outward of the through-holes 886 so as to bound and selectively seal the through-holes 886 during operation. Numerous other configurations of such seals, and the o-rings particularly, including but not limited to the various other valve designs shown and described in the prior pending patent applications referred to above and incorporated herein by reference may also be employed, such that those skilled in the art will appreciate that the valves shown and described in the exemplary embodiments of the present invention are merely illustrative and that the invention is not so limited. Any of the disk valves employed in the present invention may be formed of glass-filled nylon, Delrin, aluminum, magnesium, or any other such suitable material now known or later developed. Or, in an alternative embodiment as shown and described above in connection with FIGS. 9-16, the floating disk valves may instead be formed of urethane or some other material that itself forms a sufficient seal against any mating surface, such that separate o-rings are not needed, the urethane or other such disk valve optionally being further configured with a supportive backing plate. These and other such alternative valve constructions are possible in the present invention without departing from its spirit and scope. With regard to the clearance pocket, specifically, or the space between the piston and the lower valve when the piston reaches its full down stroke, or bottom-dead-center, position, the negative effects of such clearance pockets are further reduced in the exemplary embodiments of the present invention wherein the entire clearance pocket basically consists of a counter-bore recess in either the lower valve or the lower end of the piston rod formed to accommodate the head of the respective bolt holding the disk valve of either the piston, in the case of the compressor unit, or the lower inlet valve, in the case of the vacuum pump unit. In either case, the greatly reduced clearance pockets are made possible, at least in part, by having one valve on each surface. With respect to the vacuum pump unit 870, particularly, it is noted that the geometry of the bottom side of the piston 872 is not shown to scale relative to the geometry of the top side of the inlet assembly 890 so that the inlet valve 891 can substantially seat within the corresponding recess in the piston 872 as intended by design. The clearance pocket ratio is further improved by virtue of favorable or relatively larger stroke-versus-diameter ratios for the various piston-cylinder arrangements. Regarding the piston rod 831 itself, which is a flow path for air or other fluid whether as the intake in the compression unit 830 or the exhaust in the vacuum pump unit 870 of the alternative combination compressor and vacuum pump 820 employing aspects of the present invention, here it is formed in the exemplary embodiments of nominal five-sixteenth inch (5/16 in) diameter chromolly steel, stainless steel, or aluminum alloy. While those skilled in the art will appreciate that the size and material of the rod is merely exemplary and that numerous other sizes may be employed to suit a particular application, as above illustrated in connection with the displacement rod 168, 198 shown and described in connection with FIGS. 1-20, and numerous materials may also be employed, both now known and later developed, it has been discovered that in certain embodiments or applications, as in the relatively low pressure, low flow rate exemplary context of oxygen concentrators employing a combination compressor and vacuum pump, a relatively smaller diameter piston rod, with all else being equal, has certain advantages in that the velocity of air through the rod, and thus the volume and pressure of air entering the upper chamber, is increased, thereby increasing the pre-charging or super-charging effect on the air before it is introduced into the lower chamber for compression, as described in more detail above. Similarly, for the vacuum pump unit, the relatively smaller diameter piston rod causes an increased velocity of the discharged air. In either case, the smaller diameter rod may also serve as a muffler and so minimize the noise from the inner workings of the piston-cylinder exiting through the rod to the atmosphere. Furthermore, as best seen in the same partial cross-sectional views of FIGS. 40, 41, 46, and 47 and particularly the schematic of FIG. 39, for example, the rod may be gimbaled in its installation within the piston, and the piston base, specifically, so as to allow the rod to float a bit and take out slight angular displacement of the rod rather than having resulting side load on the piston. That is, in the exemplary embodiment wherein the piston base sub-assembly 944 is formed with an upwardly-extending collar 945, an internal groove 958 may be formed within the collar 945 for the purpose of receiving an appropriately-sized o-ring 959, whereby the o-ring 959 facilitates installation of the piston rod 831 within the piston base sub-assembly 944 by seating or providing an interference fit therebetween and thus allowing for the piston rod to shift slightly in orientation relative to the piston base sub-assembly 944, and hence the piston body 942, so as to again decrease side load on the piston 932 during use. Those skilled in the art will appreciate that the configurations of the channel 958 and o-ring 959 are merely exemplary and that numerous other configurations in gimbaling the rod 831 within the piston base 944 are possible without departing from the spirit and scope of the invention.

In sum, with respect to the alternative combination compressor and vacuum pump 820 employing aspects of the present invention shown in FIGS. 27-47, those skilled in the art will appreciate that even where the compressor or vacuum pump unit is single-acting and operates at a relatively slow rate, in such relatively low pressure and low flow applications, the required performance is yet obtained while the resulting system enjoys improved breathing, is less prone to vibration and blow-by problems, and is relatively inexpensive and uncomplicated to manufacture. Accordingly, it will be appreciated by those skilled in the art that aspects of the present invention are not limited to any particular configuration of a combination compressor and vacuum pump apparatus or method of use, much less the particular exemplary embodiments shown and described, and that numerous such configurations are possible without departing from the spirit and scope of the invention.

With all of the embodiments of the compression apparatus of the present invention, again, o-rings and the like may be used liberally throughout the construction to provide seals between all mechanically joined components as needed. An example of the kind of o-ring employed in the present invention is a Viton® o-ring having a temperature range of −10 to 400 degrees Fahrenheit (−23 to 204 degrees Celsius). The o-rings may also be made of urethane or EPDM (ethylene propylene) or other such material now known or later developed. Furthermore, it is to be understood that all o-rings are to be seated as by being mechanically trapped or press fit or otherwise secured so as to effectively remain in the positions shown, as by means now known or later developed in the art. The other components shown and described, except as otherwise mentioned, are primarily constructed of aluminum, steel or cast iron. The seal about the piston rod may be a bronze or graphite bushing or a urethane lip seal, as may be the piston wall itself for sealing within the cylinder against the inside surface of the cylinder wall. Moreover, it will be appreciated by those skilled in the art that numerous combinations of the structure and geometry of the drive mechanism and the cylinder arrangements shown and described can be practiced depending on the application and performance requirements. Drives and cylinders can be mixed and matched to suit particular needs, such that the embodiments shown are to be understood as merely exemplary. Particularly, the lengths and diameters of the cylinders and piston assemblies can vary widely from the geometries shown and described without departing from the spirit and scope of the invention. Specifically, while the displacement rod is shown and described herein as being tubular or annular, it will be appreciated that the rod can take a variety of configurations without departing from the invention. Again, the cylinders themselves can be arranged in parallel or in series, and the described advantages can be achieved using the disclosed drive mechanisms with virtually any cylinder arrangement now known or later developed, and need not be the novel cylinder design of the present invention whereby the rod is sufficiently large relative to the cylinder to cooperate with the piston in compressing fluid within the cylinder. Or, advantages in construction and use can be achieved through the novel cylinder design of the present invention involving the displacement rod, among other things, and, in an alternative embodiment, a floating piston valve, again, whether the cylinder is single-acting or double-acting, single-staged or multi-staged, or actuated by a drive mechanism alone or along with other cylinders, and so need not involve any of the particular drive mechanisms disclosed to still derive the advantages of the cylinder constructions described herein. Thus, while use of both the disclosed drive mechanisms and cylinders is preferable, it is not required and the invention is not so limited.

Accordingly, it will be appreciated by those skilled in the art that the present invention is not limited to any particular configuration of the compression apparatus and its cylinder or cylinders, and that numerous such configurations are possible without departing from the spirit and scope of the invention. Therefore, aspects of the present invention may be more generally described as mechanisms by which one or more piston-cylinder arrangements are driven so as to achieve dynamic movement of the piston within the cylinder while minimizing side loads and by which such piston-cylinder units are themselves configured with piston rod and piston and piston valve configurations to achieve the desired fluid movement and compression in various contexts. Variations of such structure and resulting benefits of operation are possible without departing from the spirit and scope of the invention.

While aspects of the invention have been described with reference to at least one exemplary embodiment, it is to be clearly understood by those skilled in the art that the invention is not limited thereto. Rather, the scope of the invention is to be interpreted only in conjunction with the appended claims and it is made clear, here, that the inventor believes that the claimed subject matter is the invention.

What is claimed is:

1. A compression apparatus for compressing a fluid, the apparatus having a frame and a motor mounted to the frame, the improvement comprising:

a drive mechanism installed on the frame so as to be driven by the motor, wherein the drive mechanism comprises:

first and second timing pulleys rotatably mounted in spaced apart relationship on a common side of the frame;

a drive pulley installed on a drive shaft of the motor so as to be positioned substantially co-planar with the first and second timing pulleys; and a timing belt configured to engage the drive pulley and the first and second timing pulleys; and at least one piston-cylinder unit operably connected to the drive mechanism, the piston-cylinder unit having:

a cylinder;

a piston slidably installed within the cylinder, wherein the piston comprises a piston body having at least one through-hole formed therein for communication between a first space below the piston within the cylinder and a second space above the piston within the cylinder;

a displacement rod interconnecting the piston and the drive mechanism so as to shift the piston up and down within the cylinder, the displacement rod having:

a hollow configuration adapted to receive the fluid into an inner volume of the displacement rod; and an outside diameter relative to the inside diameter of the cylinder such that the ratio of the nominal surface area below the piston to the nominal surface area above the piston is in the range of 1.1 to 20, whereby the displacement rod serves to displace volume within the second space and thereby participate in the compression of the fluid within the at least one piston-cylinder unit;

a bottom cap installed on the displacement rod adjacent to the piston and having at least one bottom channel formed therein for >communicating the fluid between the displacement rod and the first space below the piston;

a first piston valve installed on the piston for selectively controlling the passage of the fluid between the displacement rod and the first space; and a second piston valve installed on the piston for selectively controlling the passage of the fluid through the at least one through-hole.

2. The apparatus of claim 1, wherein:

the first and second timing pulleys are installed on respective first and second timing pulley shafts that pass through the frame;

first and second timing pulley couplings are installed on the respective first and second timing pulley shafts opposite the first and second timing pulley and offset from each other and from the central axes of the respective first and second timing pulley shafts so as to serve as crank, arms, for the at least one piston-cylinder, unit; and the displacement rod is connected to the first timing pulley coupling and the cylinder is configured with a base installed on the second timing pulley coupling, whereby rotational movement of the first and second timing pulleys as driven by the motor through the drive pulley and the timing belt shifts the cylinder and the displacement rod spatially so as to drive the piston up and down within the cylinder.

3. The apparatus of claim 2, wherein a first, piston-cylinder unit is operably connected to the drive mechanism through the first and second timing pulley couplings; and first and second timing pulley cranks are installed directly on the first and second timing pulleys offset from each other and from the central axes of the respective first and second timing pulley shafts so as, to serve as crank arms for a second piston-cylinder unit also driven by the drive mechanism as the first and second timing pulleys rotate, the second piston-cylinder unit having a second cylinder, a second piston slidably installed within the second cylinder, and a second displacement rod connected to the first timing pulley crank and a second base of the second cylinder installed on the second timing pulley crank.

4. The apparatus of claim 1, wherein the cylinder comprises a collar assembly installed on the cylinder wall through which the displacement rod slidably and sealingly passes, the collar assembly including an exit hole in which a connector is installed for transfer of the fluid.

5. The apparatus of claim 4, wherein the collar assembly comprises:

a lower collar member installed on the cylinder wall having at least one passage formed therein;

a spring-biased lower collar member valve shiftably installed adjacent the lower collar member so as to selectively seal the at least one passage; and an upper collar member installed on the lower collar member such that an annular space is formed between the lower and upper collar members through which the fluid selectively passes to the exit hole after having passed through the at least one passage as allowed by the lower collar member valve.

6. The apparatus of claim 5, wherein the collar assembly further comprises a bushing installed between the lower and upper collar members for a reduced friction seal about the displacement rod as it moves up and down within the cylinder through the collar assembly.

7. The apparatus of claim 6, wherein o-rings are installed between the bushing and the lower and upper collar members, whereby the bushing is resiliently mounted within the collar assembly.

8. The apparatus of claim 1, wherein the cylinder comprises a base cap installed on the cylinder wall having a profile substantially conforming to that of the piston, including a downwardly-extending piston wall of the piston, whereby a clearance pocket below the piston at the bottom of the stroke of the piston-cylinder unit is reduced.

9. The apparatus of claim 1, wherein the displacement rod further comprises a top cap installed on the displacement rod and having at least one top channel formed therein for communication between the space surrounding the piston-cylinder unit and the inner volume of the hollow displacement rod.

10. The apparatus of claim 1, wherein:

the piston further comprises a piston wall installed on the piston body for slidably sealing against the cylinder wall;

the first piston valve comprises a urethane disk configured to selectively seal the at least one bottom channel from the first space below the piston; and the second piston valve comprises a urethane disk configured to selectively seal the at least one through-hole formed in the piston body.

11. The apparatus of claim 1, wherein the at least one piston-cylinder unit is further formed having a reaction chamber in an exit collar assembly of the cylinder, whereby compressed fluid is stored in the reaction chamber as a pre-charged, pressurized fluid to be pushed into a subsequent compression stage.

12. The apparatus of claim 1 further comprising:

a tube sealingly installed about the cylinder, the tube being sealed at the top and bottom of the cylinder by an o-ring and secured by top and bottom end caps, whereby a hermetically sealed annular space is formed about the cylinder between a wall of the cylinder and the tube; and a fluid inserted into the annular space so as to facilitate conductive and convective heat transfer away from the cylinder.

13. The apparatus of claim 12 wherein the tube is configured with an inlet port and an outlet port, whereby the fluid may be circulated so as to further facilitate conductive and convective heat transfer out of the cylinder.

14. The apparatus of claim 1 further comprising: a second piston-cylinder unit operably connected to the drive mechanism so as to effectively lag the first piston-cylinder unit by approximately one to ninety degrees (1 ° -90° ), the second piston-cylinder unit having a second cylinder, a second piston slidably installed within the second cylinder, and a second piston rod driving the second piston up and down within the second cylinder.

15. The apparatus of claim 14, wherein:

the first and second piston-cylinder units are arranged in series as in a multi-staging set up;

a first line is connected to an exit valve of the first piston-cylinder unit;

a second line is connected to an inlet valve of the second piston-cylinder unit; and an intermediate surge tank is connected between the first and second lines.

16. A compression apparatus for compressing a fluid, the apparatus having a frame and a motor mounted to the frame, the improvement comprising:

a drive mechanism installed on the frame so as to be driven by the motor, wherein the drive mechanism comprises:

first and second timing pulleys rotatably installed on respective first and second timing pulley shafts in a spaced apart relationship on a common side of the frame, wherein:

the first and second timing pulley shafts that pass through the frame; and first and second timing pulley couplings are installed on the respective first and second timing pulley shafts opposite the first and second timing pulley and offset from each other and from the central axes of the respective first and second timing pulley shafts so as to serve as crank arms for the at least one piston-cylinder unit;

a drive pulley installed on a drive shaft of the motor so as to be positioned substantially co-planar with the first and second timing pulleys; and a timing belt configured to engage the drive pulley and the first and second timing pulleys; and at least one piston-cylinder unit operably connected to the drive mechanism, the piston-cylinder unit having:

a cylinder, a piston slidably installed within the cylinder, and a displacement rod interconnecting the piston and the drive mechanism so as to shift the piston up and down within the cylinder, the displacement rod having an outside diameter relative to the inside diameter of the cylinder such that the ratio of the nominal surface area below the piston to the nominal surface area above the piston is in the range of 1.1 to 20, whereby the displacement rod serves to displace volume and thereby participate in the compression of the fluid within the at least one piston-cylinder unit and wherein the displacement rod is connected to the first timing pulley coupling and the cylinder is configured with a base installed on the second timing pulley coupling, whereby rotational movement of the first and second timing pulleys as driven by the motor through the drive pulley and the timing belt shifts the cylinder and the displacement rod spatially so as to drive the piston up and down within the cylinder.

17. The apparatus of claim 16, wherein a first piston-cylinder unit is operably connected to the drive mechanism through the first and second timing pulley couplings; and first and second timing pulley cranks are installed directly on the first and second timing pulleys offset from each other and from the central axes of the respective first and second timing pulley shafts so as to serve as crank arms for a second piston-cylinder unit also driven by the drive mechanism as the first and second timing pulleys rotate, the second piston-cylinder unit having a second cylinder, a second piston slidably installed within the second cylinder, and, a second displacement rod connected to the first timing pulley crank and a second base of the second cylinder installed on, the second timing pulley crank.

18. A compression apparatus for compressing a fluid, the apparatus having a frame and a motor mounted to the frame, the improvement comprising: a drive mechanism installed on the frame so as to be driven by the motor; and at least one piston-cylinder unit operably connected to the drive mechanism, the piston-cylinder unit having: a cylinder, comprising: a cylinder wall; and a collar assembly installed on the cylinder wall through which a displacement rod slidably and seatingly passes, tile collar assembly including an exit hole in which a connector is installed for transfer of the fluid, wherein the collar assembly comprises: a lower collar member installed on the cylinder wail having at least one passage formed therein; a spring-biased lower collar member valve shiftably installed adjacent the lower collar member so as to selectively seal the at least one passage; and an upper collar member installed on the lower collar member such that an annular space is formed between the lower and upper collar members through which the fluid selectively passes to the exit hole after having passed through the at least one passage as allowed by the lower collar member valve; a piston slidably installed within the cylinder, and a displacement rod interconnecting the piston and the drive mechanism so as to shift the piston up and down within the cylinder, the displacement rod having an outside diameter relative to the inside diameter of the cylinder such that the ratio of the nominal surface area below the piston to the nominal surface area above the piston is in the range of 1.1 to 20, whereby the displacement rod serves to displace volume and thereby participate in the compression of the fluid within the at least one piston-cylinder unit.

19. The apparatus of claim 18, wherein the collar assembly further comprises a bushing installed between the lower and upper collar members for a reduced friction seal about the displacement rod as it moves up and down within the cylinder through the collar assembly.

20. The apparatus of claim 19, wherein o-rings are installed between the bushing and the lower and upper collar members, whereby the bushing is resiliently mounted within the collar assembly.

* * * * *